US005590168A

United States Patent [19]

Iketaki

[11] Patent Number: 5,590,168

[45] Date of Patent: Dec. 31, 1996

[54] X-RAY MICROSCOPE

[75] Inventor: Yoshinori Iketaki, Oume, Japan

[73] Assignee: Olympus Optical Co., Ltd., Tokyo, Japan

[21] Appl. No.: 466,973

[22] Filed: Jun. 6, 1995

Related U.S. Application Data

[62] Division of Ser. No. 171,719, Dec. 22, 1993, Pat. No. 5,450,463.

[30] Foreign Application Priority Data

| | | | |
|---|---|---|---|
| Dec. 25, 1992 | [JP] | Japan | 4-347051 |
| Dec. 25, 1992 | [JP] | Japan | 4-347083 |
| Mar. 1, 1993 | [JP] | Japan | 5-040012 |
| Mar. 2, 1993 | [JP] | Japan | 5-041219 |
| Mar. 11, 1993 | [JP] | Japan | 5-050873 |
| Mar. 12, 1993 | [JP] | Japan | 5-052269 |
| Mar. 12, 1993 | [JP] | Japan | 5-052410 |

[51] Int. Cl.[6] ..... G21K 7/00

[52] U.S. Cl. ..... 378/43; 378/161

[58] Field of Search ..... 378/43, 161, 140, 378/204

[56] References Cited

U.S. PATENT DOCUMENTS

| | | | |
|---|---|---|---|
| 5,216,699 | 6/1993 | Iketaki | 378/161 |
| 5,226,065 | 7/1993 | Held et al. | 378/64 |

FOREIGN PATENT DOCUMENTS 4140651 5/1992 Japan .

OTHER PUBLICATIONS

Borghesi, et al, "Graphite (C)", Handbook of Optical Constants of Solids (1991), pp. 449–460.

Klems, "X–ray Absorption in Valence–excited Molecules as a Possible Contrast Mechanism for Chemically Sensitive Imaging and Spectroscopy", Feb. 15, 1991, pp. 2041–2045, Physical Review A, vol. 43, No. 4.

Henke, et al, "Low–Energy X–Ray Interaction Coefficients: Photoabsorption, Scattering, and Reflection", pp. 1 and 27, Copyright 1982 by Academic Press, Inc.

Krause, "Automaic Radiative and Radiationless Yields for K and L Shells", 1979, pp. 307–327, J. Phys. Chem. Ref. Data, vol. 8, No. 2.

Campbell, et al, "KαKβ, and Radiative Auger Photon Intensities in K X–Ray Spectra from Atoms in the 20≦ Z ≦ 40 Region", Apr. 1986, pp. 2410–2417, Physical Review A, vol. 33, No. 4.

Aoki, "X–Ray Optical Elements and Their Applications", pp. 342–351, Institute of Applied Physics, University of Tsukuba, 1986.

*Primary Examiner*—Don Wong

*Attorney, Agent, or Firm*—Watson Cole Stevens Davis, P.L.L.C.

[57] ABSTRACT

An X-ray microscope for observing a transmitted X-ray microscopic image of a specimen by irradiating the specimen with X-rays and exciting radiation rays, in which the exciting radiation rays are made incident upon the specimen at a large photon flux in an efficient manner without loss, so that a contrast of the image can be increased. The invention provides a desired relationship between thickness of specimen, wavelength of X-rays and tone resolving power of image fro obtaining a transmitted X-ray microscopic image having an excellent contrast. The invention further proposes optimizations for a photon flux of exciting radiation rays as well am for a timing of irradiation of X-rays and exciting radiation rays. The X-ray microscope can observe particular element contained in particular substance without being affected by the same element contained in other substances which constitute a specimen together with the particular substance by suitably selecting a wavelength of the exciting radiation rays. The invention further propose a secondary electron microscope, in which a specimen is irradiated with X-rays and exciting radiation rays and secondary electrons emitted from the specimen are detected by an electron monochrometer.

1 Claim, 35 Drawing Sheets

Output of MCP 104

Q Switch Signal to UV Laser 81

FIG_29
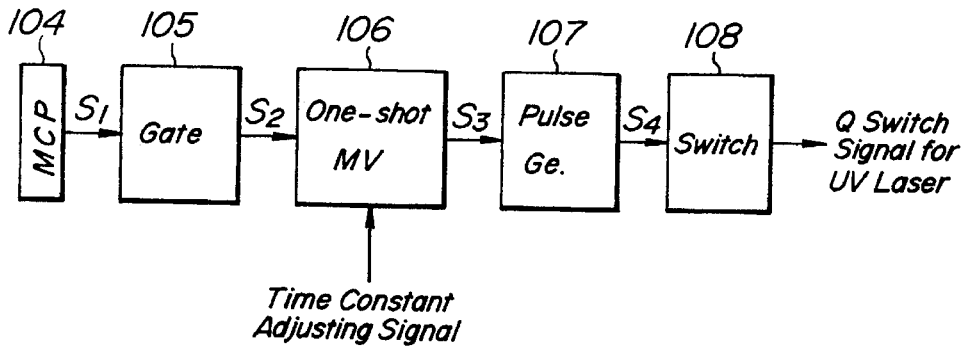
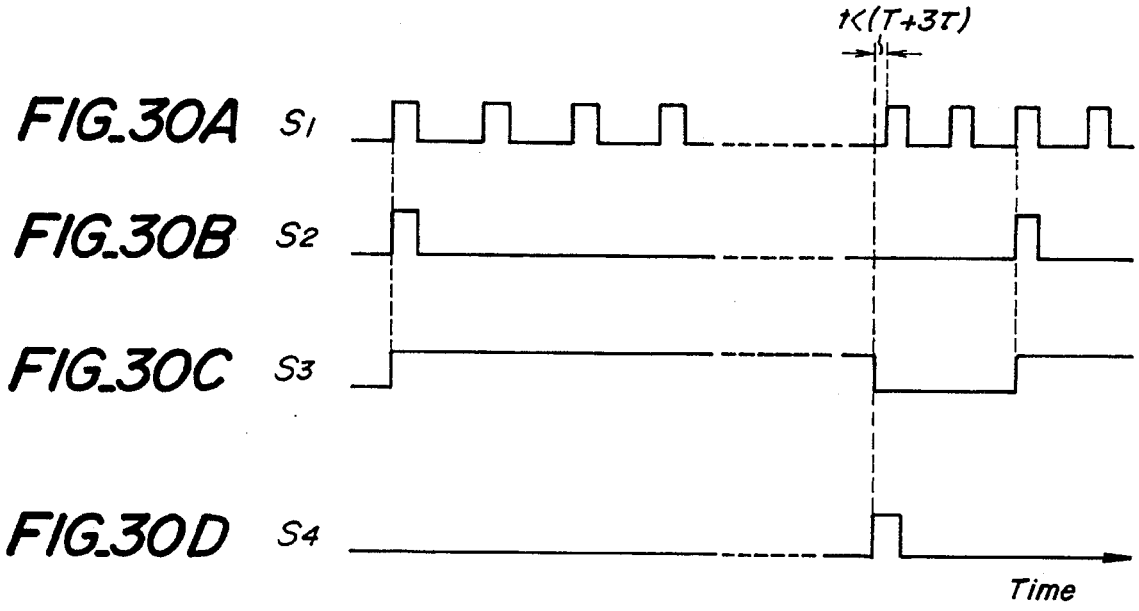

X-RAY MICROSCOPE

This is a division of application Ser. No. 08/171,719, filed Dec. 22, 1993, now U.S. Pat. No. 5,459,463.

BACKGROUND OF THE INVENTION

1. Field of the Invention

The present invention relates to an X-ray microscope for obtaining a transmitted X-ray microscopic image of a specimen such as biological specimen by irradiating the specimen with X-rays and exciting radiation rays.

2. Related Art Statement

Various studies and developments for X-ray radiation sources and X-ray optical elements have been advanced, and one of their application systems, an X-ray microscope has been proposed. In X-ray microscope, there are provided various imaging optical elements such as Wolter type optical element which is a kind of the grazing incident optical element, a zone plate optical system utilizing diffraction, and a Schwarzschild optical system including two spherical mirrors having multilayer coatings applied thereon. Particularly, a soft X-ray microscope using soft X-rays has been developed to a study of biological substances, because damage to the biological substances can be reduced. That is to say, in the soft X-ray microscope, the biological specimens can be observed with a high resolution without dyeing or staining. Generally, a wavelength range of the soft X-rays extends from 2Å which is the longest wavelength of the hard X-rays to 1000Å which is the shortest wavelength of the vacuum ultraviolet rays, so that the wavelength region of the soft X-rays partially overlaps with a wavelength region of extreme ultraviolet rays.

FIG. 1 is a schematic view showing the Wolter optical element, in which X-rays are made incident upon reflecting surfaces illustrated by solid lines at large incident angles (grazing incident) and are reflected thereby due to the total reflection. FIG. 2 is a schematic view depicting the Fresnel zone plate optical element, in which X-rays are reflected by diffraction. FIG. 3 is a schematic view showing the Schwarzschild optical element using two spherical mirrors each having a multilayer coating applied thereon. These X-ray optical elements are well-known in the art and are described in "X-RAY OPTICAL ELEMENTS and THEIR APPLICATIONS", Sadao AOKI, Applied Physics, Vol 56, No. 3, 1987, pp. 342(44)–351(53), so that their detailed explanation is omitted here.

Among the soft X-ray wavelength region, soft X-rays within a wavelength region of $\lambda$=43.7Å to 23.6Å, i.e. a so-called water window region between the K$\alpha$ absorption edge of carbon and the K$\alpha$ absorption edge of oxygen are important, because the absorption of the soft X-rays of this region by carbon and nitrogen is large, while that by water composed of oxygen and hydrogen is small. Therefore, by using the soft X-rays of the water window region, it is possible to observe biological specimens mainly composed of proteins (living tissues) with high resolution in water. Due to this fact, research institutions have endeavored to develop optical elements, radiation sources and detectors having high performance for the soft X-rays of the wavelength region of 43.7 to 23.6Å.

As stated above, the soft X-rays within the above mentioned wavelength region are suitable for inspecting the biological substances, however it is practically difficult to manufacture the optical elements, radiation sources, detectors and so on having excellent property due to the following reason. Firstly, it is very difficult to manufacture the X-ray multilayer reflecting mirror and filter having superior characteristics for the soft X-rays of the above mentioned wavelength region. That is to say, upon designing the multilayer reflecting mirror having a high reflectance, it is required that two kinds of substances with the largest possible difference between their refractive indices are built up alternately to form a multilayer film. However, the refractive indices of almost all substances for the X-rays are close to unity, and thus it is difficult to choose two kinds of substances with the large difference in the refractive index. Although a proposal has been made for materials of the multilayer coating whose reflectances are expected to be somewhat improved, such as multilayer films Ni/Sc and Ni/Ti having a structure of laminating alternately Ni (nickel) and Sc (scandium) and Ni and Ti (titanium), these materials are liable to be crystallized during the evaporation, and this makes it difficult to deposit a uniform film. Furthermore, when the normal incident mirrors are to be formed by the presently developed technique, a period or pitch of a multilayer coating for the wavelength region of 43.7 to 23.6Å becomes smaller than 20Å, so that the fabrication of the thin multilayer film is difficult. Still further, in the wavelength region of 43.7 to 23.6Å, the absorption of X-rays in terms of carbon is high and thus it is impossible to utilize organic materials as filters and a choice of filter materials is limited. In the X-ray microscope, it is necessary to provide the multilayer coatings and filters, but the above problems become obstacles upon utilizing the soft X-rays.

Even though the above mentioned first problem were solved, there is remained a second problem which will be explained next. This second problem relates to a quality of the transmitted X-ray image of a specimen, particularly the decrease in contrast of the image. That is to say, the absorption of the soft X-rays by a living specimen is determined by a thickness of the specimen, a density of nitrogen contained in the specimen and a wavelength of the X-rays, and therefore when the specimen has a large thickness and a high density of nitrogen, a substantial part of the X-rays is absorbed by the specimen and thus the transmitted X-ray image of the specimen becomes dark. When a thin specimen having a low nitrogen density is observed, almost all incident X-rays are transmitted through the specimen and thus a transmitted X-ray image becomes bright. In both cases, the constant of the transmitted X-ray image is very low.

The above mentioned second problem could be solved by adjusting the thickness of the specimen or by adjusting the wavelength of the X-rays within the wavelength region of 43.7 to 23.6Å, because the nitrogen density of the specimen could never be artificially adjusted. In the first solution, the thickness of the specimen is adjusted with the aid of a precision machine such as a microtome which requires high operator skill for cutting the specimen to reduce its thickness. Further, the cutting operation has to be repeated through the rule of trial and error and requires a long time. Therefore, this solution is not practical at all. The second solution requires a wide change in design and layout of the microscope optical systems in using the X-ray optical elements such as zone plate and Schwarzschild optical element, so that this solution is also of little practical use and at variance with the reality.

There has been proposed an X-ray microscope using X-rays of a wavelength region of, e.g. 65 to 43.7Å other than the above mentioned region of 43.7 to 23.6Å in which a microscopic image of a specimen of a particular protein molecule can be obtained with high contrast. Now a principle of this X-ray microscope will be explained with reference to FIGS. 4 and 5. FIGS. 4A to 4F represent the transition process of electron in carbon atom upon absorbing X-rays. FIG. 4A shows an electron arrangement within the carbon atom in the ground state. When the carbon atom is irradiated with X-rays, an electron E in the 1*s* orbit is ionized as illustrated in FIG. 4B (this is referred to as a first transition) and a hole is formed in the 1*s* orbit as depicted in FIG. 4C. This condition is very unstable in the view point of energy, so that an electron in the 2*p* orbit is transfers into the 1*s* orbit (this is termed as a second transition) to secure its stability as shown in FIG. 4D. When the carbon atom constitutes a protein molecule, a hole formed in the 2*p* orbit (see FIG. 4E) captures an electron (a third transition) from a surrounding constituent element to resume the initial ground state as shown in FIG. 4F. During the above mentioned transition process, the transmitted X-ray microscopic image of protein is obtained by utilizing the first transition. However, if a wavelength of the used X-rays is longer than the absorption edge of the carbon, the X-rays could not be absorbed by the protein, and thus the contrast of the obtained microscopic image is decreased extremely.

Now considering the preceding electron transitions from their reverse processes, it is recognized that even though the wavelength of the X-rays is longer than the absorption edge of carbon, the transmitted X-ray microscopic image of protein can be observed with high contrast. At first, from the ground state shown in FIG. 5A, an electron E in the 2*p* orbit is excited or ionized due to an reversed third transition to form a hole in the 2*p* orbit as shown in FIG. 5B. Then, as illustrated in FIG. 5C, an electron in the 1*s* orbit is excited by the irradiation of X-rays into the 2*p* orbit due to the reversed second transition as depicted in FIG. 5D. This reversed second transition can be performed by the X-rays having a photon energy which is lower than the wavelength of the absorption edge of carbon. That is to say, the reversed second transition can be carried out by the X-rays having a wavelength longer than the absorption edge of carbon.

The condition of FIG. 5D is entirely identical with the condition of FIG. 4B which is obtained after the first transition for ionizing the electron in the inner-shell 1*s* from the ground state, but an energy for ionizing or exciting the electron from the 1*s* orbit into the 2*p* orbit is about several to twenty eV (corresponding to a wavelength region of 100 to 300 nm), so that the reversed second transition may be performed by means of an ultraviolet laser. An energy required for exciting the electron from the 1*s* orbit to the 2*s* orbit in FIG. 5D is smaller than an energy required for ionizing the inner-shell electron in FIG. 4B by several to 20 eV. Therefore, by using the two step transition including the process for exciting the electron in the 2*p* orbit and the process for exciting the electron in the 1*s* orbit into the 2*p* orbit as shown in FIGS. 5A to 5D, it is possible to the observe the transmitted image of protein even by using the X-rays of the wavelength longer than the absorption edge of carbon.

The superiority of the above mentioned method using the reversed transitions has been quantitatively confirmed by J. K. klems in X-ray Absorption in Valence-excited Molecules as a Possible Contrast Mechanism for Chemically Sensitive Imaging and Spectroscopy, Physical Review A, Vol. 43, No. 4, Feb. 1991, pp. 2041–2045. In this method, firstly the X-rays having a wavelength longer than the absorption edge of carbon can be used, and therefore the multilayer coating may be formed by materials such as W (tungsten) and C (carbon) which are excellent in optical constant and easy of film fabrication. Moreover, these materials have been studied for a long time and have been actually used. Secondly, a necessary energy for ionizing or exciting the electron in the 2*p* orbit differs for particular proteins, so that carbon atom in a specific protein can be selectively excited or ionized. Further, a value of energy for the succeeding electron transition from the 1*s* orbit into the 2*p* orbit is determined uniquely. Therefore, when X-rays having the equivalent photon energy are taken as a probe, it is possible to obtain the transmitted X-ray image of a desired protein. In this case, the contrast of this transmitted X-ray microscopic image is enhanced by more than one figure compared with the conventional method utilizing the wavelength region of 43.7Å to 23.6Å as shown in FIG. 6.

The above mentioned principle can be easily realized by slightly changing the existing X-ray microscope system. FIG. 7 is a schematic view showing the known X-ray microscope. The X-ray microscope comprises an X-ray source 1 for emitting X-rays having a given wavelength, a condenser lens 2 for projecting the X-rays onto a specimen 3, an objective lens 4, a filter 5 and a detector 6 which are arranged on the same optical axis. The objective lens 4 may be classified into two groups, i.e. a wave dispersion type such as zone plate or the Schwarzschild optical element and a grazing incident mirror type of collecting white light such as Wolter type optical element. When a white light source is used for the X-ray source 1 and the Wolter type objective lens 4 is provided, it is necessary to arrange a spectrometer on the optical path extending to the detector 6. The X-ray detector 6 may be formed by a microchannel plate (MCP) and an imaging element such as charge coupled device (CCD). When the white light radiation source is used, a thin film filter such as beryllium (Be) film for cutting off stray light rays having wavelengths longer than that of ultraviolet is generally arranged in the optical path. In order to avoid the absorption of the X-rays by the air, the above mentioned optical elements are all arranged within a vacuum chamber not shown. The X-ray detector 6 is connected to a signal processing circuit and an image signal produced by this circuit is supplied to a monitor to display a visible image of the specimen on the monitor.

The reversed transition method proposed by J. H. Klems has been applied to the above mentioned X-ray microscope by simply adding ultraviolet ray source 7, condenser lens 8 and ultraviolet (UV) reflection mirror 9 as illustrated in FIG. 8. It should be noted that in U.S. Pat. No. 5,216,699 issued on Jun. 1, 1993 and assigned to the same assignee to whom the present application is also assigned, there is described the X-ray microscope shown in FIG. 8. The UV reflection mirror 9 is inserted between the specimen 3 and the objective lens 4 and has a sufficiently high transmittance for the wavelength region of 65 to 43.7Å and has a sufficiently high reflectance for the ultraviolet rays. Therefore, the UV reflection mirror 9 also serves as the X-ray filter for cutting off the noise, i.e. stray light rays having wavelengths longer than that of the ultraviolet, so that the X-ray filter 5 shown in FIG. 7 is dispensed with. In this X-ray microscope, when the specimen 3 is irradiated with the X-rays having the equivalent energy for effecting the reversed second transition shown in FIG. 4*p* as well as the ultraviolet rays emitted from the UV source 7 by means of the condenser lens 8 and UV reflection mirror 9, the electron in the 2*p* orbit of carbon of a specific protein can be ionized or excited and the transmitted X-ray microscopic image of the specimen 3 can be observed through the process of the transition proposed by J. H. Klems.

The X-ray microscope shown in FIG. 8 has further advantages. That is to say, the absorption coefficient of the X-rays due to a living specimen can be simply changed, so that the contrast of the transmitted X-ray image can be adjusted without changing the thickness of the specimen or the wavelength of the X-rays. The X-ray absorption coefficient of the living substance is proportional to the number of carbon atoms having the holes in the $2p$ orbits after the irradiation with the ultraviolet rays as shown in FIG. 5C and this number is proportional to a photon flux or an amount of the irradiated ultraviolet rays. Therefore, by adjusting a photon flux or an amount of the ultraviolet rays to be made incident upon the living specimen, the absorption coefficient of the X-rays in terms of the living specimen can be changed such that the contrast of the transmitted X-ray image becomes optimum.

Moreover, a transmitted X-ray image of the specimen without the irradiation with the ultraviolet rays is picked-up in addition to the transmitted X-ray image of the same specimen with the irradiation with the ultraviolet rays, and then a differential image of these two X-ray images is derived to remove background noise due to elements other than carbon. The thus obtained differential X-ray image has a superior contrast purely due to carbon.

FIGS. 9 and 10 are schematic diagrams showing another embodiments of the X-ray microscope disclosed in the above mentioned U.S. Pat. No. 5,216,699. The X-ray microscope shown in FIG. 9 comprises an X-ray source 11 formed by a synchrotron radiation (SOR) source, a spectrometer 12, a condenser lens 13 formed by a Fresnel zone plate, an objective lens 14 also formed by a Fresnel lens, and an X-ray detector 16 formed by MCP. These elements are arranged on the same optical axis. A specimen 14 to be inspected is placed between the condenser lens 13 and the objective lens 15. The X-ray microscope further comprises an ultraviolet laser light source 17, a condenser lens 18, a glass wedge 19 and a thin film 20 made of Be (beryllium) which is arranged at 45 degrees with respect to the optical axis. Ultraviolet rays emitted by the UV light source 17 is projected onto the specimen 14 by means of the Be thin film 20. This Be thin film 20 further serves to prevent stray rays such as ultraviolet rays from being incident upon the detector 16.

The wedge 19 is made of a material such as BK7 glass having a high absorption for the ultraviolet rays and is arranged movably with respect to an optical axis as shown by a double headed arrow, so that by adjusting a position of the wedge 19, an optical path length of the wedge through which the ultraviolet rays pass can be changed so as to adjust an amount of ultraviolet rays to be made incident upon the specimen 14. In this manner, a properly adjusted amount of the ultraviolet rays can be projected onto the specimen 14 together with the X-rays, and thus it is possible to obtain a transmitted X-ray microscopic image of the protein specimen having a high contrast compared with the known X-ray microscope.

The X-ray microscope illustrated in FIG. 10 is basically same as that shown in FIG. 9. In this microscope, there is provided a laser plasma source including Nd:YAG laser 21, an X-ray condenser lens 22 is formed by a Wolter type optical element, an objective lens 23 is formed by a Schwarzschild optical element, and a detector 24 is formed by a microchannel plate (MCP). In order to generate X-rays, a laser light beam emitted from the Nd:YAG laser 21 is made incident upon a target 25 by means of a half mirror 26 and a condenser lens 27. A part of the laser beam reflected by the half mirror 26 is transmitted through a polarizer 28 to adjust an amount of laser beam passing therethrough, and then the laser beam emanating from the polarizer is made incident upon an optically anisotropic or non-linear crystal 29 such as KDP ($KH_2PO_4$). Then, the ultraviolet rays are converted into fourth order harmonics and the thus converted ultraviolet rays of harmonics are made incident upon an ultraviolet reflecting mirror 32 by means of reflection mirror 30, condenser lens 31 and UV. The ultraviolet rays reflected by the mirror 32 are then made incident upon a specimen 33.

The X-ray microscope shown in FIG. 10 has advantages compared with the X-ray microscope depicted in FIG. 9 that there is not provided the UV light source such as UV laser and the objective lens 23 is formed by the Schwarzschild optical element including the multilayer coatings made of W/C and having an excellent optical property. For instance, the reflectance of a multilayer film composed of 200 membranes coating for the normal incident ultraviolet having the wavelength of 45Å amounts to about 30%, so that it is possible to observe a transmitted X-ray image having a high brightness.

In the X-ray microscopes illustrated in FIGS. 8 to 10, it is essentially required to irradiate the specimen with a sufficiently large amount of the ultraviolet rays in order to observe a transmitted X-ray microscopic image having a high contrast. However, in these X-ray microscopes, the UV light sources are arranged outside the vacuum chamber and the ultraviolet rays are made incident upon the specimen by means of the UV transmissive window provided in the wall of the vacuum chamber, so that a relatively large amount of the ultraviolet rays is absorbed by the air and window and thus an amount of the ultraviolet rays actually impinging upon the specimen is reduced. Therefore, the transmitted X-ray microscopic image having the high contrast could not be obtained. In order to avoid such a drawback, it is necessary to provide a large scale UV light source which can emit a very large amount of ultraviolet rays. But this solution results in high cost.

Furthermore, in the above mentioned X-ray microscopes, the ultraviolet rays are made incident upon the specimen as a diverging ultraviolet beam by means of the thin BE film serving as the ultraviolet reflecting mirror and X-ray filter. Therefore, a photon flux measured at a surface of the specimen is liable to be small, so that the electron in the $2p$ orbit could not be effectively ionized or excited and the contrast of the transmitted X-ray image is liable to be decreased. Moreover, a part of the ultraviolet rays is scattered within the vacuum chamber and stray rays are made incident upon the X-ray detector. This results in white noise in the transmitted X-ray microscopic image and deteriorates the image quality.

As stated above, in the X-ray microscopes shown in FIGS. 8 to 10, the X-ray absorption coefficient of the specimen can be changed by adjusting an amount of the ultraviolet rays impinging upon the specimen without changing a thickness of the specimen. However, the inventors of the present application have found that it is practically difficult to observe the transmitted X-ray microscopic image having a high contrast without adjusting a thickness of the specimen due to the existence of elements contained in a portion of the specimen which portion is free from the irradiation of the ultraviolet rays. In order to observe an optimum X-ray image having a good contrast, the inventors have found that a mutual relationship between a thickness of a specimen, a wavelength of the X-rays and a resolving power of tone has to be established quantitatively. However, no one has proposed such a relationship.

In the X-ray microscopes mentioned above, in order to obtain a transmitted X-ray microscopic image having a good contrast, it is necessary to determine a photon flux or an amount of the ultraviolet rays to be made incident upon the specimen. In other words, the inventors have found that the photon flux of the ultraviolet rays is one of important parameters for observing the X-ray image having an excellent quality. Moreover, if a suitable photon flux is determined, it will be possible to select a suitable ultraviolet light source. The selection of the ultraviolet light source such as a laser is a very important factor for designing and manufacturing actual products and puts a large influence upon cost and performance of products. However, there has not been established a theory for determining the photon flux of the ultraviolet rays to be made incident upon the specimen.

The inventors have further found experimently that the quality of the transmitted X-ray microscopic image obtained by the ultraviolet excitation type X-ray microscope depends on a time period during which the specimen is irradiated with the ultraviolet rays and a timing of the irradiation of the X-rays with respect to the irradiation of the ultraviolet rays. Also in this case, the photon flux of the ultraviolet to be made incident upon the specimen is an important factor.

In the ultraviolet excitation type X-ray microscope explained above, in order to observe various kinds of elements contained in a specimen or in order to observe the same element contained in different substances of the specimen, it is necessary to change a wavelength of the ultraviolet rays. However, in the above mentioned X-ray microscopes, a wavelength of the ultraviolet rays could not be changed or adjusted in accordance with objects to be observed.

As the soft X-ray prove, there has been proposed a secondary electron spectroscopic apparatus, in which particle beam such as electron beam, proton beam, positron beam, neutron beam, and photon beam is projected onto a specimen to emit secondary electrons and a power spectrum of the secondary electrons is detected. Recently, in a field of analyses for semiconductor surface, carbon containing organic substances, semiconductor process such as CVD, and organic electronic devices, there has been required to develop a new estimation by utilizing the electron spectroscopy for chemical analysis (ESCA) and the Auger electron spectroscopy, in which soft X-rays having wavelengths longer than several Å are used as an optical probe. Particularly, there has been required to develop an analysis using soft X-rays having a wavelength longer than 5—as the optical probe for investigating biological substances including oxygen (K absorption edge is 23.32Å), nitrogen (K absorption edge is 30.99Å), carbon (K absorption edge is 43.68Å), phosphorus (L absorption edge is 94Å and K absorption edge is 5.8Å), calcium (L absorption edge is 35Å), sodium (K absorption edge is 11.6Å), magnesium (K absorption edge is 9.5Å).

In presently available estimating apparatuses, a radiation source is formed by an X-ray tube, and thus use may be made of characteristic X-rays having a wavelength shorter than several Å. Therefore, when a specimen mainly composed of carbon is to be estimated, its absorption coefficient is too small to yield a large amount of photoelectrons or Auger electrons, so that a sensitivity of analysis is liable to be low. Further, only the characteristic X-rays can be used, it is impossible to perform various analyses and elements can not be judged precisely.

In view of the above fact, there has been desired to develop a novel estimation using the soft X-rays having a wavelength longer than several Å. However, in order to obtain white soft X-rays, it is necessary to provide a large scale synchrotron radiation source (SOR) which could be hardly utilized by general users.

In order to avoid the above mentioned drawbacks, there has been proposed in Japanese Patent Laid-open Publication Kokai Hei 4-140651 an electron spectroscopic analyzing apparatus using a laser plasma light source. In this analyzing apparatus, a laser beam having an intensity higher than $10^{12}$W/cm$^2$ is projected upon a target made of a metal under a pressure lower than $10^{-4}$ Torr and the target metal is brought into a plasma condition to emit soft X-rays having a wavelength longer than 5Å. Therefore, the light source can be simply realized by means of easily available YAG laser and vacuum chamber.

The soft X-rays emitted by the above mentioned laser plasma can be advantageously dispersed widely by a toroidal grating monochrometer rather than by a constant-deviation monochrometer. Further, by providing a slit on a Rowland circle of the toroidal grating monochrometer, it is possible to derive soft X-rays having a given wavelength. The thus obtained soft X-rays are then made incident upon a specimen to emit secondary electrons. The secondary electrons are then detected by an electron analyzer arranged at a given angle with respect to the specimen and the energy of secondary electrons is analyzed. In this manner, elements constituting a surface of the specimen can be judged or determined precisely. That is to say, by analyzing the energy of electrons ionized by photons or Auger electrons, it can be determined how much electrons are emitted from what energy levels of what elements.

Further by selecting a wavelength of the soft X-rays, an amount of Auger electrons emitted from a specific element can be exclusively increased. For instance, when X-rays having a wavelength near the K absorption edge of carbon is projected onto the specimen, carbon KLL Auger electrons having the kinetic energy of about 250 eV can be predominantly observed, and thus an amount of carbon contained in a specimen surface can be analyzed.

By using the above mentioned electron spectroscopic analyzing apparatus, it is possible to observe Auger electrons emitted by various elements by selecting a wavelength of the X-rays, so that the analysis for elements can be performed with a very high sensitivity compared with the other type ESCA using the X-ray tube. Moreover, by scanning the wavelength of the X-rays and detecting amounts of emitted secondary electrons, it is possible to effect an analysis utilizing the extended X-ray absorption fine structure (EXAFS). Further, when an X-ray optical system such as inclined incident mirror is arranged behind the slit provided on the Rowland circle to produce an X-ray microbeam and a specimen stage is scanned with the X-ray microbeam, it is possible to obtain a two-dimensional image representing a distribution of an element under inspection. In this case, if the X-ray optical elements are formed by the Schwarzschild optical element or zone plate having a wavelength dependent dispersion, the monochrometer may be dispensed with.

However, when a specimen is composed of a plurality of substances and these substances have the same element, it is impossible to observe the element contained in a particular substance. For instance, a biological specimen contains various proteins and these proteins contain carbon, so that when the specimen is irradiated with the X-rays, every carbon elements contained in all the proteins emit the secondary electrons. Therefore, it is impossible to derive a distribution of the carbon element within a particular protein.

SUMMARY OF THE INVENTION

The present invention has for its general object to provide an X-ray microscope, in which a transmitted X-ray microscopic image of a specimen having an excellent image quality can be observed.

It is another object to provide an X-ray microscope, in which a transmitted X-ray microscopic image of a specimen can be observed with a high contrast without decreasing a photon flux of ultraviolet rays.

It is another object of the invention to provide an X-ray microscope, in which a specimen can be irradiated with ultraviolet rays under a desired condition, so that a transmitted X-ray microscopic image of a specimen can be observed with a desired contrast.

It is another object of the invention to provide an X-ray microscope, in which a transmitted X-ray microscopic image of a specimen can be observed by suitably determining a mutual relationship between a thickness of the specimen, a wavelength of X-rays and a tone resolving power of the X-ray image.

It is another object of the invention to provide an X-ray microscope, in which a specimen can be irradiated with ultraviolet rays under a suitable photon flux and a transmitted X-ray microscopic image of the specimen can be observed with a desired contrast.

It is another object of the invention to provide an X-ray microscope, in which a specimen can be irradiated with ultraviolet rays and X-rays at suitable timings to observe an X-ray microscopic image with a desired contrast.

It is another object of the invention to provide an X-ray microscope, in which a wavelength of ultraviolet rays can be adjusted in accordance with substances under inspection.

It is still another object of the invention to provide a secondary electron spectroscopic apparatus, in which it is possible to observe selectively a particular element contained in a substance which constitutes a specimen together with other substances which contain the same element.

According to a first aspect of the present invention, in an X-ray microscope in which a specimen is irradiated with X-rays having a wave length region of 65 to 43.7Å and ultraviolet rays and X-rays transmitted through the specimen are received by an X-ray detector to form a transmitted X-ray microscopic image of the specimen, the improvement being characterized in that a non-linear optical medium is provided in a vacuum chamber in which an X-ray optical system of the X-ray microscope is installed, radiation rays having a wavelength longer than that of the ultraviolet rays are made incident upon the non-linear optical medium to convert said radiation rays into ultraviolet rays, and the thus converted ultraviolet rays are made incident upon the specimen.

According to a second aspect of the invention, in an X-ray microscope in which a specimen is irradiated with X-rays having a wave length region of 65 to 43.7Å and ultraviolet rays and X-rays transmitted through the specimen are received by an X-ray detector to form a transmitted X-ray microscopic image of the specimen, the improvement being characterized in that a ultraviolet transmissive window is provided in a wall of a vacuum chamber in which an X-ray optical system of the X-ray microscope is arranged and the ultraviolet rays are made incident upon the specimen through said window as a converged or parallel ultraviolet beam.

According to a third aspect of the invention, in an X-ray microscope for forming a transmitted X-ray microscopic image of a specimen by irradiating the specimen with soft X-rays and ultraviolet rays, the improvement being characterized in that the X-ray microscope is constructed to satisfy the following condition;

$$Z<\mathrm{Log}_e M/(2r_e\lambda N_0 f)$$

wherein

Z: thickness of specimen $r_e$: classical electron radius $\lambda$: wavelength of X-ray $N_0$: the number of molecules or atoms under observation in unit volume f: imaginary part of atomic scattering factor at $\lambda$ M: resolving power of tone of image.

According to a fourth aspect of the present invention, an X-ray microscope for forming a transmitted X-ray microscopic image of a specimen by irradiating the specimen with soft X-rays and exciting radiation rays, the improvement being characterized in that the exciting radiation rays having a photon flux which satisfies the following condition is made incident upon the specimen;

$$[\exp\{\sigma_{UV}/(\sigma_X M)\}-1]/(\sigma_{UV}\tau)<I_0$$

wherein $I_0$: the number of photons irradiating specimen per unit time per unit area (photon flux)

$\tau$: lifetime of molecules or atoms excited by irradiation with exciting radiation rays $\sigma_{UV}$: excitation cross-section of molecules or atoms under observation due to exciting radiation rays $\sigma_X$: cross-section of X-rays for exciting outer-shell electron of molecule or atom under observation into excitation-generated outer-hole M: tone resolving power of image According to a fifth aspect of the invention, in an X-ray microscope for forming a transmitted X-ray microscopic image of a specimen by irradiating the specimen with soft X-rays and exciting radiation rays, the improvement being characterized in that after an initiation of irradiation with the exciting radiation rays, irradiation with said soft X-rays is started within a time period of $(T+3\tau)$; wherein $\tau$: lifetime of molecule or atom under observation excited with the exciting radiation rays T: time period of irradiation with the exciting radiation rays.

According to a sixth aspect of the invention, in an X-ray microscope for forming a transmitted X-ray microscopic image of a specimen by irradiating the specimen with soft X-rays and exciting radiation rays, the improvement being characterized in that a wavelength of said exciting radiation rays is changed in accordance with a substance under observation contained in the specimen.

According to a seventh aspect of the present invention, a secondary electron spectrometer comprising:

an X-ray radiation source for emitting X-rays;

an exciting radiation source for emitting exciting . radiation rays;

BRIEF DESCRIPTION OF THE DRAWINGS

FIGS. 5A to 5F are schematic diagrams illustrating the electron transition uner the irradiation with X-rays and ultraviolet rays;

FIG. 29 is a block diagram showing a circuit for generating the Q switch signal at adjusted timing;

FIGS. 30A to 30D are signal waveforms for explaining the operation of the circuit of FIG. 29;

DESCRIPTION OF THE PREFERRED EMBODIMENTS

Figure 11:
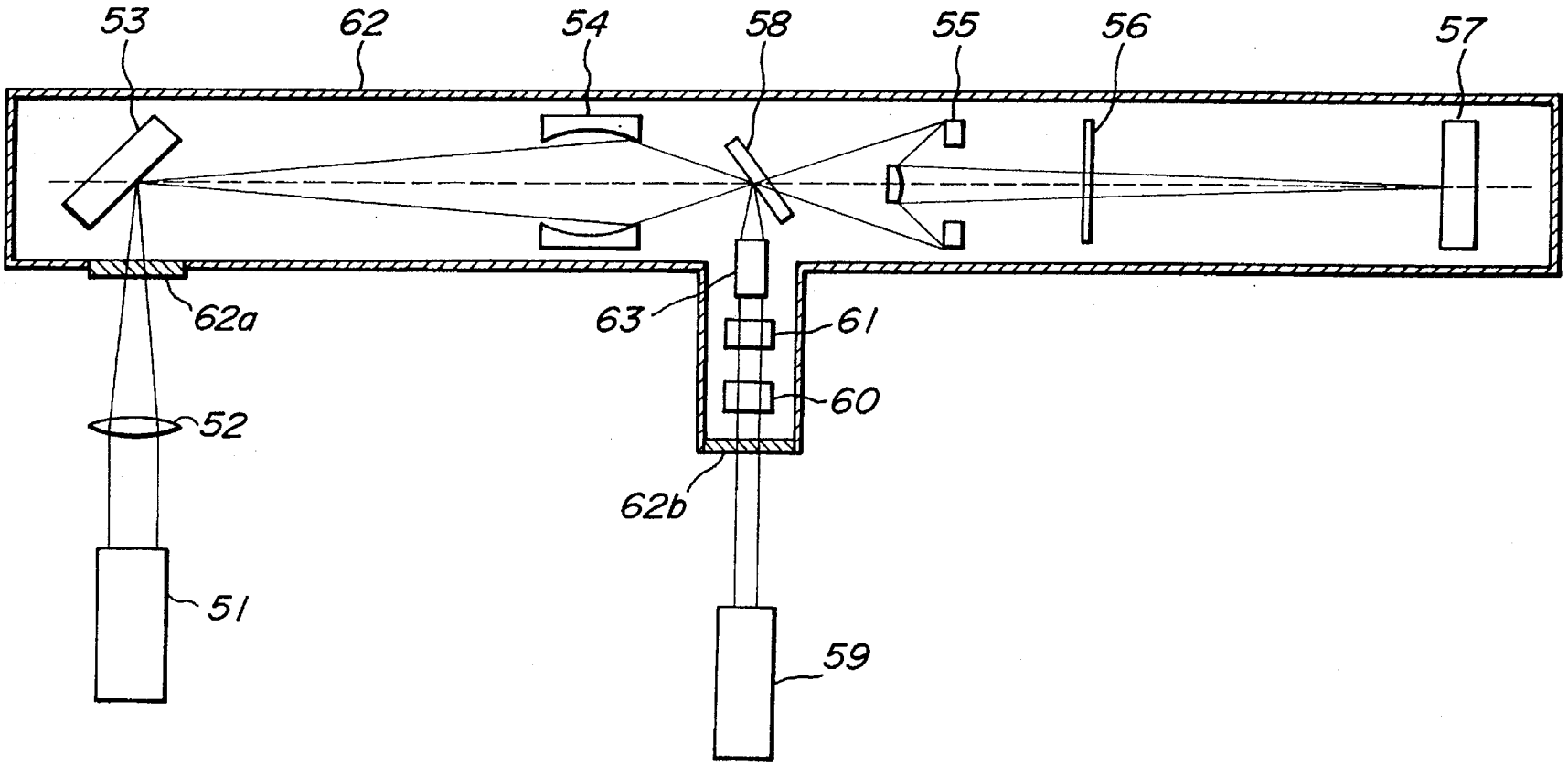
FIG. 11 is a schematic cross sectional view depicting a first embodiment of the X-ray microscope according to the invention.

FIG. 11 is a schematic view showing a first embodiment of the ultraviolet excitation type X-ray microscope according to the invention. The X-ray microscope comprises a laser plasma X-ray radiation source including a Nd:YAG laser 51 for emitting a laser beam, a condenser lens 52 for focusing the laser beam and a target 53 for emitting X-rays upon impact of the laser beam. The X-ray microscope further comprises X-ray condenser lens 54, X-ray objective lens 55, ultraviolet cut filter 56 and X-ray detector 57. The condenser lens 54 is formed by the Wolter optical element including ellipsoid of rotation mirrors and the objective lens 55 is formed by the Schwarzschild optical element. The Schwarzschild optical element includes multilayer coatings of Ni/C or W/C and has a maximum transmittance for a wavelength region of 65 to 43.7Å. The X-rays emitted by the target 53 are focused by the condenser lens 54 onto a biological specimen 58 and X-rays transmitted through the specimen are focused by the objective lens 55 onto the detector 57. The above mentioned optical elements constitute an X-ray microscopic optical system. The X-ray microscope further comprises laser 59 for emitting a laser beam having a visible wavelength, non-linear optical mediums 60 and 61 for converting the visible laser beam into ultraviolet rays and condenser lens 63 for focusing the ultraviolet rays onto the specimen 58. The elements 59, 60, 61 and 63 constitute an ultraviolet exciting optical system. All the elements other than the Nd:YAG laser 51, condenser lens 52 and laser 59 are installed within a vacuum chamber 62. In a wall of the vacuum chamber 62 there are formed windows 62*a* and 62*b* for transmitting the laser beams emitted by the lasers 51 and 59, respectively. The non-linear optical mediums 60 and 61 may be made of optically non-linear material such as KDP ($KH_2PO_4$) and BBO ($\beta$-$BaB_2O_4$).

Figure 12:
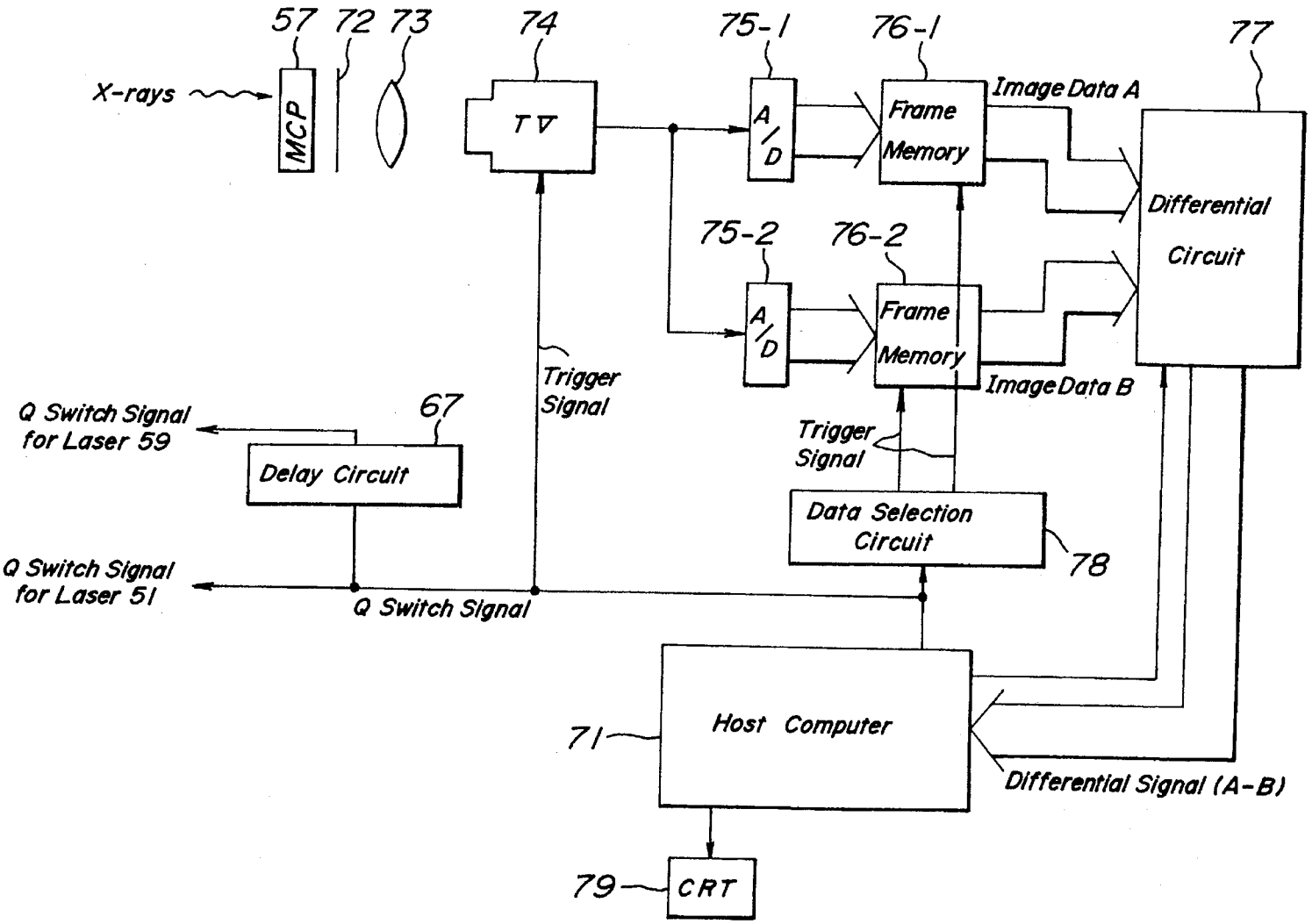
FIG. 12 is a block diagram showing a signal processing circuit of the first embodiment.

FIG. 12 is a block diagram illustrating an embodiment of a signal processing circuit for processing a signal derived from the X-ray detector 57 formed by a multichannel plate). The signal processing circuit comprises a host computer 71 for controlling the whole apparatus of the X-ray microscope system. The X-rays impinging upon the detector (MCP) 57 are converted into a visible image by means of a phosphor 72 and the thus produced optical image is picked-up by a TV camera system 74 by means of a lens 73. A first analog image signal derived from the TV camera system 74 in case that the specimen 58 is irradiated with the ultraviolet rays together with the X-rays is converted into a first digital image signal by means of a first analog-digital converter 75-1, and a second analog image signal obtained by irradiating the specimen only with the X-rays is converted into a second digital image signal by means of a second analog-digital converter 75-2. The first and second digital image signals are supplied to first and second frame memories 76-1 and 76-2 and are stored therein, respectively. Then, signals of corresponding pixels of the first and second digital image signals are supplied to a differential circuit 77 and differences therebetween are derived. Then, the thus derived digital differential signal is supplied to the host computer 71 and is stored therein. To this end, there is provided a data selection circuit 78 for supplying trigger signals to the first and second frame memories 76-1 and 76-2 in response to commands supplied from the host computer 71. The signal processing circuit further comprises a cathode ray tube 79 for displaying a transmitted X-ray microscopic image of particular substances such as proteins contained in the specimen 58. The host computer 71 further generates a trigger signal for the TV camera system 74 and a Q switch signal for the Nd:YAG laser 51. The Q switch signal is delayed by a delay circuit 67 and a delayed Q switch signal is supplied to the laser 59.

Now the operation of the X-ray microscope of the present embodiment will be explained. AT first, the host computer 71 controls an amount of the laser beam by controlling the Q switch operation by means of the Q switch signal for adjusting a timing of the laser emission, so that an amount of the ultraviolet rays to be made incident upon the specimen 58 is adjusted to obtain a transmitted X-ray image having a good contrast. Then, the host computer 71 supplies the Q switch signal to the Nd:YAG laser 51 to emit the laser beam. The laser beam emitted by the Nd:YAG laser 51 is made incident upon the target 53 by means of the condenser lens 52 and window **62*a* to emit the X-rays. In synchronism with this emission of the X-rays, the host computer 71 supplies the trigger signals to the TV camera system 74 and first frame memory 76-1. In this manner, the first frame memory 76-1 has stored first image data A representing the digitalized transmitted X-ray image of carbon contained in the specimen 58** which are irradiated with both the X-rays and ultraviolet rays.

Next, the host computer 71 supplies a command to the laser 59 for inhibiting the irradiation of the ultraviolet rays so that the sample 58 is irradiated only with the X-rays, and supplies the trigger signals to the TV camera system 74 and second frame memory 76-2. In this manner, the second frame memory 76-2 has stored second image data B representing a digitalized transmitted X-ray image of elements other than carbon contained in the specimen 58 irradiated only with the X-rays.

The first image data A stored in the first frame memory 76-1 is a signal representing the transmitted X-ray image of carbon under inspection having background noise added thereto and the second image data B stored in the second frame memory 76-2 is a signal representing the background noise. Therefore, by deriving a difference between the first and second image data A and B for corresponding pixels in the differential circuit 77, the background noise is cancelled out of the first image data A and the thus obtained differential image signal A-B represents exclusively a transmitted X-ray image of carbon contained in the specimen 58. The differential image signal is processed by the host computer 71 to generate an analog image signal which is supplied to the cathode ray tube 79. In this manner, the transmitted X-ray microscopic image of carbon is displayed on the cathode ray tube 79.

Now the generation of the ultraviolet rays used in the above mentioned X-ray microscope will be explained further in detail. The visible laser beam emitted by the laser 59 is made incident upon the non-linear mediums 60 and 61 via the window **62*b* formed in the wall of the vacuum chamber 62. As mentioned above, the non-linear mediums 60 and 61 are made of KDP or BBO, so that the visible laser beam is converted into higher harmonics having a frequency higher by an integer number than a frequency of the incident visible laser beam. Particularly, conversion coefficients of KDP and BBO for converting incident light of a wavelength region of the incident light higher than 200 nm into a second order harmonic amounts to about 20%. Therefore, light rays having a wavelength shorter than that of incident light by two times can be easily produced. For instance, when the laser 59 is formed by Nd:YAG laser emitting visible light rays having a wavelength of 532 nm, it is possible to obtain ultraviolet rays having a wavelength of 266 nm by means of a single non-linear medium. When the Nd:YAG laser is operated to emit a fundamental wave having a wavelength of 1065 nm, it is possible to produce the ultraviolet rays having a wavelength of 266 nm by means of a series arrangement of the two non-linear mediums as shown in FIG. 11. Therefore, by selecting the number of the non-linear mediums to be inserted into the optical path in accordance with a wavelength of the visible light emitted by the laser 59**, it is possible to obtain the ultraviolet rays having a wavelength near 200 nm which is preferably used in the present invention. It should be noted that it is also possible to use non-linear optical mediums which produce harmonics higher than the second order harmonic.

In the first embodiment of the X-ray microscope according to the invention, the non-linear optical mediums 60 and 61 are arranged within the vacuum chamber 62, so that the ultraviolet rays are produced within the vacuum chamber. Therefore, the ultraviolet rays are not absorbed by the air and thus a large amount of the ultraviolet rays can be made incident upon the specimen 58 without loss. Moreover, the laser 59 is formed by the visible light laser which is cheap in cost and its maintenance is very easy compared with a laser which can directly emit the ultraviolet rays such as excimer laser.

Figure 13:
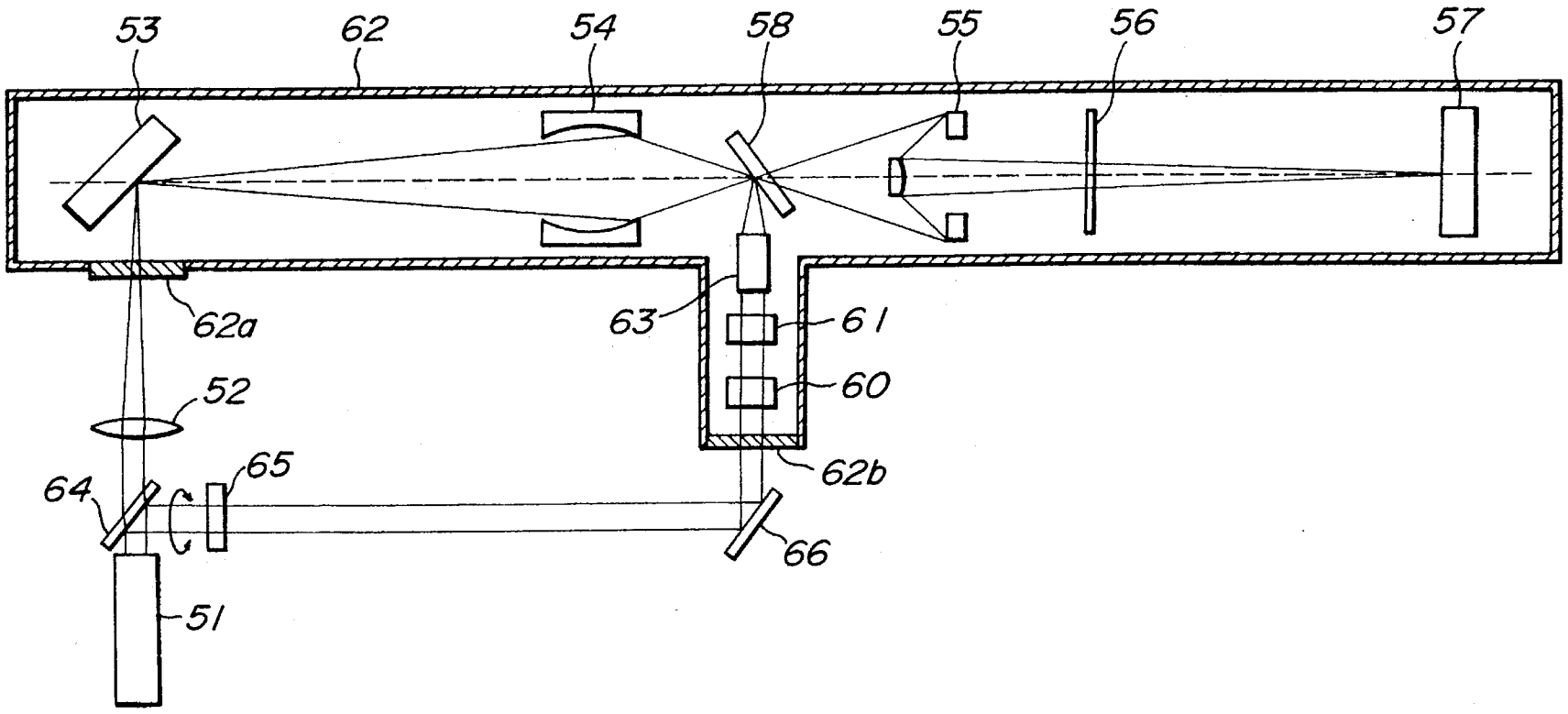
FIG. 13 is a schematic cross sectional view illustrating a second embodiment of the X-ray microscope according to the invention.
Figure 14:
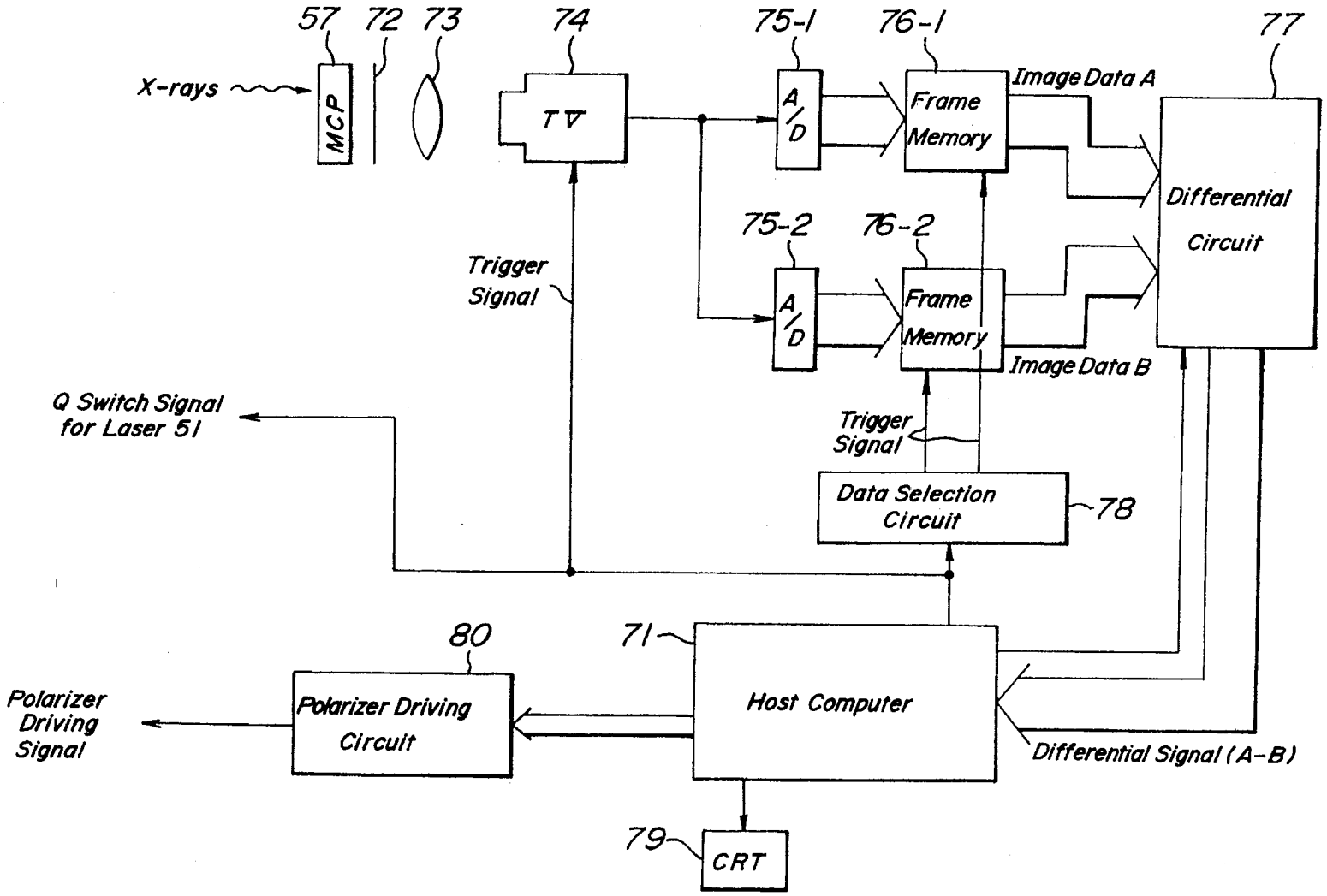
FIG. 14 is a block diagram showing the signal processing circuit of the second embodiment.

FIGS. 13 and 14 illustrate a second embodiment of the ultraviolet excitation type X-ray microscope according to the invention. In the present embodiment, portions similar to those shown in FIGS. 11 and 12 are denoted by the same reference numerals used in FIGS. 11 and 12 and the explanation of these portions is omitted. In the present embodiment, there is not provided the laser for emitting the visible light separately from the laser plasma light source. As shown in FIG. 13, a part of infrared radiation rays emitted by the Nd:YAG laser 51 is divided by a half mirror 64 arranged between the laser 51 and the condenser lens 52. The thus divided infrared radiation rays are made incident upon a polarizer 65 to adjust an amount of the infrared radiation rays. Then, the infrared radiation rays are reflected by a reflection mirror 66 and are made incident upon the non-linear optical mediums 60 and 61 by means of the window **62*b* to generate ultraviolet rays. In the present embodiment, it is preferable to make the window 62b** of a material which has a high transmittance for the infrared radiation.

In the second embodiment shown in FIG. 13, the Nd:YAG laser 51 is used commonly for generating both the X-rays and ultraviolet rays, so that the construction of the signal processing circuit has to be changed partially. That is to say, as depicted in FIG. 14, instead of supplying the Q switch signal from the host computer 71 to the laser 59 (see FIG. 11), there is provided a polarizer driving circuit 80. The polarizer 65 is arranged rotatably about an optical axis and the polarizer driving circuit 80 generates under the control of the host computer 17 a driving signal which is supplied to a driver for rotating the polarizer 65. When the specimen 58 is to be irradiated with the ultraviolet rays, the polarizer 65 is rotated by the driving signal supplied from the polarizer driving circuit 80 such that a desired amount of the infrared radiation rays can pass through the polarizer to adjust an amount of the ultraviolet rays impinging upon the specimen 58. When the irradiation of the ultraviolet rays has to be stopped, the polarizer 65 is rotated such that the inferred radiation rays do not pass through the polarizer.

In the second embodiment, the common use of the laser light source can decrease a cost of the X-ray microscope, and further a timing of the irradiation of the X-rays and a timing of the irradiation of the ultraviolet rays can be easily synchronized by the signal processing circuit.

It should be noted that in the above mentioned first and second embodiments, the image processing is performed by deriving the differential signal by means of the differential circuit 77, but according to the invention, the differential signal may be derived by the host computer 71 by processing the image data A and B in accordance with a software. Further, the X-ray condenser lens 54 is formed by the Wolter optical element and the X-ray objective lens 55 is formed by the Schwarzschild optical element, but they may be formed any other X-ray optical elements such as zone plate. Moreover, the laser plasma X-ray radiation source may be replaced by SOR (synchrotron radiation) or electron beam tube.

As explained above, in the first and second embodiments of the ultraviolet excitation type X-ray microscope according to the invention, the non-linear optical mediums for converting the radiation rays having a wavelength longer than that of the ultraviolet rays into the ultraviolet rays are arranged within the vacuum chamber, the ultraviolet rays can be effectively made incident upon the specimen without undesired loss, and it is possible to observe the transmitted X-ray microscopic image of the specimen with a high contrast.

Figure 15:
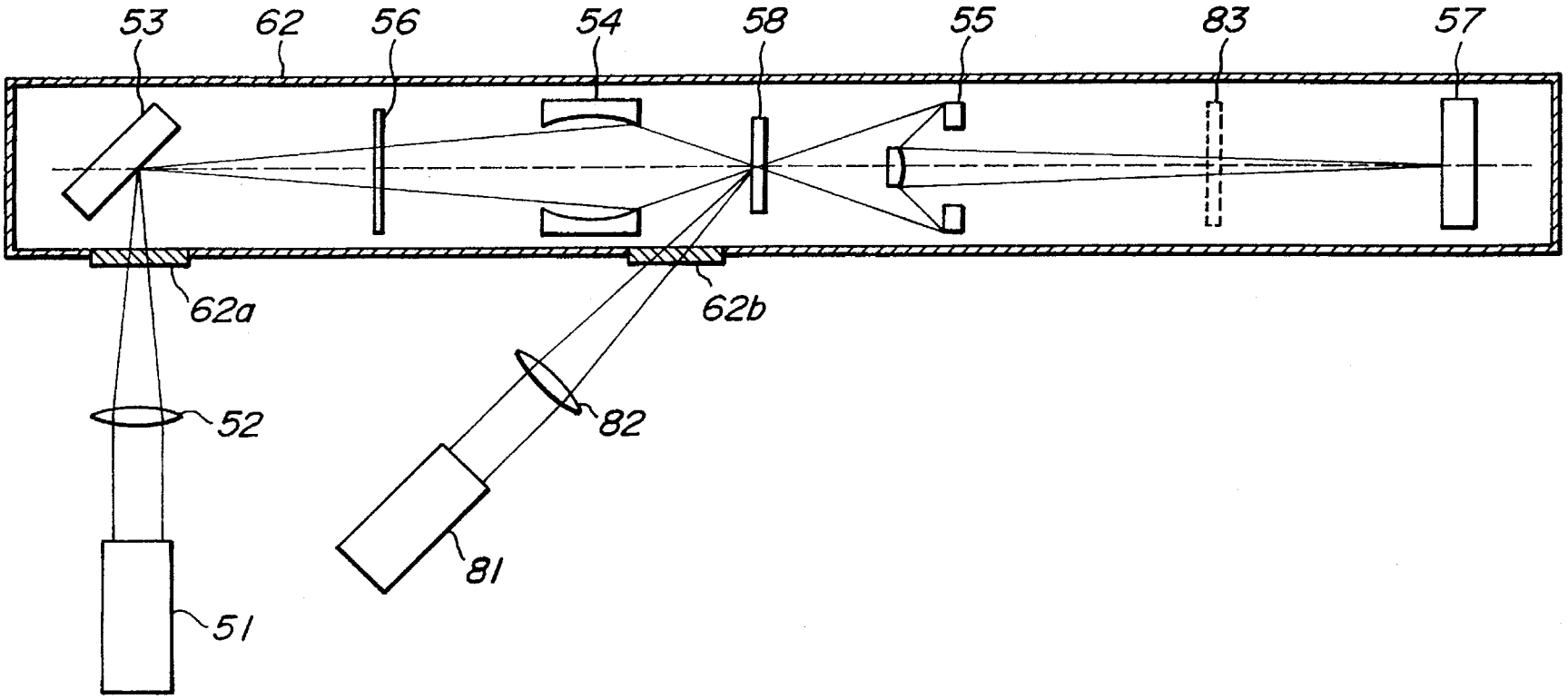
FIG. 15 is a schematic cross sectional view representing a third embodiment of the X-ray microscope according to the invention.

FIG. 15 is a schematic view showing a third embodiment of the ultraviolet excitation type X-ray microscope according to the invention. The construction of this embodiment is somewhat similar to the first embodiment shown in FIG. 11, so that portions similar to those illustrated in FIG. 11 are denoted by the same reference numerals used in FIG. 11 and their explanation is dispensed with. In the present embodiment, the UV cut filter 56 is arranged between the target 53 and the X-ray condenser lens 54. The ultraviolet exciting optical system comprises an ultraviolet laser 81 for emitting ultraviolet rays and a condenser lens 82 for focusing the ultraviolet rays onto the specimen 58 via the window 62b made of a material such as diamond and fluoride having a high transmittance for the ultraviolet rays having a wavelength longer than 200 nm. In the present embodiment, the ultraviolet rays emitted by the UV laser 81 is made incident upon the specimen 58 at an inclined angle as a fine spot. This incident angle is an important factor. For instance, the specimen 58 is placed perpendicularly to the X-ray axis, it is practically difficult to have the ultraviolet rays being made incident upon the specimen with a small incident angle, because a distance between the condenser lens 54 and the specimen 58 and a distance between the specimen and the objective lens 55 are very small. Therefore, the incident angle of the ultraviolet rays to the specimen 58 has to be relatively large or the specimen has to be inclined with respect to the X-ray axis. In the present embodiment, the specimen 58 is positioned perpendicularly to the X-ray axis and the ultraviolet rays are made incident upon the specimen 58 at an incident angle of about 45 degrees. In this case, the ultraviolet rays emitted by the UV laser 81 are converged by the condenser lens 82, so that the ultraviolet ray beam is scarcely shielded by the vacuum chamber 62 and X-ray optical elements. In this manner, the specimen 58 can be irradiated with the ultraviolet rays having a sufficiently large photon flux, so that the transmitted X-ray microscopic image of the specimen having an excellent contrast can be observed in accordance with the X-ray microscopy proposed by J. H. Klems. It should be noted that the signal processing circuit of the present embodiment is substantially same as that shown in FIG. 12.

In the present embodiment, the ultraviolet rays are projected onto the specimen 58 from the same side as that from which the X-rays are projected, and the specimen serves as the filter. Therefore, it is not always necessary to provide a stray light cut filter, but if the stray light has to be suppressed in order to improve S/N of the image, a stray light cut filter 83 may be arranged on the X-ray axis, for example between the objective lens 55 and the detector 57 as shown by a broken line in FIG. 15. In the present embodiment, there is provided the laser plasma radiation source for generating the X-rays. This radiation source emits white light including visible light and ultraviolet rays. Therefore, in order to set a desired or regulated amount of the ultraviolet rays impinging upon the specimen 58, it is necessary to cut off the visible light and ultraviolet rays. To this end, the UV cut filter 56 for cutting off light rays having wavelengths longer than that of the ultraviolet rays is arranged between the target 53 and the condenser lens 54.

Figure 16:
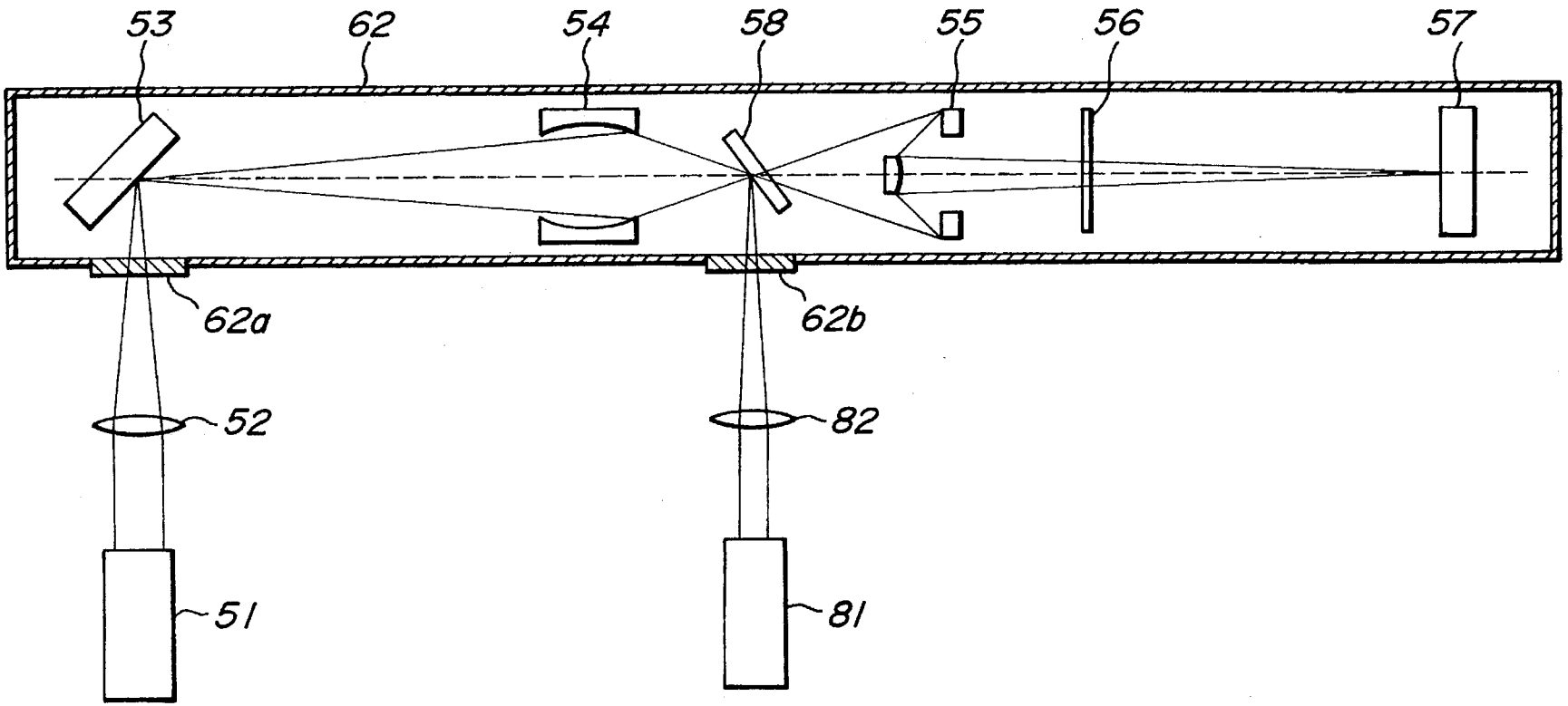
FIG. 16 is a schematic cross sectional view showing a fourth embodiment of the X-ray microscope according to the invention.

FIG. 16 is a schematic view showing a fourth embodiment of the ultraviolet excitation type X-ray microscope according to the invention. In the present embodiment, the specimen 58 is positioned to be inclined by about 45 degrees with respect to the X-ray optical axis and the UV laser 81, condenser lens 82 and window 62b are arranged such that the ultraviolet rays are made incident upon the specimen 58 at an incident angle of about 45 degrees. That is to say, the ultraviolet ray optical axis is made perpendicular to the X-ray optical axis. This construction is particularly suitable for a case in which the condenser lens 54 and objective lens 55 are arranged close to each other. It should be noted that in the present embodiment, the UV cut filter 56 is arranged between the objective lens 55 and the detector 57.

In the present embodiment, the specimen 58 is inclined with respect to the X-ray optical axis by about 45 degrees, so that a transmitted X-ray image formed on the detector 57 is an obliquely transmitted image at a ratio of $1:\sqrt{2}$. Therefore, the digital image data has to be converted in a transmitted image at a ratio of 1:1 by means of a software or a calculation circuit. Also in the present embodiment, the focused ultraviolet rays can be made incident upon the specimen, so that the photon flux can be increased although the condenser lens and objective lens are arranged close to each other, and the transmitted X-ray microscopic image of the specimen can be observed with a high contrast.

Figure 17:
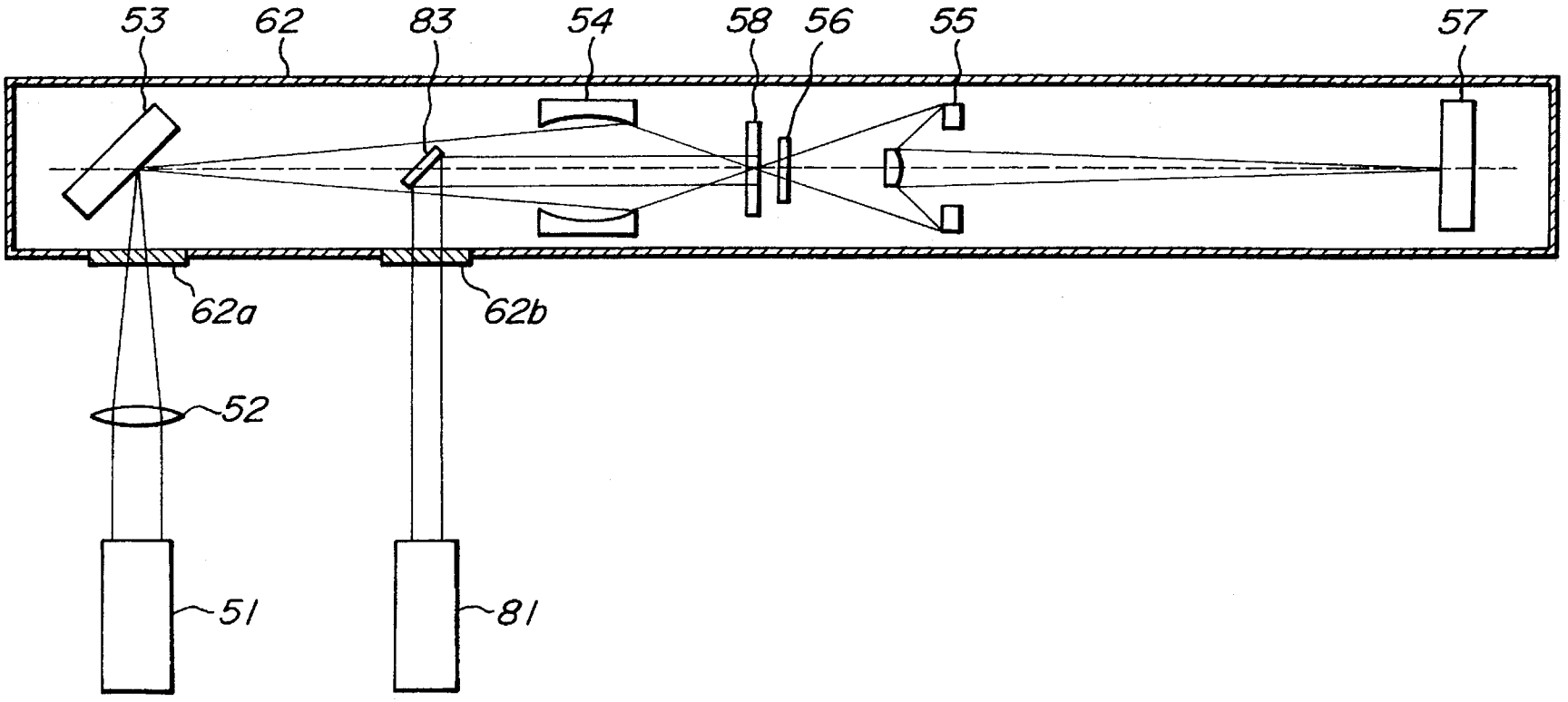
FIG. 17 is a schematic cross sectional view depicting a fifth embodiment of the X-ray microscope according to the invention.

FIG. 17 is a schematic view showing a fifth embodiment of the X-ray microscope according to the invention. In the present embodiment, the ultraviolet rays emitted by the UV laser 81 is made incident upon an ultraviolet reflection mirror 83 via the window 62*b*. The UV reflecting mirror 83 is arranged on the X-ray optical axis between the target 53 and the X-ray condenser lens 54 and is inclined by 45 degrees with respect to the X-ray optical axis. Therefore, the ultraviolet rays are reflected by the mirror 83 along the X-ray optical axis and is made incident upon the specimen 58 via a central aperture of the condenser lens 54 formed by the Wolter optical element. The Wolter optical element forming the condenser lens 54 is constituted by the ellipsoid of rotation mirrors and the X-rays are made incident upon the mirror at the angle of total reflection, so that the center aperture of the condenser lens can be advantageously utilized for transmitting the ultraviolet rays. The UV reflection mirror 83 has such a size that it does not obstruct the X-rays passing from the target 53 to the condenser lens 54. In this manner, the ultraviolet rays are projected onto the specimen 58 along the X-ray optical axis as a parallel beam. Between the specimen 58 and the objective lens 55 there is arranged the UV cut filter 56. It should be noted that the UV reflecting mirror 83 also serves to cut off stray X-rays which do not contribute to the formation of the transmitted X-ray image and debris from the laser plasma radiation source.

In the present embodiment, the parallel ultraviolet ray beam is made incident upon the specimen 58 along the X-ray optical axis along which the X-rays are made incident upon the specimen, so that the ultraviolet rays can be effectively prevented from being cut or shielded by the X-ray optical elements. It should be noted that the condenser lens may be provided between the UV laser 81 and the window 62*b* such that the converged ultraviolet ray beam is made incident upon the specimen. Further when the objective lens 55 is formed by the Wolter optical element, the UV reflection mirror 83 may be arranged between the specimen 58 and the detector 57 such that the ultraviolet rays are made incident upon a rear surface of the specimen from the side of the objective lens.

Figure 18:
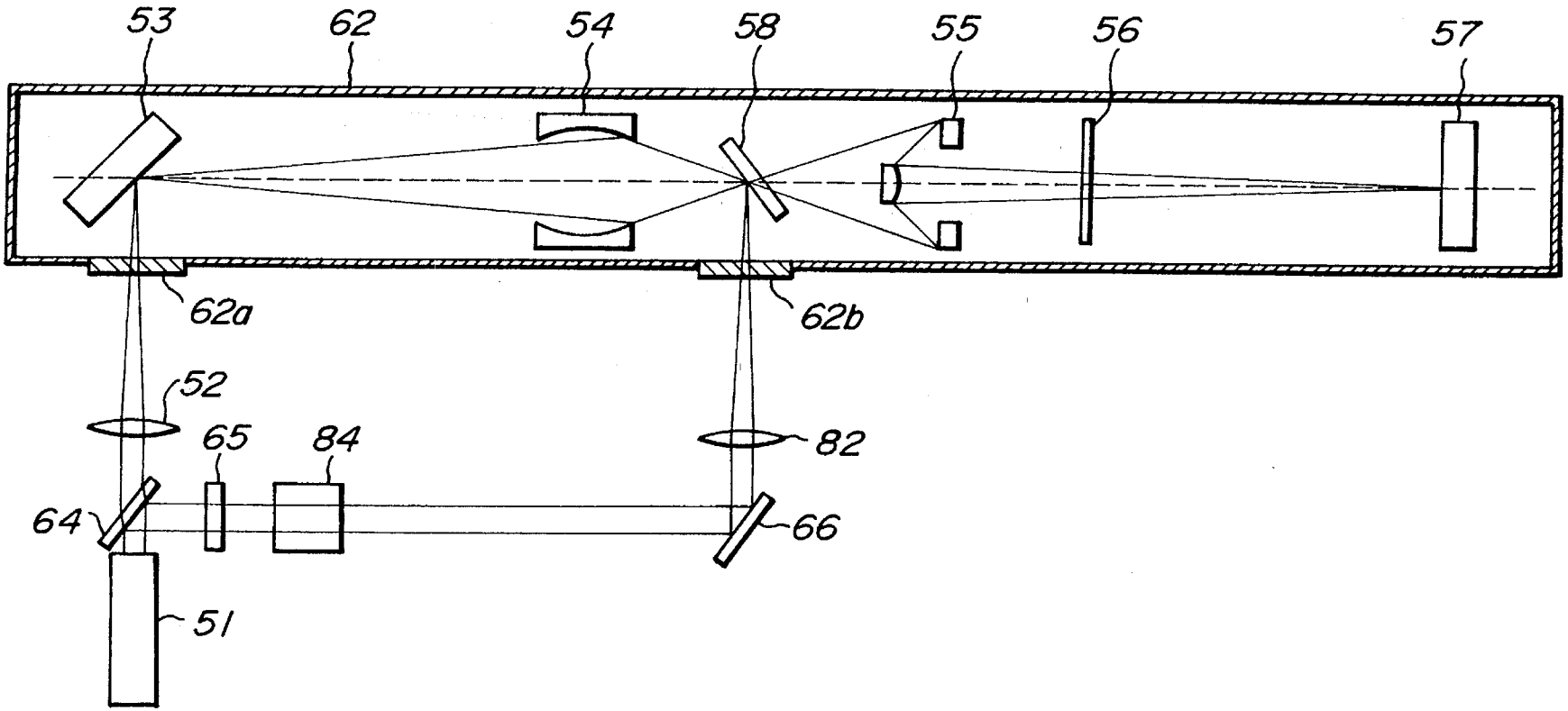
FIG. 18 is a schematic view illustrating a sixth embodiment of the X-ray microscope according to the invention.

FIG. 18 is a schematic view showing a sixth embodiment of the ultraviolet excitation type X-ray microscope according to the invention. This embodiment is similar to the second embodiment illustrated in FIG. 13. That is to say, instead of providing the UV laser, a part of the visible laser light emitted from the Nd:YAG laser 51 is divided by the half mirror 64 and is made incident upon the polarizer 65 to adjust an amount of the visible laser light transmitted through the polarizer. The visible laser beam emanating from the polarizer 65 is then made incident upon a KDP crystal 84 and is converted into fourth order harmonics, i.e. ultraviolet rays. The thus generated ultraviolet rays are made incident upon the specimen 58 by means of the reflection mirror 66, condenser lens 82 and window 62*b* made of UV transmissive material. In the present embodiment, the specimen 58 is inclined by about 45 degrees with respect to the X-ray optical axis and the ultraviolet rays are made incident upon the specimen perpendicularly to the X-ray optical axis.

In the present embodiment, the signal processing circuit of the second embodiment shown in FIG. 14 may be used, so that the advantages obtained in the second embodiment can be equally attained.

As explained above, in the second and sixth embodiments, an amount of the ultraviolet rays impinging upon the specimen 58 can be adjusted by rotating the polarizer 65. The inventors have found that the even though an amount of the ultraviolet rays, i.e. the photon flux is adjusted, it is sometimes difficult to observe the transmitted X-ray microscopic image having an excellent contrast. In order to remove such a drawback the inventors have confirmed that a thickness of the specimen, a wavelength of the X-rays and a tone resolving power of image should have a predetermined relationship. Now this relationship will be explained in detail with reference to the sixth embodiment shown in FIG. 18. Prior to the discussion, various parameters will be explained as follows.

$N_0$: the number of molecules or atoms under inspection in unit volume

N: the number of molecules or atoms in ground state under inspection in unit volume n: the number of molecules or atoms under inspection in unit volume excited with UV $\tau$: lifetime of molecule or atom under observation excited with UV $\sigma_{UV}$: cross-section of molecule or atom under inspection excited by UV T: time period of UV irradiation $I_0$: the number of photon (photon flux) impinging upon specimen per unit time per unit area $\sigma_X$: cross-section of X-ray for exciting inner-shell electron into UV-excitation-generated outer-shell hole of molecule or atom under observation $\mu_{UV}$: absorption coefficient of molecule or atom under inspection for ultraviolet rays $\mu_X$: absorption coefficient of molecule or atom under inspection for X-rays [in general, the absorption coefficient $\mu$ and the excitation cross-section $\sigma$ have the following relation $\mu=N\sigma$. . . (1)]

$\lambda$: wavelength of ultraviolet rays for exciting inner-shell electron into UV-excitation-generated outer-shell hole M: tone resolving power of transmitted X-ray image When molecule or atom under observation is irradiated with the ultraviolet rays, the equilibrium equation of the ground state and excited state with respect to time t may be expressed as follows.

$$-dN/dt=I_0\sigma_{UV}N-(N_0-N)/\tau \quad (2)$$

When this equation (2) is solved under an initial condition that $N=N_0$ at $t=0$ to derive $n=N_0-N$, the following equation may be derived.

$$n=[1-\exp\{-(I_0\sigma_{UV}+1/\tau)t\}]\cdot\{I_0\sigma_{uv}N_0\sigma_{uv}\tau)\} \quad (3)$$

It may be generally assumed that the irradiation time T of the ultraviolet rays is longer than the lifetime $\tau$ of the excited state ($\tau<T$), so that the equation (3) may be simplified as follows.

$$-n\cong I_0\sigma_{UV}N_0\tau/(1+I_0\sigma_{UV}\tau) \quad (4)$$

The photon flux $I_o$ of the ultraviolet rays is greatly decayed in accordance with a distance L up to which the ultraviolet rays penetrate into the specimen. Therefore, n becomes a function of L and $\mu_x$ is a function of L, so that the number of excited molecules or atoms n(L) may be expressed by the following equation (5), wherein $\mu_{UV}=N_0\sigma_{UV}$.

$$n(L)=I_0\sigma_{UV}N_0\tau\cdot\exp(-\mu_{UV}L)/[1+I_0\sigma_{UV}\tau\cdot\exp(-\mu_{UV}L)] \quad (5)$$

Next, a transmittance $F(\lambda)$ due to the transition of the inner-shell electron of the molecule or atom into the UV-excitation-generated outer-shell hole when the there are produced the excited molecules or atoms which are produced by the irradiation with the ultraviolet rays and whose number is defined by the equation (5) is derived. The transmittance F(λ) is also a function of L and may be expressed by the following equation (6).

$$F(\lambda)=\exp[-u(L)] \tag{6}$$

wherein $$u(L)=\sigma_x\int_0^L n(L')dL'.$$

Therefore, if the specimen has a sufficiently large thickness, the transmittance F(λ) for the X-rays having the wavelength λ upon the irradiation of the ultraviolet rays may be expressed as follows.

$$F(\lambda)=\lim_{L\to\infty}\exp[-u(L)] \tag{7}$$

The above equation (7) can be calculated in an analytic manner and may be simplified as follows.

$$F(\lambda)=(1+I_0\sigma_{UV}\tau)^{-\sigma}x/\sigma\mathrm{UV} \tag{8}$$

In the equation (7), a condition of L→∞ is assumed, but in practice, the thickness of the specimen up to which the ultraviolet rays can penetrate is about several hundreds nm and molecules or atoms situating at positions far from said distance are remained in the ground state. Therefore, the ultraviolet excitation type X-ray microscope can observe only molecules or atoms within a surface of a specimen and a bulk of the specimen becomes transparent for the X-rays. At a first glance, this may be interpreted that the molecules or atoms within the surface of the specimen can be observed even thought the thickness of the specimen is large. However, this interpretation is contradict to the fact.

From the equation (8), it may be derived that when a part of the specimen is not irradiated with the ultraviolet rays, i.e. $I_0=0$, the transmittance F(λ) of the relevant portion of the specimen becomes 1, so that no absorption by this part of the specimen could be observed. However, this conclusion is obtained under the following assumptions. Firstly, when the molecules or atoms under inspection within the bulk of the specimen (they are not irradiated with the ultraviolet rays) are concerned, the absorption coefficient for the X-rays is very small, because the wavelength of the X-rays is somewhat longer than the X-ray absorption edge. Secondly, the absorption due to molecules or atoms not under observation is ignored. In this connection, reference should be made to the above mentioned Physical Review A of J. H. Klems.

The above assumptions are correct when a thickness of the specimen is small. However, when a wavelength of the X-rays is somewhat longer than the absorption edge of X-rays, there is a slight absorption, so that if a thickness of the specimen is about several hundreds nm, the transmittance of the specimen becomes zero without the irradiation of the ultraviolet rays. Therefore, the advantage of the ultraviolet excitation type X-ray microscope could not be attained.

The inventors have conducted various experiment and analyses for deriving a mutual relationship between a thickness of a specimen, a wavelength of X-rays and a resolving power of tone in order to observe a transmitted X-ray microscopic image, and have found the following relationship.

Now it is assumed that an absorption coefficient of a specimen for X-rays in case of no irradiation of the ultraviolet rays is $\mu_0$ (this value varies for particular elements contained in the specimen), a thickness of a portion of the specimen through which the ultraviolet rays penetrate is $Z_{UV}$, a thickness of a remaining portion of the specimen up to which the ultraviolet rays do not penetrate is $Z_0$, and a whole thickness of the specimen is Z ($Z=Z_{UV}+Z_0$). In general, $Z_{UV}<<Z_0$, so that the absorption coefficient $F_0$ may be expressed as follows.

$$F_0=F(\lambda)\exp(-\mu_0 Z) \tag{9}$$

As shown in FIGS. 12 and 14, the transmitted X-ray microscopic image of the specimen is observed by picking up the X-ray image by means of the two dimensional MCP or solid state image sensor to derive the bivalent image signal and the image signal is displayed on the monitor such as CRT. Now it is considered a condition for realizing a minimum performance for judging the existence or non-existance of molecule or atom under inspection when the signal derived from the image pick-up device is quantized into M tones. If this condition is realized in the X-ray microscope, it is possible to distinguish an absorption coefficient $F_0=1/M$ by optimally utilizing the tone resolving power of the image sensing device. In order to utilize the tone resolving power optimally, it can be derived from the equation (7) that the following equation should be satisfied.

$$1/M<\exp(-\mu_0 Z) \tag{10}$$

When this equation (10) is rewritten, the following equation may be derived.

$$Z<\mathrm{Log}_e M/\mu_0 \tag{11}$$

Now it is assumed that a large amount of the molecules or atoms under inspection are existent in the specimen, but the number of other molecules or atoms is small. Then, it is sufficient to consider the absorption by the molecules or atoms under inspection. Therefore, the above equation may be further rewritten. That is to say, the absorption coefficient $\mu_0$ may be expressed by the following equation (12) in which $r_e$ denotes a classical electron radius, λ is a wavelength of the X-rays, $N_0$ is the number of molecules or atoms under inspection per unit volume, and f represents an imaginary part of the atom scattering factor at the wavelength λ.

$$\mu_0=2r_e\lambda N_0 f \tag{12}$$

Finally by rewriting the equation (11) by using the equation (12), the following equation (13) may be obtained.

$$Z<\mathrm{Log}_e M/(2r_e\lambda N_0 f) \tag{13}$$

The equation (13) represents the required relationship between the thickness of the specimen, the wavelength of the X-rays and the tone resolving power for observing or judging the existence of the molecules or atoms under inspection contained in the specimen while the tone resolving power of the X-ray microscopic image pick-up system.

It should be noted that the above relationship is derived by ignoring the existence of molecules or atoms other than those under observation, so that a region defined by the above equation (13) would be somewhat wider than actually required one. According to the invention, the thickness of the specimen is adjusted to satisfy the condition defined by the equation (13), and then the transmitted X-ray microscopic image having an excellent contrast can be observed.

In the above explanation, the tone resolving power M is defined by the detector and A/D converter, but when use is made of an X-ray photographic film, the equation (13) is still effective. In this case, the tone resolving power M may be determined in accordance with a tone resolving power of the X-ray photographic film itself.

Figure 19:
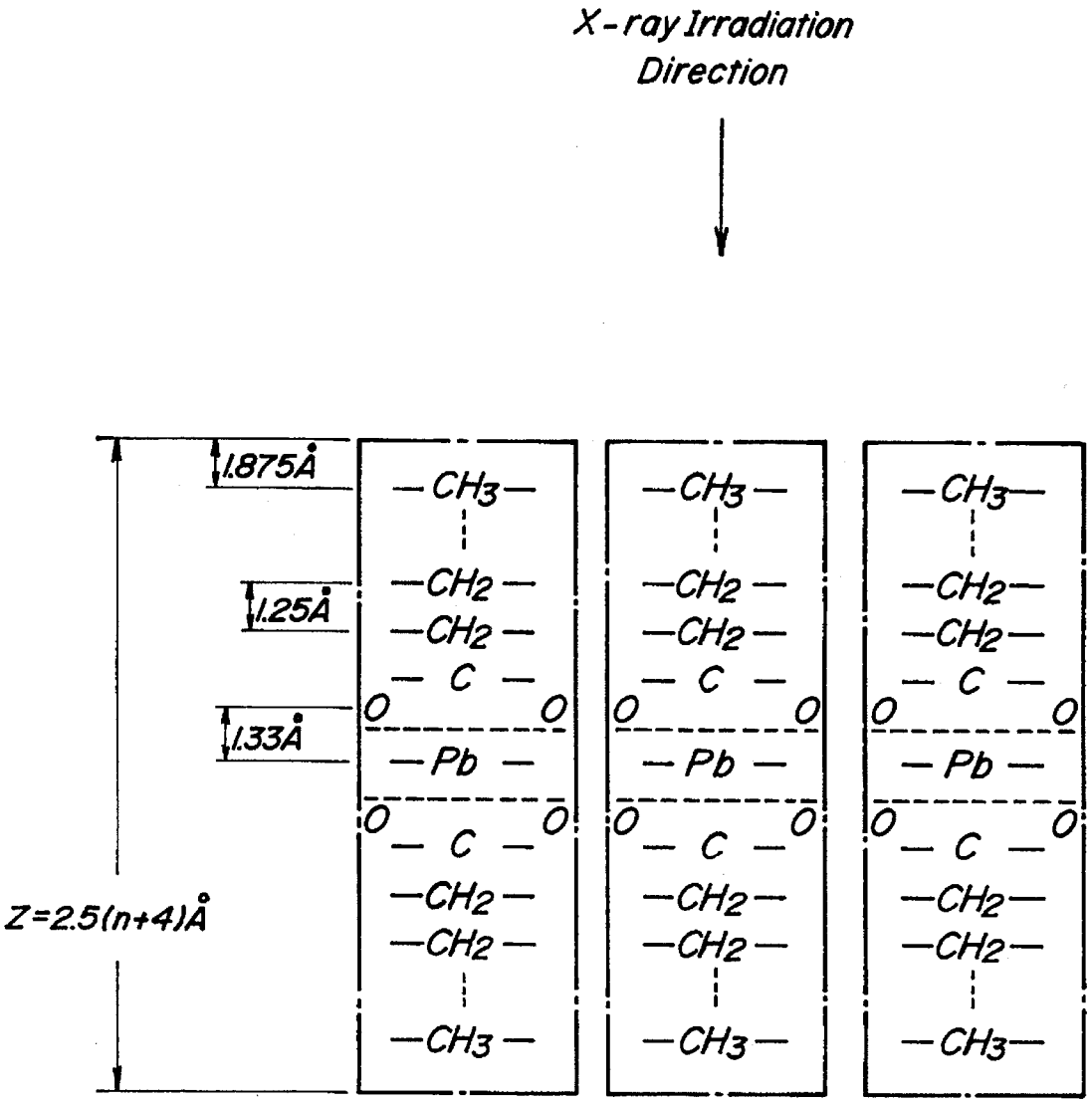
FIG. 19 is a schematic diagram representing molecular structure of the LB film.

Now the effectiveness of the above equation (13) will be confirmed by taking an example in which a chain structure of carbon in a laminated langmuir-blodgett film (LB film) at a wavelength of 44.7Å. FIG. 19 is a schematic diagram showing the molecular construction of a single cell of the LB film. The molecular formula of this film may be expressed as follows.

$$[CH_3(CH_2)_nCOO]_2Pb \quad (14)$$

The LB thin film is formed by depositing two-dimensionally the molecules expressed by the formula (14) on a thin substrate as a multilayer. Now a maximum thickness of the thin film will be considered. For the sake of simplicity, it is assumed that the substrate is sufficiently thinner than the LB film, so that influence of the substrate can be neglected. This may be realized by using the substrate made of diamond whose absorption is very small and whose mechanical strength is large. For instance, a thickness of the diamond substrate may be 0.2 to 0.3 μm.

The LB film is formed by the molecules defined in the formula (14) wherein n=76. In this case, a length of a single molecule is 200Å and a cross-section of the molecule becomes 20Å$^2$. Therefore, the numbers of atoms in unit volume constituting the molecule may be expressed in a table 1. As to substance data such as atom scattering factors, refer to Atomic Data & Nuclear Data Tables, Vol. 27, No. 1, B. L. HENKE et al. 1982. In the table 1, there are also shown atomic scattering factors of respective elements and absorption coefficients contributed by particular elements at the wavelength of 44.7Å. The absorption coefficient $\mu_0$ of the LB film is a sum of these absorption coefficients. In the present example, $\mu_0$ is 2222.0/cm.

TABLE 1

| Element | Number in one cell | Number N per unit volume (number/cm$^3$) | Imaginary part of atomic scattering factor | Absorption coefficient |
|---|---|---|---|---|
| C | 78 | $1.9 \times 10^{22}$ | 0.19 | 903.6 |
| O | 4 | $1.0 \times 10^{21}$ | 0.64 | 162.7 |
| H | 154 | $3.9 \times 10^{22}$ | 0.003 | 29.3 |
| Pb | 1 | $2.5 \times 10^{20}$ | 18.0 | 1126.4 |

When it is assumed that the A/D converters 75-1, 75-2 shown in FIG. 14 treat the digital signal composed of eight bits, the tone resolving power M becomes $M=2^8=256$, so that Z<25 μm from the equation (11). This condition defines a value of Z from the absorption in a case including elements other than carbon under observation. Whilst, when Z is defined by the equation (13) which considers the absorption only in terms of carbon elements under inspection, Z<60 μm may be obtained.

From the above consideration, it may be found that in order to pick-up the transmitted X-ray microscopic image having high contrast and high tone, the specimen should have a thickness which is substantially equal to a penetration depth of X-rays (several hundreds nm), but in order to realize the minimum performance of the ultraviolet excitation type X-ray microscope for observing the existence of the molecules or atoms under inspection, the condition defined by the equation (13) should be satisfied.

Figure 20:
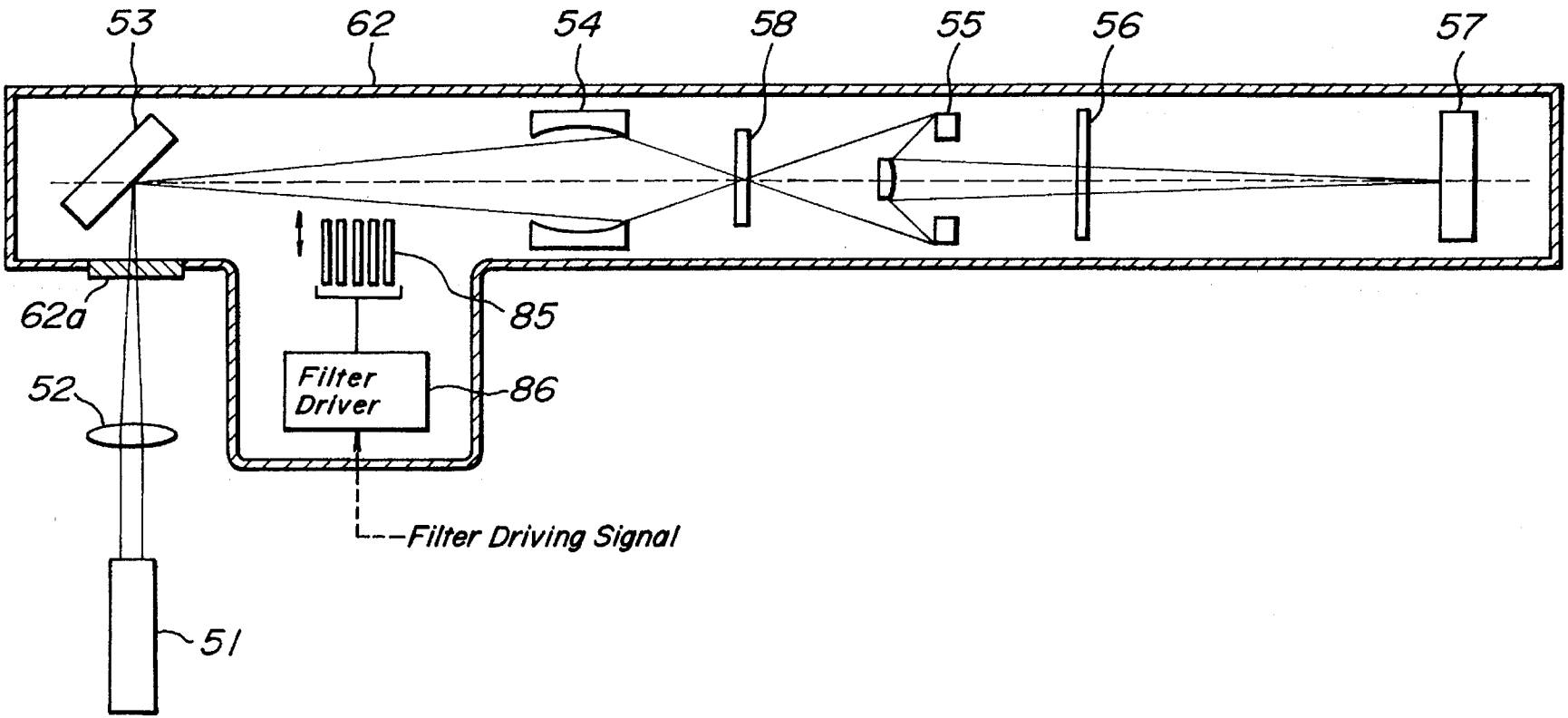
FIG. 20 is a schematic view showing a seventh embodiment of the X-ray microscope according to the invention.

FIG. 20 is a schematic view showing a seventh embodiment of the ultraviolet excitation type X-ray microscope according to the invention. Also in the present embodiment, portions similar to those of the previous embodiments are denoted by the same reference numerals used in the previous embodiments and their explanation is omitted. In the present embodiment, both the X-rays and ultraviolet rays are generated by the laser plasma radiation source comprising the Nd:YAG laser 51, condenser lens 52 and target 53. Between the target 53 and the X-ray condenser lens 54 there is arranged filter assembly 85 including a plurality of X-ray filter elements and ultraviolet filter elements which are removably inserted into the optical path by means of a filer driver 86. The filter assembly 85 and filter driver 86 are arranged within the vacuum chamber 62.

Figure 21:
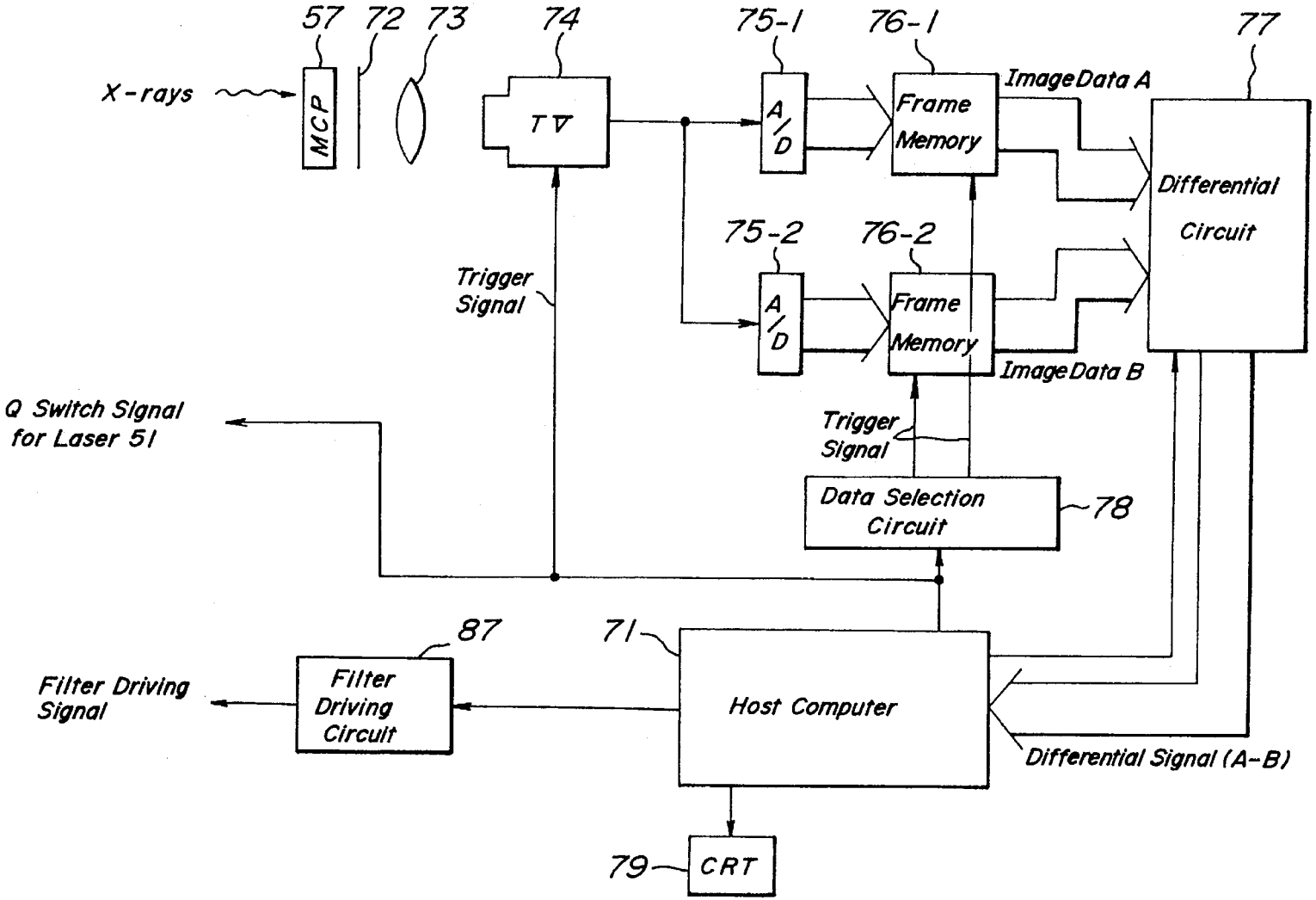
FIG. 21 is a block diagram depicting the signal processing circuit of the seventh embodiment.

FIG. 21 is a block diagram illustrating the signal processing circuit of the present embodiment. The signal processing circuit of the present embodiment is quite similar to that shown in FIG. 14, but in the present embodiment, there is provided a filter driving circuit 87 instead of the polarizer driving circuit 80 in FIG. 14. The filter driving circuit 87 receives commands from the host computer 71 and generates a filter driving signal to be supplied to the filter driver 86 shown in FIG. 20.

The laser plasma radiation source can emit radiation of a wide band including a band from the X-rays to the ultraviolet rays, so that it is possible to obtain the X-rays and ultraviolet rays required for the ultraviolet excitation type X-ray microscope according to the invention. Therefore, if the intensities of the X-rays and ultraviolet rays emitted by the laser plasma radiation source are suitable for the specimen 58, it is not necessary to provide a separate radiation source emitting the ultraviolet rays and the whole construction of the X-ray microscope system can be simplified.

The filer assembly 85 is provided for adjusting the intensities and wavelengths of the X-rays and ultraviolet rays to be made incident upon the specimen 58. That it to say, in order to observe the transmitted X-ray image having a high contrast, a thickness of the specimen 58 may be determined in accordance with the relationship defined by the equation (13), but it is necessary to limit the intensities of the X-rays and ultraviolet rays and a ratio of these intensities and to select wavelengths of the X-rays and ultraviolet rays to remove undesired X-rays and ultraviolet rays which affect the observation. To this end, in the present embodiment, the filter assembly 85 comprises a plurality of X-ray filter elements having different transmission wavelength regions and transmittances and a plurality of ultraviolet filter elements having different transmission wavelength regions and transmittances and these filter elements can be selectively inserted into the optical path by means of the filter driver 86. In this manner, it is possible to observe a transmitted X-ray microscopic image having an excellent contrast.

In the present embodiment, it is not necessary to provide the ultraviolet radiation source or the means for converting the laser light emitted by the Nd:YAG laser into the ultraviolet rays, so that the whole system can be simple in construction and cheap in cost. Moreover, the ultraviolet rays can be selected from the continuous spectrum emitted by the laser plasma radiation source, and thus the wavelength of the exciting ultraviolet rays can be easily and precisely changed. This is particularly suitable for selectively observing particular elements or a particular element in a particular substance contained in a specimen. That is to say, by changing the wavelength of the ultraviolet rays, carbon elements contained in a particular protein contained in a biological specimen composed of various proteins can be exclusively observed.

The Schwarzschild optical element and zone plate have the wavelength selectivity for the X-rays, so that if the condenser lens 54 and/or objective lens 55 is formed by these optical elements, the filter assembly 85 may not include the X-ray filter elements. However, the grazing incident optical element such as the Wolter optical element reflects radiation of any wavelength, so that the filter assembly 85 should include the X-ray filter elements. Therefore, suitable optical elements may be utilized in accordance with applications. It should be noted that when a multilayer coating is applied on the grazing incident type optical element, the element can have the wavelength selectivity. Therefore, when the grazing incident type optical element is constructed to transmit the X-rays of a wavelength region of 65 to 43.7Å, carbon elements in a specimen can be advantageously observed. Furthermore, when it is desired to observe a transmitted X-ray image without irradiation of the ultraviolet rays, the filter assembly 85 may comprise a UV cut filter.

In the above embodiment, the specimen 58 is the LB film having the molecular structure of a single cell shown in FIG. 19, but according to the invention, the relationship defined by the equation (13) may be equally applied in observing LB films having other molecular structures than that shown in FIG. 19, and also in these cases the above explained advantages can be equally attained. Further, in the above embodiment, the ultraviolet rays are produced by the laser plasma radiation source, so that there is not provided a separate UV source. However, it is also possible to provide an UV source such as glass laser, excimer laser and SOR source. Moreover, the intensity of the ultraviolet rays may be changed by inserting a wedge prism into the optical path or by adjusting the focus condition of the condenser lens 82 shown in FIGS. 15, 16 and 18.

It should be further noted that in the above embodiment, the exciting radiation is formed by the ultraviolet rays, but according to the invention, the excitation may be performed by radiation other than the ultraviolet rays. That is to say, a specimen may be excited by irradiating it with X-rays or visible light rays. Also in such a case, the above mentioned relationship expressed by the equation (13) may be equally applied.

As explained above, in the X-ray microscope according to the invention, a specimen is irradiated with the X-rays and exciting radiation rays such as ultraviolet rays, while the condition defined by the equation (13) is satisfied, so that the transmitted X-ray microscopic image of the specimen can be observed with a high contrast.

Figure 22:
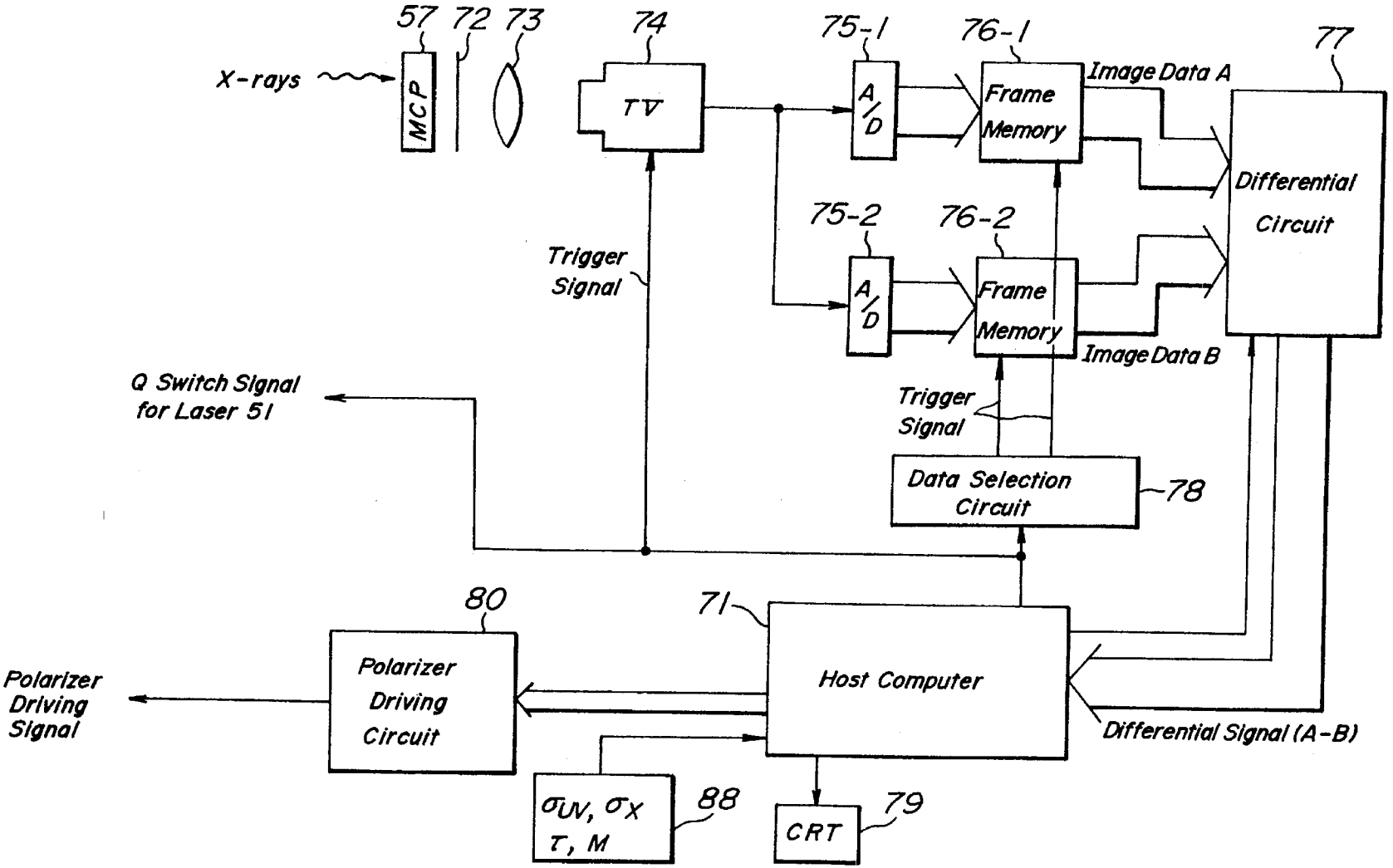
FIG. 22 is a block diagram illustrating the signal processing circuit of a modification of the sixth embodiment shown in FIG. 18.

The inventors have further conducted extensive study for an amount or a photon flux of the ultraviolet rays and have derived a necessary condition for observing the transmitted X-ray image having an excellent contrast. Now this will be explained in detail with reference to the sixth embodiment shown in FIG. 18. FIG. 22 is a block diagram showing the signal processing circuit of the present embodiment and this signal processing circuit is similar to that depicted in FIG. 14, so that similar portions are denoted by the same reference numerals used in FIG. 14. That is to say, the polarizer 65 is rotated in accordance with the polarizer driving signal generated by the polarizer driving circuit 80. In other words, the polarizer driving circuit 80 is controlled by the command signal supplied from the host computer 71 with reference to previously prepared intelligent data base 88 for molecules or atoms under inspection. In this manner, the photon flux of the exciting ultraviolet rays can be adjusted to an optimum value for observing the transmitted X-ray image having a good image quality. As explained above, the polarizer 65 also serves to cut off the irradiation with the ultraviolet rays. The intelligent data base 88 includes an exciting cross-section $\sigma_{UV}$ of molecule or atom under observation due to the ultraviolet rays, $\sigma_x$ a cross-section of the X-rays for exciting the inner-shell electron of molecule or atom under observation into the ultraviolet-excitation-generated outer-shell hole, a lifetime $\tau$ of molecule or atom excited by the UV irradiation, and a tone resolving power M of the X-ray image. These data have been prepared for respective molecules or atoms to be observed.

Now a principle for determining an optimum amount, i.e. photon flux of the ultraviolet rays will be explained in detail by considering the absorption of the ultraviolet rays and a basic process of relaxation. In the following explanation, the notations mentioned above are also used, and further the following factors are defined.

Figure 1:
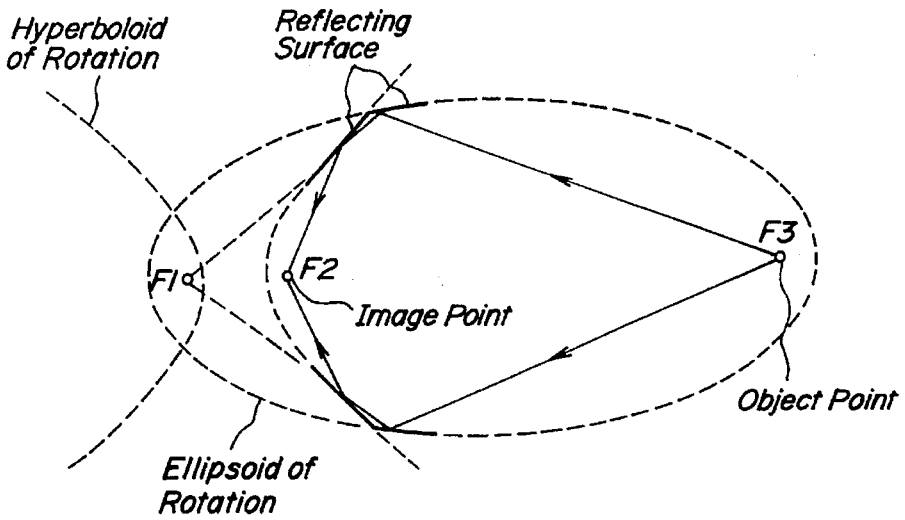
FIG 1 PRIOR ART
FIG. 1 is a schematic view showing a known Wolter type optical element used in the X-ray microscope.
Figure 2:
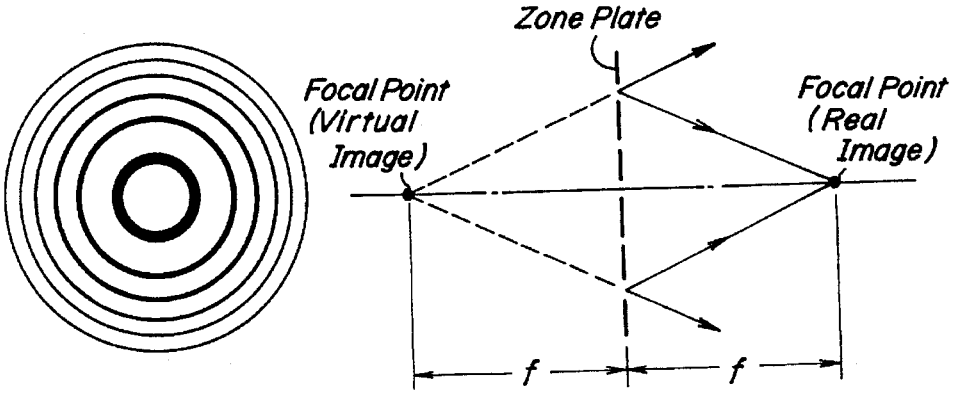
FIG 2 PRIOR ART
FIG. 2 is a schematic view depicting a known zone plate used in the X-ray microscope.
Figure 3:
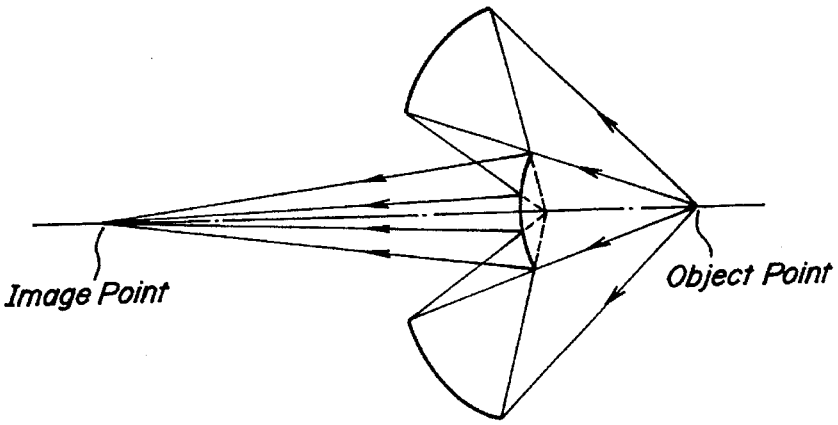
FIG 3 PRIOR ART
FIG. 3 is a schematic view illustrating a known Schwarzschild type optical system used in the X-ray microscope.
Figure 4A:
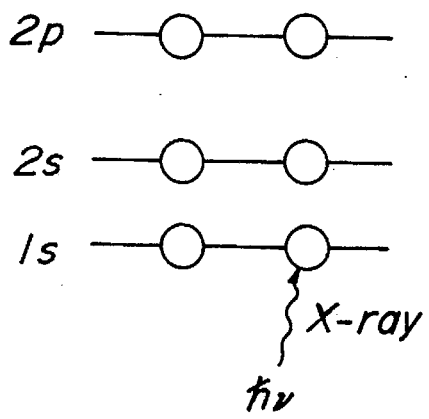
PRIOR ART FIG 4A
FIGS. 4A to 4F are schematic diagram representing the electron transition process under the irradiation of X-rays.
Figure 4B:
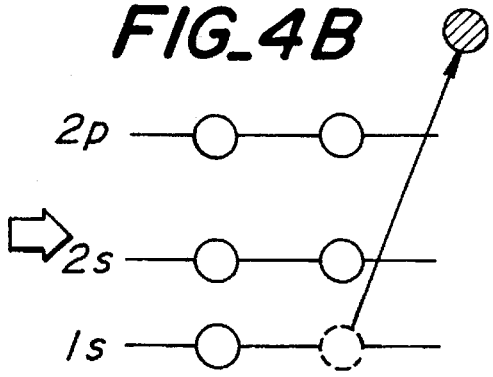
Figure 4C:
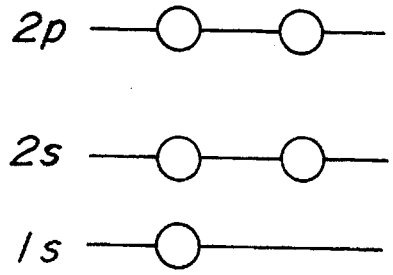
Figure 4D:
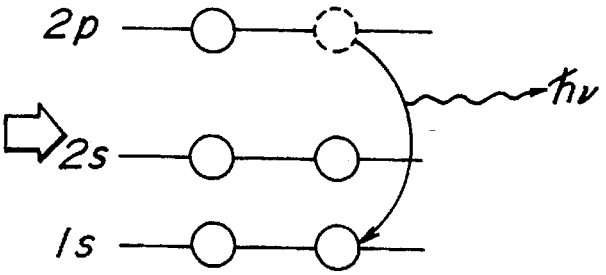
Figure 4E:
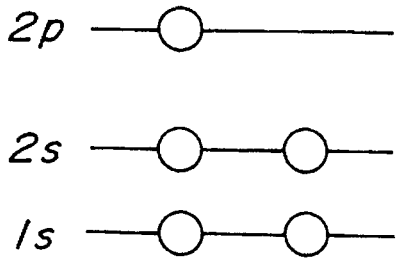
Figure 4F:
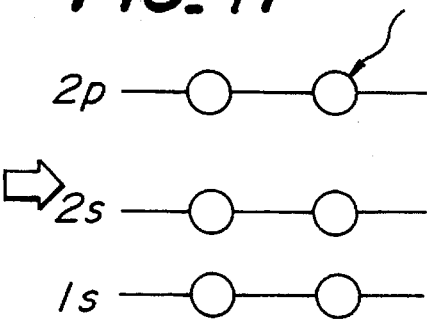
Figure 5A:
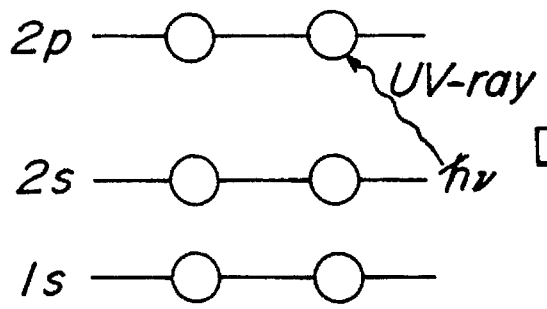
PRIOR ART FIG 5A
Figure 5B:
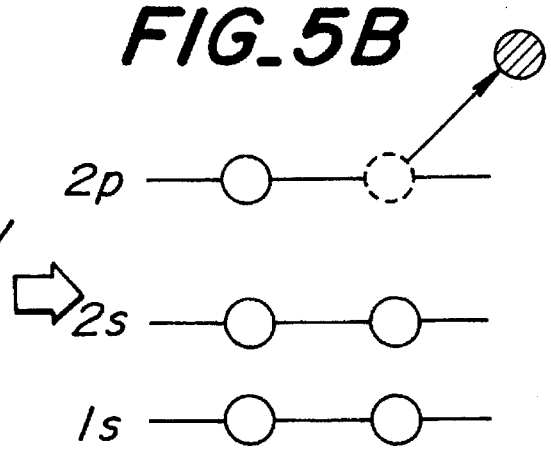
Figure 5C:
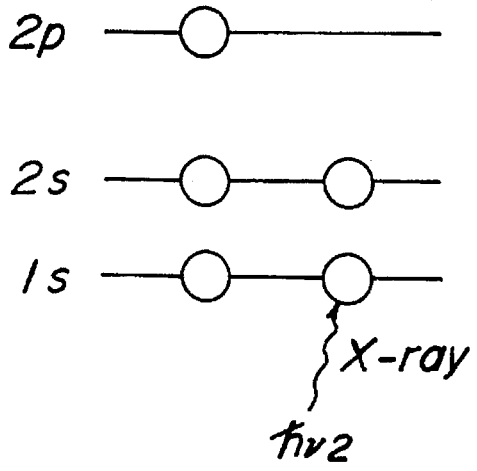
Figure 5D:
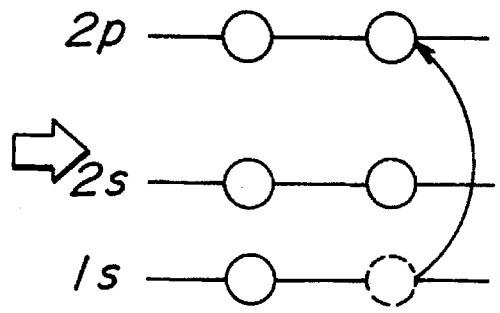
Figure 6:
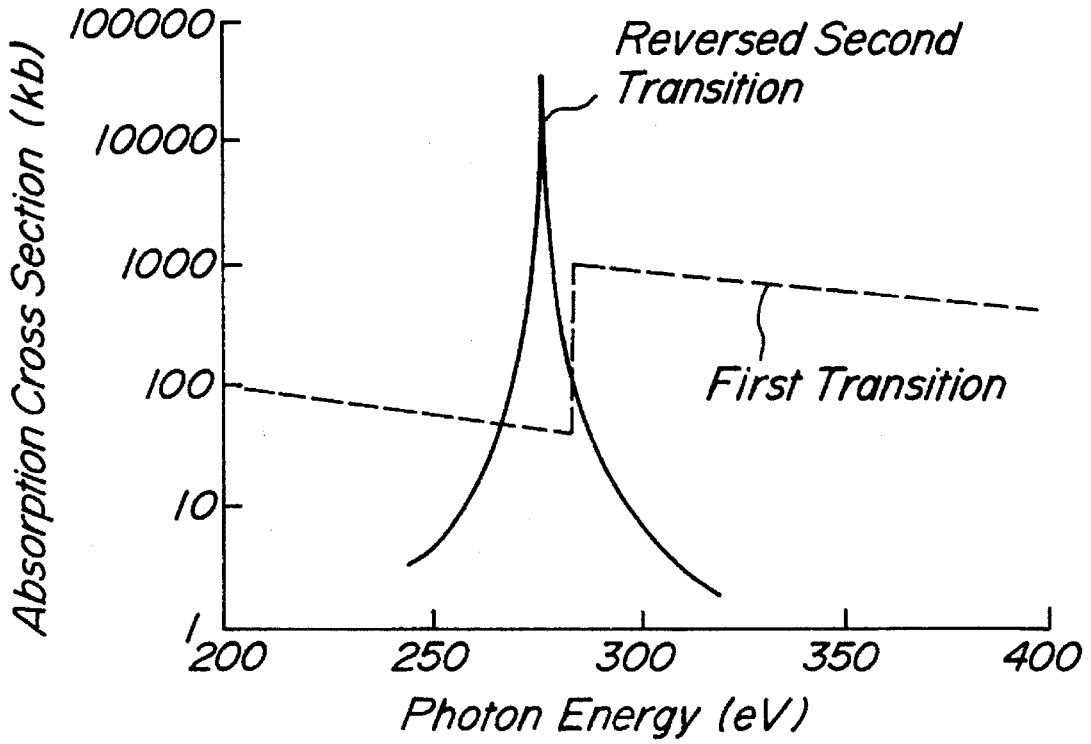
FIG 6 PRIOR ART
FIG. 6 is a graph showing a relation between the photon energy and the absorption cross-section.
Figure 7:
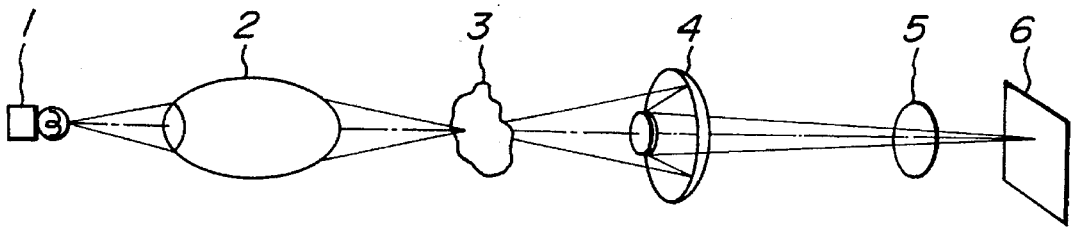
FIG 7 PRIOR ART
FIG. 7 is a schematic view illustrating a known X-ray microscope in which a specimen is irradiated only with X-rays.
Figure 8:
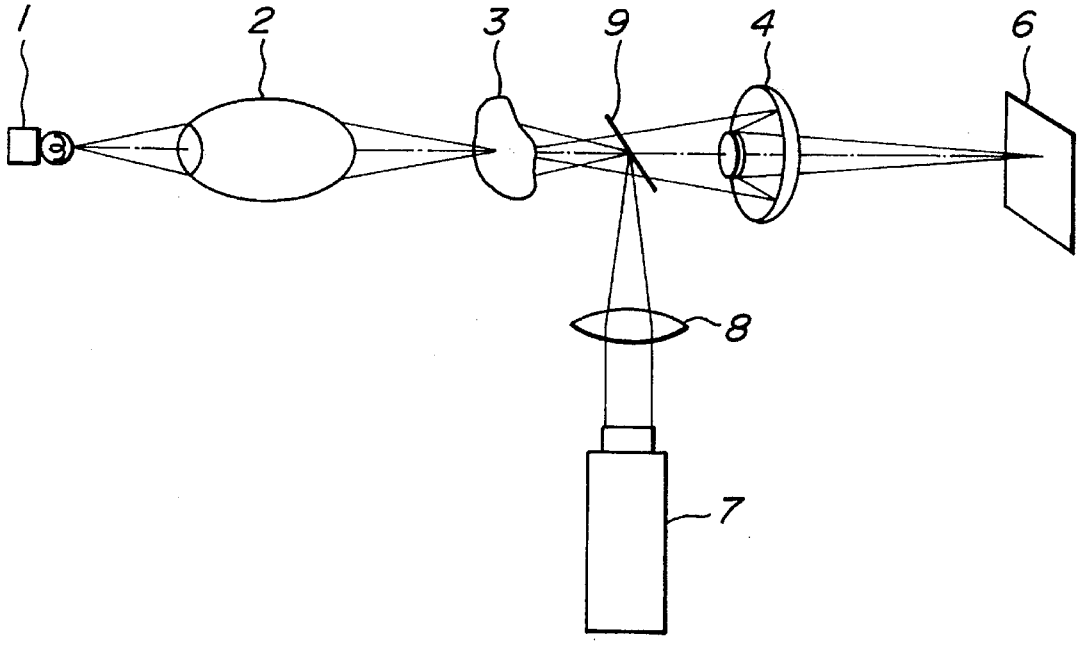
FIG. 8 is a schematic perspective view depicting a first embodiment of the soft X-ray microscope previously proposed by one of the inventors of the present invention, in which a specimen is irradiated with both X-rays and ultraviolet rays.
Figure 9:
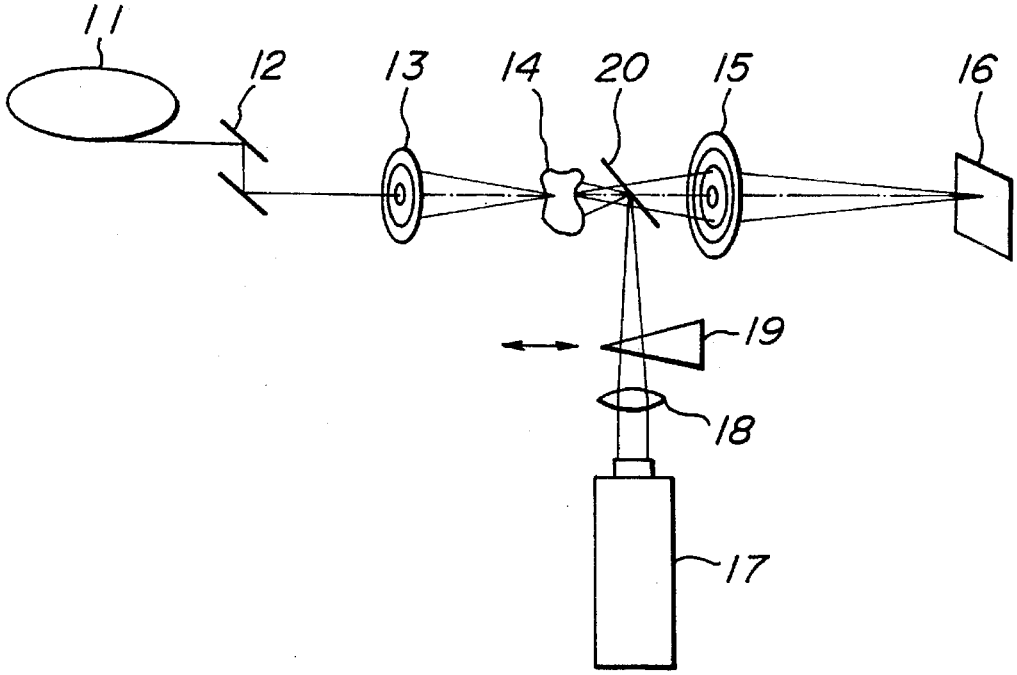
FIG. 9 is a schematic view representing a second embodiment of the previously proposed X-ray microscope.
Figure 10:
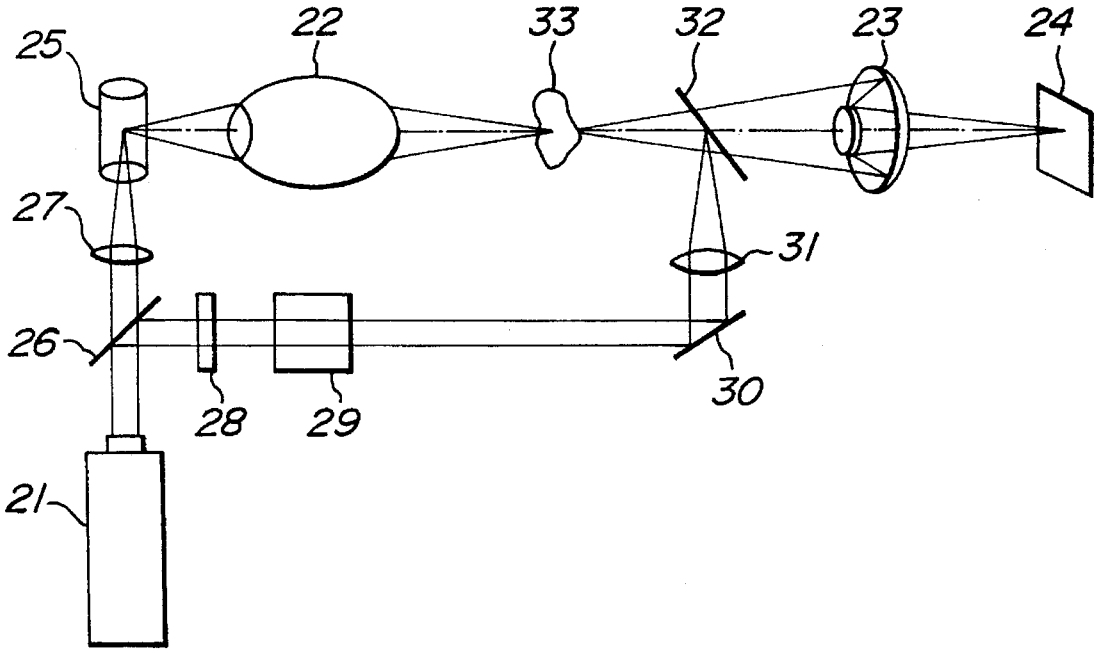
FIG. 10 is a schematic view illustrating a third embodiment of the previously proposed X-ray microscope.

E: energy of X-rays for exciting inner-shell electron of molecule or atom under observation into ultraviolet-excitation-generated outer-shell hole $\omega$: fluorescence yield upon transition of outer-shell electron to be excited with ultraviolet rays into inner-shell hole within univalent ion having inner-shell hole h: Blank's constant c: light velocity It should be noted that the transition in $\omega$ can be simply explained to be corresponding to the reverse transition shown in FIG. 5D. In this analysis, the equations (1) to (8) are applicable. In the equation (8), $\sigma_X$ is hardly influenced by chemical environment of the outer-shell electron, so that the following order estimation may be obtained (refer to Physical Review A, Vol. 43, 1991, J. H. Klems).

$$\sigma_X=\pi/(2E^2)\cdot(nc)^2\omega \text{ wherein, } n=h/2\pi \quad (15)$$

Therefore, the contrast of the transmitted X-ray image may be roughly estimated from the equations (8) and (9).

As stated above, generally the transmitted X-ray microscopic image is obtained by using the two-dimensional MCP or solid state image sensor to derive the bivalent image signal and the bivalent image signal is displayed on the monitor such as CRT. When the image signal is quantized in M tones, it is required to distinguish at least a transmittance of 1 and a transmittance of 1−1/M by increasing the photon flux $I_0$ in order to realize a minimum condition for judging the existence of molecule or atom under observation. That is to say, from the equation (8), the following condition should be satisfied.

$$1-1/M>(1+I_0\sigma_{UV}\tau)^{-\sigma}X/^{\sigma}UV \quad (16)$$

The tone resolving power M depends on the function of the A/D converter, and if the digital image signal is of four bits, M becomes 16 tones and if eight bits, M=256, so that 1/M is sufficiently smaller than unity ($1/M \leqq 1$). Therefore, in accordance with Maclaurin expansion formula, the equation (15) may be rewritten as follows.

$$[\exp\{\sigma_{UV}/(\sigma_X^M)\}-1]/(\sigma_{UV}\tau)<I_0 \quad (17)$$

Therefore, the existence of molecule or atom under inspection contained in the specimen can be judged by performing the image pick-up with the photon flux $I_0$ defined by the above equation (17), while the tone resolving power of the image sensing system can be utilized optimally. In this case, a sufficiently large amount of the ultraviolet rays are made incident upon the specimen, and therefore the transmitted X-ray microscopic image can be observed with a good contrast. As stated above, the X-ray photographic film may be used instead of the opto-electronic image pick-up system including the detector 57, phosphor 72, TV camera system 74 and A/D converters 75-1, 75-2, and also in this case the above condition defined by the equation (17) may be equally applied by determining the resolving power M in accordance with the photographic film.

Now the effectiveness of the above equation (17) will be confirmed by taking a graphite as the specimen 58. The left hand term of the equation (17) will be calculated. First of all, $\sigma_x$ is calculated from the equation (15) by using the fluorescence yield ω described in J. Phys. Chem. Ref. Data, Vol. 8, No. 2, 1979, pp. 307–312, M. O. Krause. From this reference, ω of carbon element constituting the graphite is given as $\omega=3.5\times10^{-3}$. Further as the transition energy E, a value of 227 eV of carbon Kα X-rays is adopted. Then, $\sigma_X$ is calculated in accordance with the equation (15) to obtain $\sigma_X=2.8\times10^{-17}$.

Next, the excitation cross-section of outer-shell electron $\sigma_{UV}$ will be calculated. This value can be calculated from general optical constants. That is to say, $\sigma_{UV}$ may be expressed by the following equation (18) wherein $\lambda_{UV}$ denotes the wavelength of the exciting ultraviolet rays, k is an imaginary part of a refractive index and N is the number of atoms per unit volume.

$$\sigma_{UV}=4\pi k/(N\lambda_{UV}) \quad (18)$$

In Handbook of Optical constants of Solids, Academic Press, 1985, E. D. Palik reported that the imaginary part of refractive index k is equal to 2.65 for the wavelength $\lambda_{UV}=266$ nm. Further, N is generally known to be equal to $1.15\times10^{23}/cm^2$. By applying the above values to the equation (18), the cross-section $\sigma_{UV}=1.1\times10^{-17}$ is obtained.

Next, values of τ and M will be considered. In general, the excitation lifetime τ of the outer-shell electron becomes several nano seconds from data of molecular/atomic fluorescence time. However, the excitation lifetime is shortened by the vibration relaxation process and others, so that it is assumed that τ is 1 nano second. In recent image processing apparatuses, the image signal is treated as a digital signal of eight bits, so that the tone resolving power M is $2^8=256$. Now the equation (17) is calculated by using the above mentioned values for respective parameters to obtain the following condition.

$$I_0>1.4\times10^{23}\ \text{photons/cm}^2\text{/sec} \quad (19)$$

Now it is considered what radiation source could satisfy the above mentioned condition defined by the equation (19). Fourth order harmonics of the Nd:YAG laser output has been known as the radiation source producing a high output power at a wavelength of 266 nm. A pulse width of this Nd:YAG laser is at longest 10 nano seconds, so that its energy per a single pulse may be calculated as follows, while a beam size of the laser beam is assumed to be 1 $cm^2$.

$$(1.4\times10^{23}\ \text{photons/cm}^2\text{/sec})\times(1\ \text{cm}^2)\times(10\times10^{-9}\ \text{sec})\times(5\times1.6\times10^{-19}J)=100\ \text{mJ/pulse} \quad (20)$$

From the above consideration, it is confirmed that a commercially available Nd:YAG laser may be advantageously utilized as the radiation source and its fundamental wave (1064 nm) is converted into the fourth harmonics by means of two non-linear optical crystals. In this manner, the exciting ultraviolet rays having the photon flux which satisfies the above condition can be obtained and the existence of the graphite can be recognized or judged by the ultraviolet excitation type X-ray microscopic method.

In the above explanation, the graphite specimen is considered, but the above explained method of determining the photon flux may be equally applied to any other specimens. Also in these cases, the above mentioned effectiveness may be attained.

Figure 23:
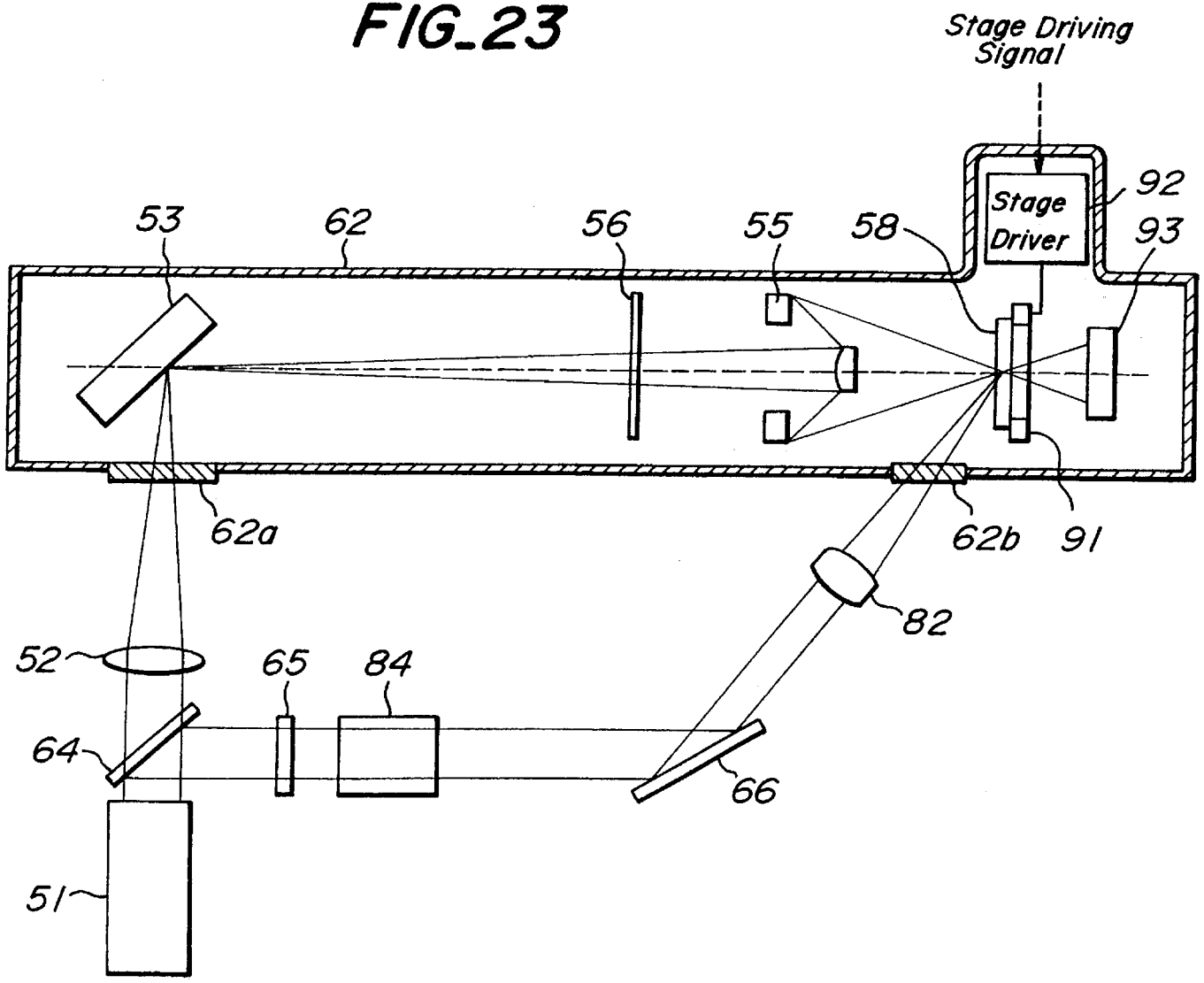
FIG. 23 is a schematic view showing an eighth embodiment of the X-ray microscope according to the invention.

FIG. 23 is a schematic view illustrating a eighth embodiment of the X-ray microscope according to the invention. In the present embodiment, the X-ray microscope is constructed as a scanning type X-ray microscope. That is to say, the X-rays are projected onto a specimen as a fine spot and the specimen and X-ray beam are moved relative to each other in a plane perpendicular to the X-ray optical axis.

The X-rays emitted by the target 53 are made incident upon the condenser lens 54 formed by the Schwarzschild optical element via the ultraviolet cut-off filter 56 and then the X-rays are focused onto the specimen 58 as a very fine beam spot. The ultraviolet cut-off filter 56 serves to prevent undesired ultraviolet rays from being made incident upon the specimen 58. The specimen 58 is supported by a stage 91 which is arranged movably in mutually orthogonal directions X and Y directions in a plane perpendicular to the X-ray optical axis by means of a stage driver 92. X-rays transmitted through the specimen 58 are detected by an X-ray detector 93.

In the scanning type X-ray microscope, a signal generated from a fine point in the specimen 58 which is irradiated with the X-rays is detected by the detector 93 and this detection is repeated for successive points on the specimen by moving the specimen with respect to the X-ray beam spot. The transmitted X-ray image may be obtained by composing a number of signals obtained from the successively scanned points. Therefore, in the present embodiment, the detector 91 may be formed by any type of X-ray detectors instead of the image sensor type detectors 57 used in the previous embodiments.

The exciting ultraviolet rays are also projected by means of the condenser lens 82 as a fine spot onto the specimen 58 from the ultraviolet optical axis which is inclined with respect to the X-ray optical axis.

Figure 24:
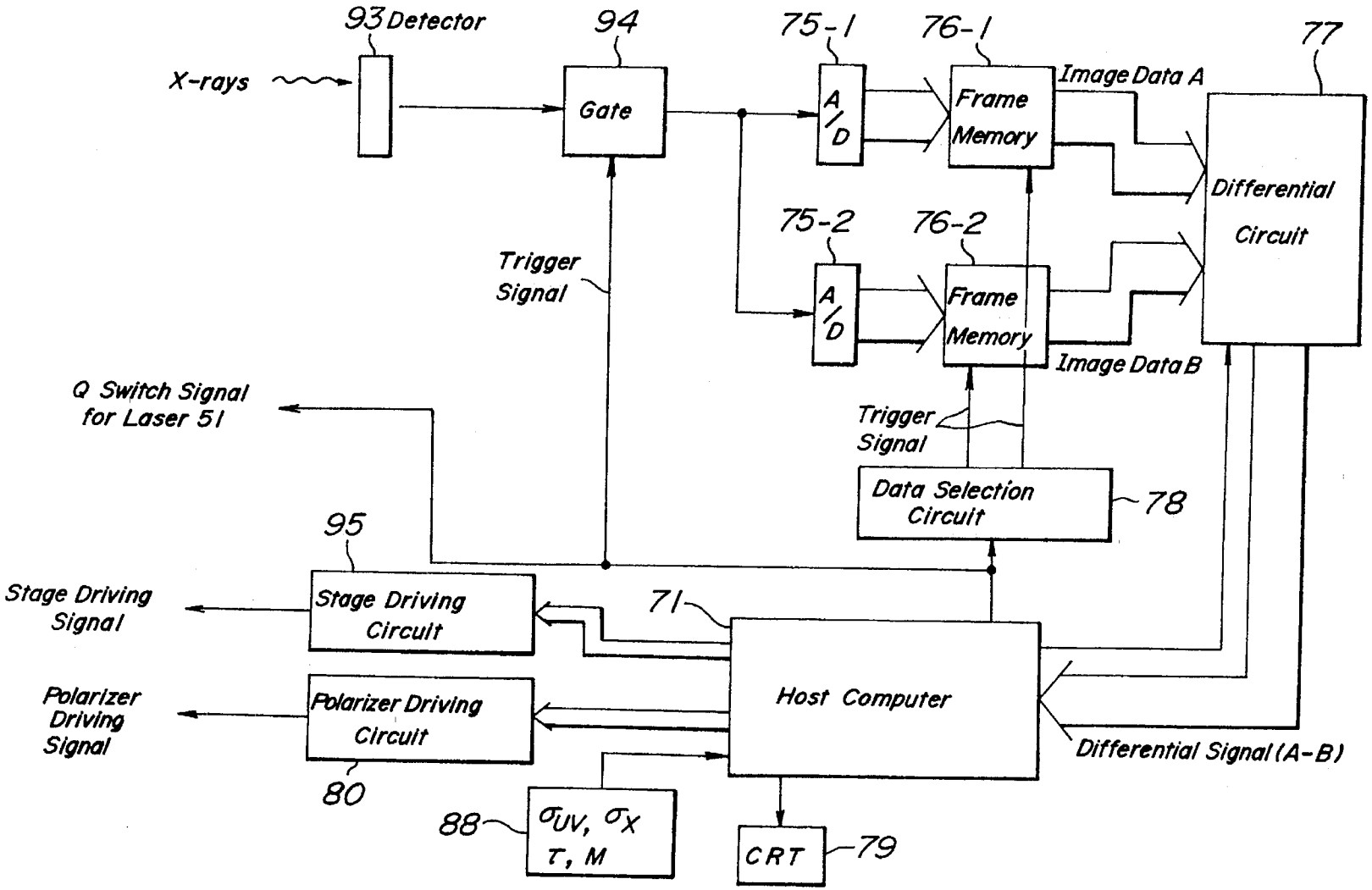
FIG. 24 is a block diagram depicting the signal processing circuit of the eighth embodiment.

FIG. 24 is a block diagram illustrating the signal processing circuit of the present embodiment. The signal produced by the detector 93 is supplied to a gate circuit 94 which is triggered by a trigger signal supplied from the host computer 71 such that a timing at which the output signal form the detector 93 is passed through the gate circuit is synchronized with the movement of the stage 91 holding the specimen 58. In this manner, the output signals produced by the detector 93 are successively supplied to the A/D converter 75-1, 75-2 to produce signal image signals which are then stored in the frame memory 76-1, 76-2. The signal processing circuit further comprises a stage driving circuit 95 for generating the stage driving signal in accordance with commands supplied from the host computer 71.

Next, a range for obtaining the transmitted X-ray microscopic image by using the ultraviolet excitation type X-ray microscope will be considered.

Figure 25:
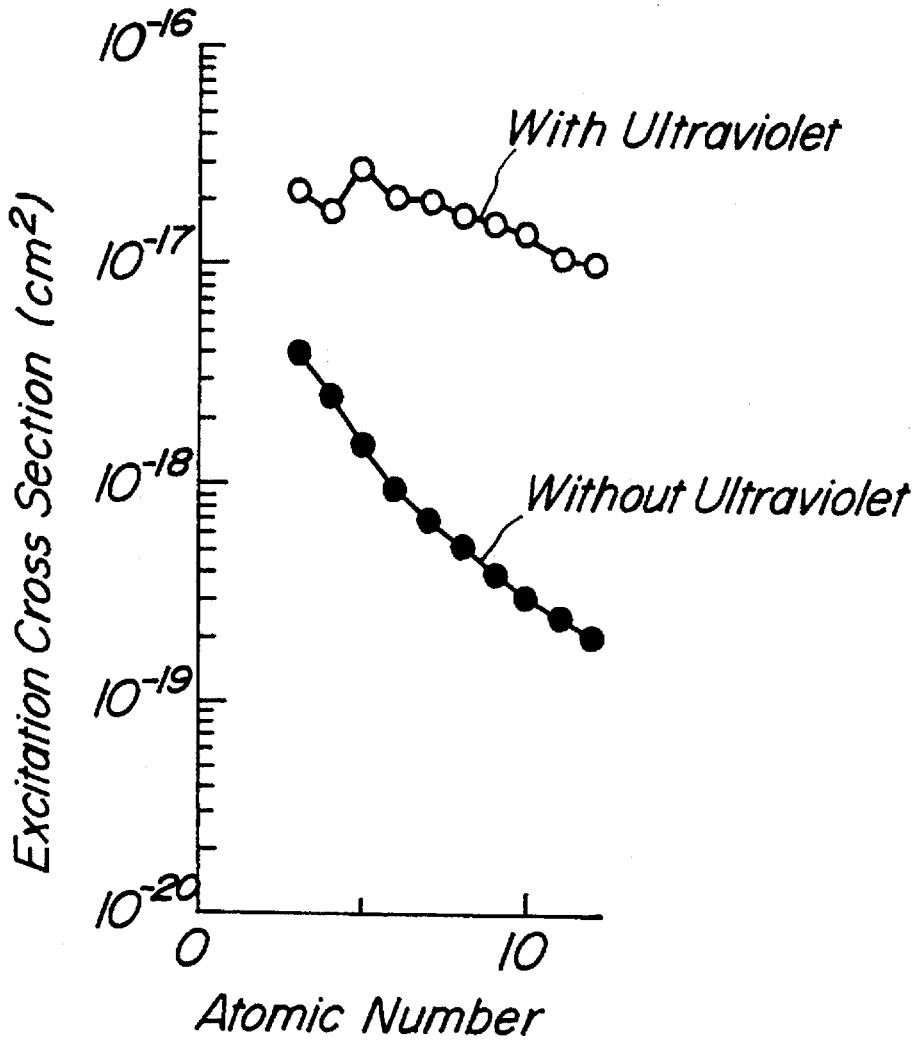
FIG. 25 is a graph representing a relation between atomic number and excitation cross-section.

FIG. 25 is a graph showing an ionization cross-section of atoms having amotic numbers up to 12 at the absorption edge of K-shell and an excitation cross-section for exciting the outer-shell electrons with the irradiation of ultraviolet rays and exciting the K electron into the excitation-generated hole. The ionization cross-section is calculated from the following equation (21) by using atomic scattering factors measured by Henke and the excitation cross-section is calculated from the equation (15) by using the fluorescence yields reported by krause:

$$\sigma=2\lambda r_e f \tag{21}$$

wherein $\sigma$ is the excitation cross-section with the irradiation of ultraviolet, $\lambda$ is a wavelength of the X-rays, $r_e$ represents a classical electron radius, and f is an imaginary part of atomic scattering factor.

From FIG. 25, it is apparent that the excitation cross-section of the X-rays with the ultraviolet irradiation is greater than that without the ultraviolet irradiation by one to two figures. Therefore, it is recognized that elements shown in FIG. 25, i.e. B, Be, C, N, O, F, Ne, Na and Mg have very high absorption coefficients, so that when the specimen contains these elements, it is possible to observe the absorption image by using a smaller amount of X-rays than that for observing the absorption image due to the absorption by the ionization by 10 to 100 times. Further, from the equation (8) the transmittance for the X-rays can be adjusted at will by controlling an amount of the exciting ultraviolet rays.

In the above explanation, there is described the case in which the electron in the 1*s* orbit is excited into the 2*p* orbit for the atoms having the atomic number up to 12. For atoms having atomic numbers from 13 to 30, the electrons in the 3*p* orbit is excited to produce a hole and the electron in the 1*s* orbit is excited into the hole in the 3*p* orbit. In this case, the fluorescence yield $\omega$ becomes smaller by one figure than that in a case of exciting the electron from the 1*s* orbit into the 2*p* orbit (refer to the above listed Physical Review A, Vo. 33, No. 4, 1986), because a ratio of the fluorescence yield of fluorescent X-rays $K\beta/K\alpha$ is about 0.1–0.2. However, the excitation yield is still larger by several to ten times than that in a case of ionizing the inner-shell electron.

From the above, it is apparent that by using the ultraviolet excitation type X-ray microscope according to the invention, it is possible to observe selectively not only C, but also N, O, Ca, K, MG, S, P and Na contained in biological specimens. Furthermore, when a silicon specimen used as industrial material is observed, impurities such as C and O can be selectively observed by suitably selecting the wavelengths of the X-rays and ultraviolet rays. This is particularly effective for observing elements having atomic numbers up to 30.

In the above explanation, the ultraviolet rays are used as the exciting radiation, but according to the invention, the X-rays, visible light rays and other radiation rays may be utilized for exciting the specimen.

The inventors of the present application have further investigated to derive a condition for timings of the irradiation with the X-rays and a time period of irradiation of the ultraviolet rays in order to observe the transmitted X-ray microscopic image having a high contrast. Further, the inventors have found a desired photon flux of the ultraviolet rays in case of satisfying the above condition. According to the invention, after an initiation of the exciting radiation irradiation, the irradiation with the X-rays is started within a time period of $(T+\tau)$, wherein T is a time period during which the specimen is irradiated with the exciting radiation and $\tau$ is a lifetime of molecule or atom under observation in an excited state by the exciting radiation. The inventors have further found that the irradiation time of the exciting radiation is preferably set to $3\tau$.

Figure 26:
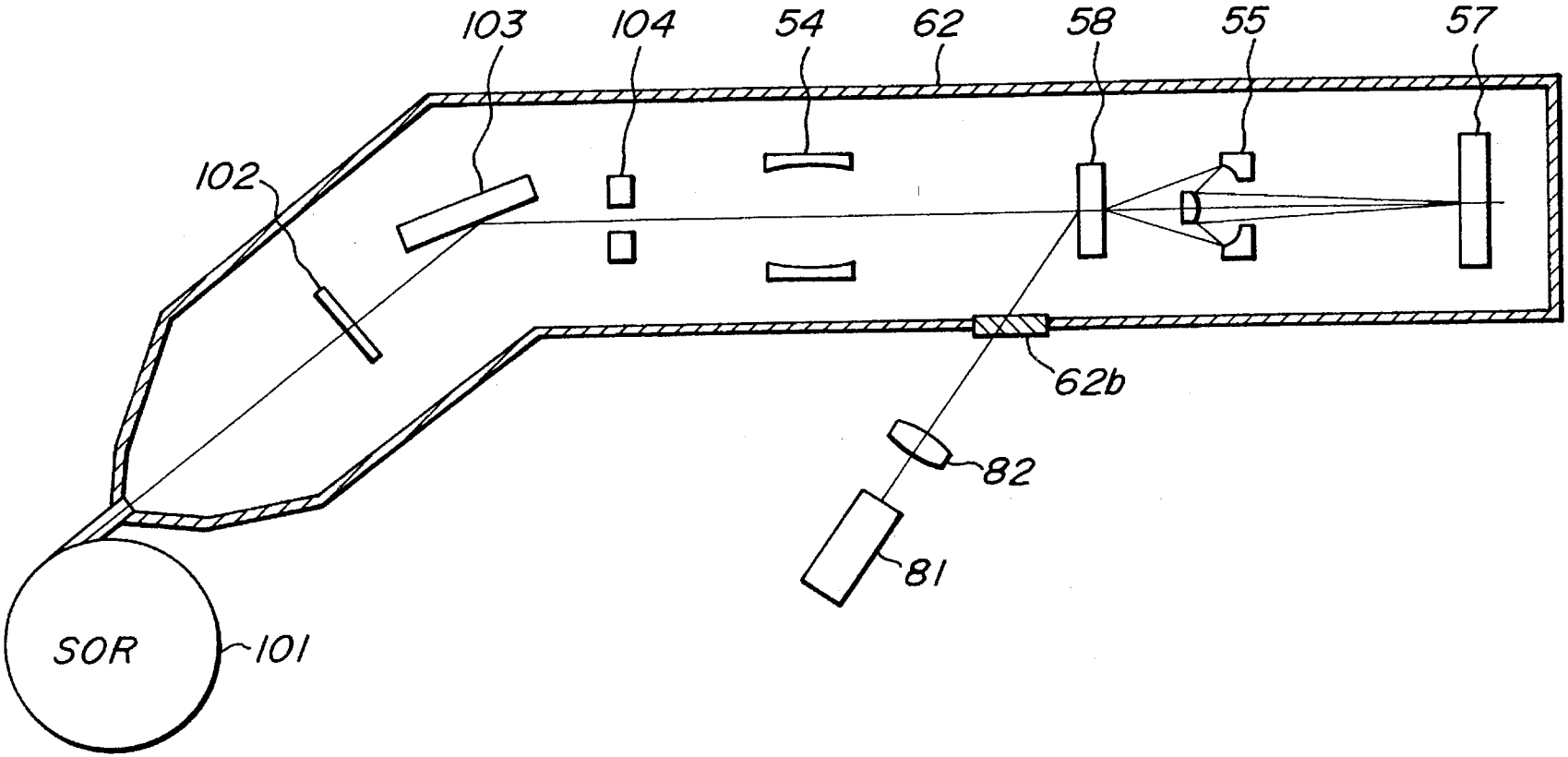
FIG. 26 is a schematic view illustrating a nineth embodiment of the X-ray microscope according to the invention.

FIG. 26 is a schematic view showing a ninth embodiment of the X-ray microscope according to the invention. In the present embodiment, the X-ray radiation source is formed by a synchrotron radiation source (SOR) 101 which emits a continuous spectrum having a wide band from visible light to X-rays in a pulsatory manner. The radiation beam emitted by the SOR 101 is made incident via an ultraviolet cut-off filter 102 upon a monochrometer 103 formed by a diffraction grating. X-rays having a given wavelength emanating from the monochrometer 103 is made incident upon a MCP 104 having a central aperture formed therein, through which the X-rays are made incident upon the condenser lens 54 formed by the Wolter optical element. The MCP 104 generates a signal which is synchronized with the pulsatory emission of the SOR 101. As will be explained later, this signal is supplied to the host computer.

The X-rays passing through the MCP 104 is made incident upon the specimen 58 by means of the condenser lens 54 and X-rays transmitted through the specimen are made incident upon the detector 57 by means of the objective lens 55 formed by the Schwarzshcild optical element. There are further arranged outside the vacuum chamber 62 UV laser 81 emitting ultraviolet rays and condenser lens 82 for focusing the ultraviolet rays onto the specimen 58 by means of the window 62*b* formed in the wall of the vacuum chamber 62. In the present embodiment, the ultraviolet rays are made incident upon the specimen 58 from a direction inclined with respect to the X-ray optical axis, while the specimen is arranged perpendicularly to the X-ray axis. It should be noted that the outlet of the SOR 101 is directly coupled with the vacuum chamber 62 as illustrated in FIG. 26.

Figure 27:
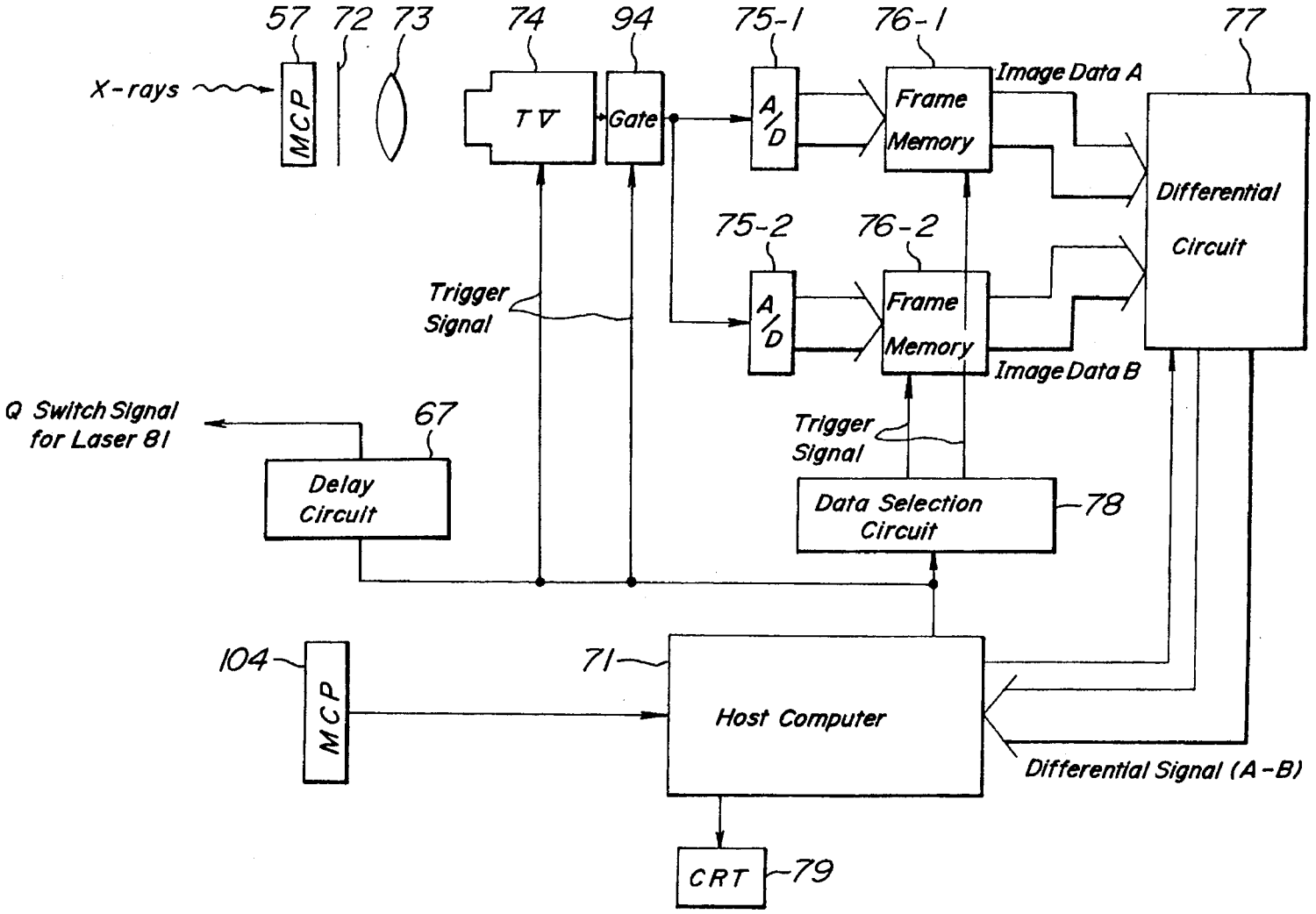
FIG. 27 is a block diagram showing the signal processing circuit of the nineth embodiment.

FIG. 27 is a block diagram showing the signal processing circuit of the present embodiment. This signal processing circuit is quite similar to that shown in FIG. 12 and only a difference will be explained. In the present embodiment, a part of the X-rays emanating from the monochrometer 103 is detected by the MCP 104 and the output signal from the MCP is supplied to the host computer 71. In response to this output signal, the host computer 71 supplies the Q switch signal via the delay circuit 67 to the ultraviolet laser 81 at a suitable timing. The host computer 71 further generates the trigger signals for the TV camera system 74, and data selection circuit 78 in response to the output signal of the MCP 104.

Figures 28A, 28B:
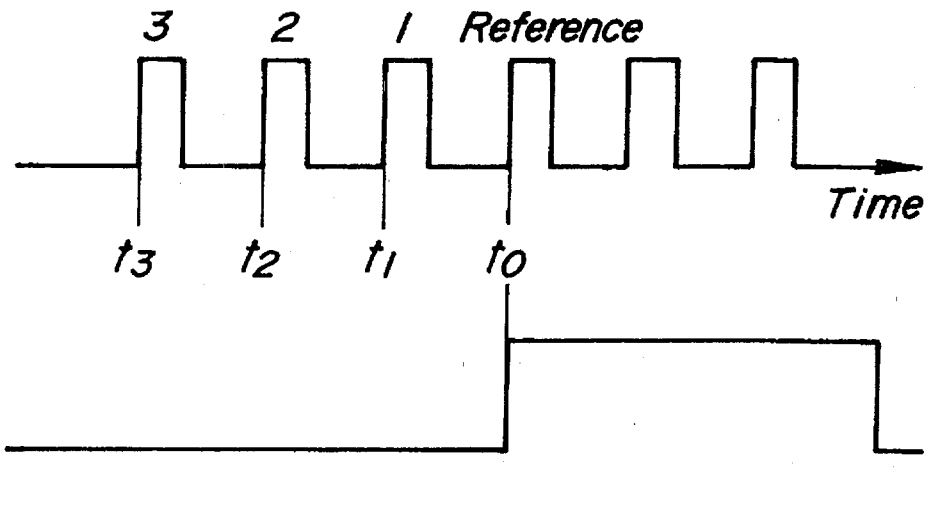
FIGS. 28A and 28B are signal waveforms explaining the operation of nineth embodiment.

Now the operation of the X-ray microscope of the present embodiment will be explained also with reference to FIGS. 28A and 28B representing the output pulses from the MCP 104 and Q switch signal to the UV laser 81, respectively. In the present embodiment, the SOR source 101 emits the pulsatory radiation beam so that the pulsatory X-rays having the given wavelength selected by the monochrometer 103 are made incident upon the specimen 58, and therefore it is not necessary to control the emission timing of the SOR source 101 by means of the host computer 71. In the signal processing circuit of the present embodiment, the output pulses generated by the MCP 104 are counted by the host computer 71 and the Q switch signal is generated by the delay circuit 67 when the predetermined number of pulses has counted. For instance, after a given timing $t_3$, when three pulses have been counted ($t_0$), the Q switch signal is supplied to the UV laser 81 as shown in FIG. 28B to emit the ultraviolet rays.

The host computer 71 generates the trigger signals to the TV camera system 74, gate circuit 94, and frame memories 76-1, 76-1 in synchronism with the emission of the ultraviolet rays, and the first and second digital image signals A and B are stored in the frame memories 76-1 and 76-2, respectively with and without the irradiation with the ultraviolet rays.

As shown in FIGS. 28A and 28B, a time period during which the specimen is irradiated with the ultraviolet rays is longer than a time duration of a single X-ray pulse, so that during the irradiation with the ultraviolet rays, the specimen is repeatedly irradiated with the X-ray pulses. In order to avoid an undesired superimposition of transmitted X-ray images, the image signal obtained by only one X-ray pulse is stored in the frame memory 76-1. To this end, in the present embodiment, the gate circuit 94 is arranged between the TV camera system 74 and the A/D converters 75-1, 75-2.

Now a principle for determining optimum time period for the irradiation with the ultraviolet rays and optimum timing for the irradiation with the X-rays will be explained with reference to the ultraviolet absorption and basic process of relaxation. As stated above, the ratio $\alpha$ of molecule or atom excited with the ultraviolet rays is defined by the equation (3). In this equation (3), $\alpha$ becomes larger, when the irradiation time is longer, while the photon flux of the ultraviolet rays is assumed to be constant. In the ultraviolet excitation type X-ray microscope, when the $\alpha$ becomes larger, the absorption coefficient becomes larger and the contrast of the transmitted X-ray image is increased.

In the equation (3), the value of $\alpha$ depends on the term $C=\exp[-(I_0\sigma_{UV}+1/\tau)t]$. In order to effect the excitation, the value of C should be as small as possible. When T is set to be equal to $3\tau$ ($T=3\tau$), C becomes substantially smaller than 0.05. That is to say, when the irradiation time T of the ultraviolet rays is set to be equal to or shorter than $3\tau$, the effectiveness of the excitation can be enhanced. In this manner, by setting the irradiation time of the ultraviolet rays in accordance with the lifetime $\tau$ of molecule or atom excited with the ultraviolet rays, the outer-shell electron can be effectively excited within a short time. Contrary to this, in case of the reverse transition, more than 95% of excited molecules or atoms are returned into the ground state at a time after the period of $3\tau$ has elapsed from a completion of the irradiation with the ultraviolet rays. From the above consideration, according to the invention, in order to observe the transmitted X-ray microscopic image having a good contrast, the X-ray pulse having the duration not longer than $(T+3\tau)$ is projected onto the specimen within a time period of not longer than $(T+3\tau)$ after the initiation of the irradiation with the ultraviolet rays. In the present embodiment, the timing of the irradiation of the ultraviolet rays is determined with reference to the timing of the irradiation with the X-rays, so that both the X-rays and ultraviolet rays are made incident upon the specimen substantially simultaneously. Therefore, the above condition is satisfied.

Now the ultraviolet radiation source will be considered for observing biological proteins by means of the X-ray microscope. In this case, the absorption of carbon is mainly observed. The previously listed J. H. Klems reference has reported that carbon reveals a strong absorption band in a wavelength of 200 to 300 nm and a lifetime of excited state is nearly equal to 3 nano seconds. Therefore, it is very suitable to utilize harmonics of output radiation emitted by the Nd:YAG laser having the pulse duration of 6 to 10 nano seconds. In case of generating an excited condition having a shorter lifetime such as several hundreds pico seconds due to the relaxation of protein molecules, harmonics of output radiation emitted from Ti sapphire laser having a short pulse duration and SOR source may be advantageously used.

When the protein molecules having the lifetime of 3 nano seconds is irradiated with the harmonics of the Nd:YAG laser output radiation under the above condition, after the irradiation of the ultraviolet rays has been initiated, the irradiation with the X-rays should be started within 20 nano seconds in order to observe the transmitted X-ray microscopic image having a good contrast.

In the present embodiment, the timings of the irradiation with the X-rays and ultraviolet rays are controlled by the host computer 71, but according to the invention, the following simple method can be also adopted.

The output pulses $S_1$ are extracted by a gate circuit 105 and the extracted pulses $S_2$ are supplied to an one-shot multivibrator 106. An output signal $S_3$ of the multivibrator 106 is supplied to a pulse generator 107 which produces an output signal $S_4$ in response to a trailing edge of the signal $S_3$. The output signal $S_3$ is supplied to a switch 108 to generate the Q switch signal and the thus generated Q switch signal is supplied to the ultraviolet laser. A time constant of the one-shot multivibrator 106 is adjustable from the external, so that the timing at which the pulse signal $S_4$ is generated by the pulse generator 107 can be adjusted.

The output pulse $S_1$ from the MCP 104, output pulse $S_2$ from the gate circuit 105 and output pulse $S_4$ from the pulse generator 107 are displayed on an oscilloscope and the time constant of the one-shot multivibrator 106 is adjusted by watching these pulses. When the switch 108 is made on after confirming a fact that the pulses $S_1$ and $S_4$ become a suitable timing relation, the irradiation with the X-rays and ultraviolet rays can be initiated.

In practice, there is induced an electric delay due to electric cables, so that it is preferable to adjust the time constant by watching the transmitted X-ray microscopic image displayed on the CRT.

The above analysis may be equally applied to other substances, molecules or atoms than the proteins in the biological substances, and also in these cases, the above explained advantages can be equally attained.

Figure 31:
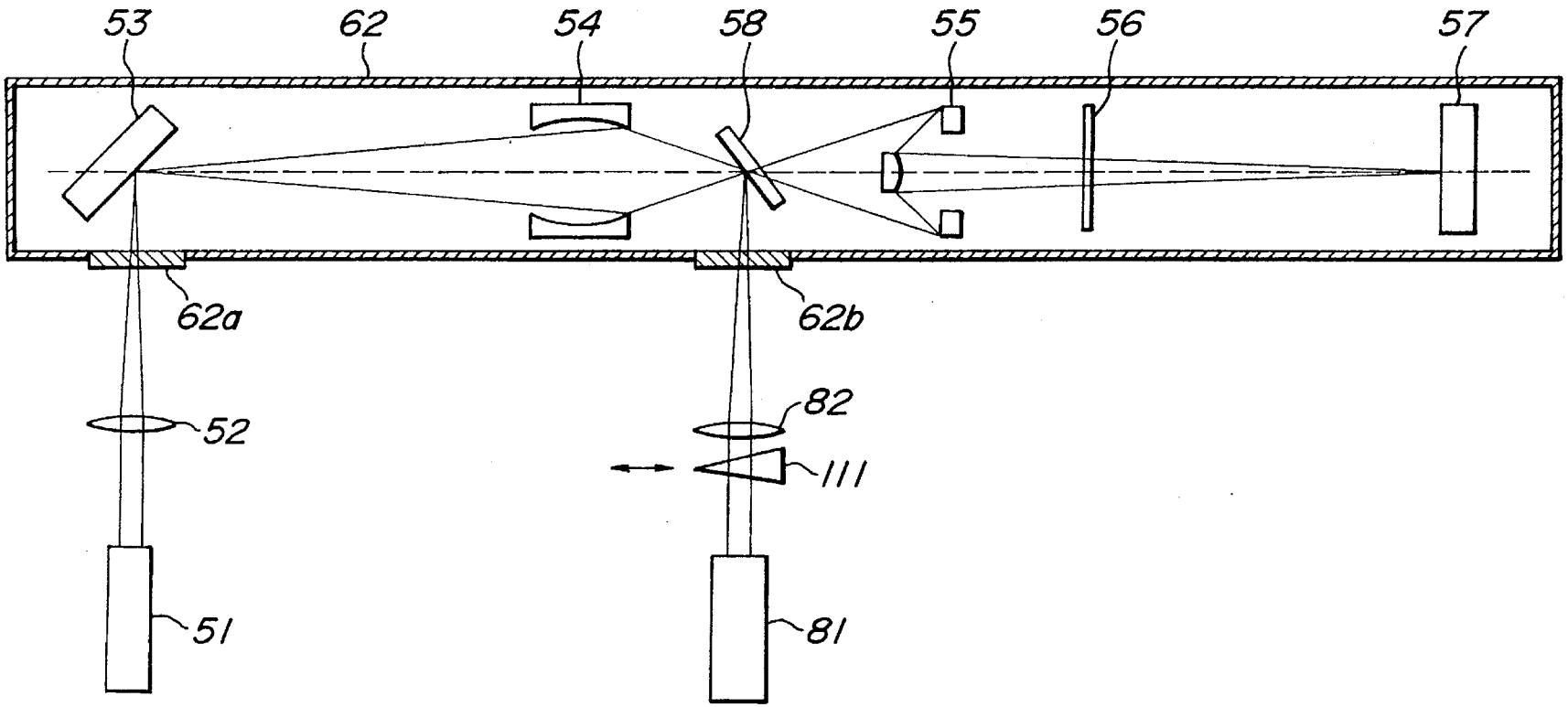
FIG. 31 is a schematic view illustrating a tenth embodiment of the X-ray microscope according to the invention.

FIG. 31 is a schematic view depicting a tenth embodiment of the X-ray microscope according to the invention. The construction of the optical system of this embodiment is quite similar to the fourth embodiment shown in FIG. 16. In the present embodiment, a glass wedge 111 is inserted between the UV laser 81 and the condenser lens 82 for adjusting an amount of the ultraviolet rays. The specimen 58 is inclined by 45 degrees with respect to the X-ray optical axis and the ultraviolet rays are made incident upon the specimen perpendicularly to the X-ray optical axis. As explained above, this construction is suitable for a case in which the condenser lens 54, specimen 58 and objective lens 55 are arranged on the X-ray optical axis close to each other.

Figure 32:
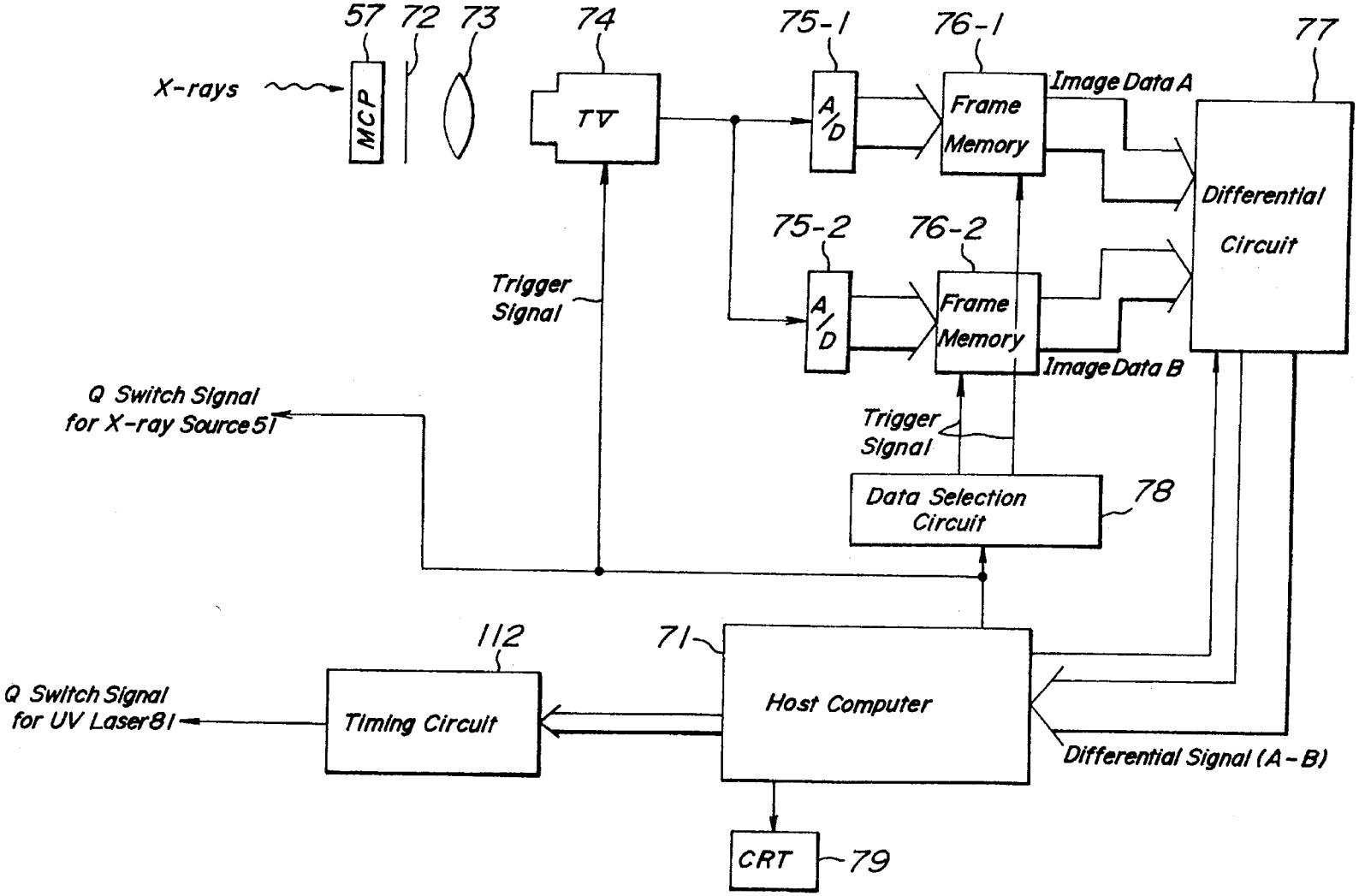
FIG. 32 is a block diagram depicting the signal processing circuit of the tenth embodiment.

FIG. 32 is a block diagram showing the signal processing circuit of the present embodiment. In the present embodiment, there is provided a timing circuit 112 for generating the Q switch signal for the ultraviolet laser 81 in accordance with commands supplied from the host computer 71. The timing circuit 112 also serves as the gate circuit for the Q switch signal. That is to say, the timing circuit 112 is controlled by the commands supplied from the host computer 71 and adjusts the output timings of the Q switch signal for the Nd:YAG laser 51 and Q switch for the ultraviolet laser 81 such that the X-rays are made incident upon the specimen 58 within the time period of $(T+3\tau)$ from the initiation of the irradiation with the ultraviolet rays.

According to further aspect of the present invention, the X-ray microscope can selectively observe a particular kind of molecule or atom contained in a specimen by changing a wavelength of exciting radiation rays. Now this will be explained in detail.

Figure 33:
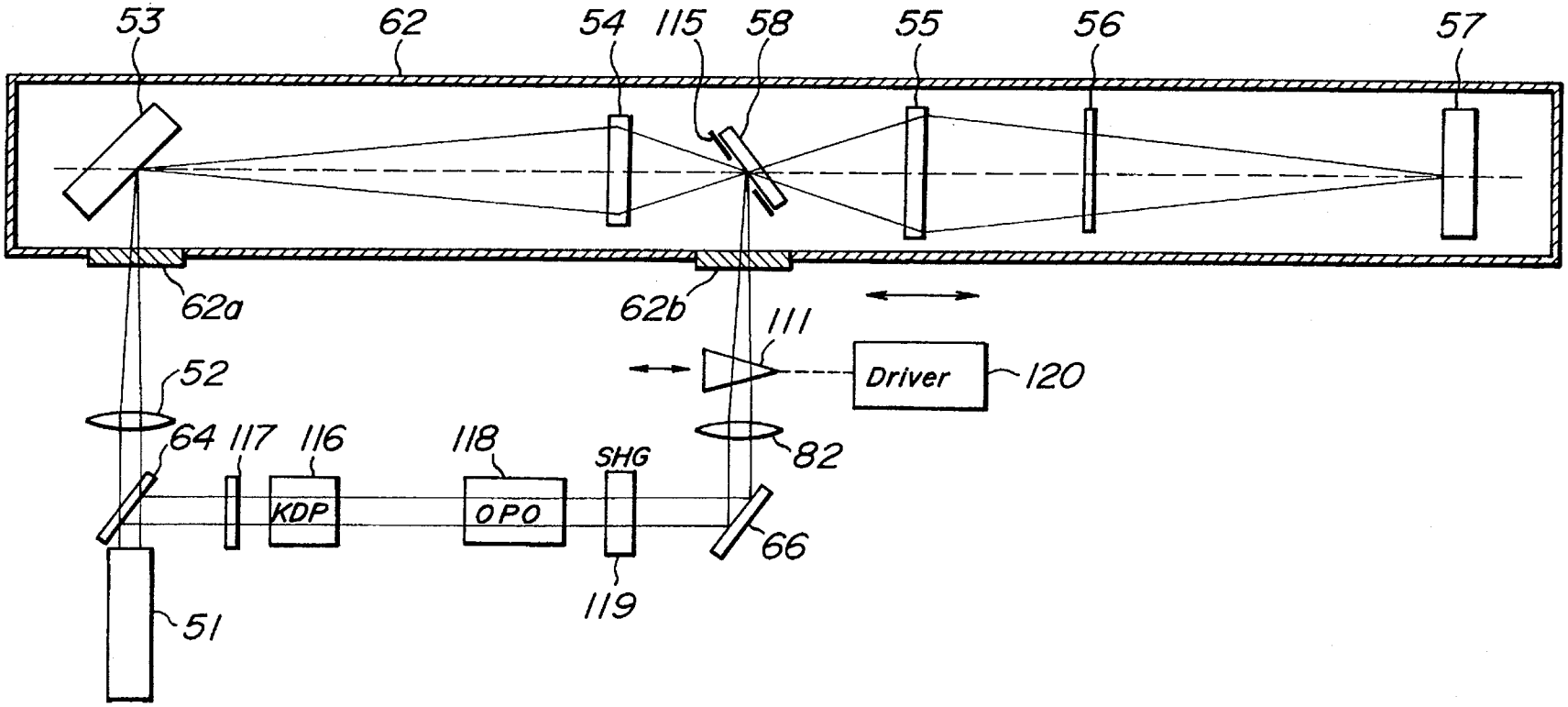
FIG. 33 is a schematic view showing an eleventh embodiment of the X-ray microscope according to the invention.

FIG. 33 is a schematic view showing an eleventh embodiment of the X-ray microscope according to the invention, in which a wavelength of exciting ultraviolet rays can be changed in accordance with a substance under observation. The whole construction of the optical system of the present embodiment is similar to that of the sixth embodiment illustrated in FIG. 18. That is to say, in the present embodiment, the X-rays and exciting ultraviolet rays are generated by using the single Nd:YAG laser 51. The laser beam emitted by the Nd:YAG laser 51 is made incident upon the target 53 by means of the condenser lens 52 to emit X-rays having a given wavelength. Then, the X-rays are made incident upon the specimen 58 by means of the condenser lens 54 via a pin hole plate 115. The X-rays transmitted through the specimen 58 are detected by the detector 57 by means of the objective lens 55 and ultraviolet cut-off filter 56. The specimen 58 is arranged to be inclined with respect to the X-ray optical axis by 45 degrees.

A part of the laser beam emitted from the Nd:YAG laser 51 is reflected by the half mirror 64 and the thus divided laser beam is made incident upon a KDP crystal 116 via a shutter 117. The KDP crystal 116 functions to convert incident radiation into its third harmonics, so that the laser beam emitted by the Nd:YAG laser 51 is converted into ultraviolet rays. The thus converted ultraviolet rays are made incident upon an optical parametric oscillator (OPO) 118 for changing or adjusting a wavelength of ultraviolet rays. Then, the ultraviolet rays having the wavelength adjusted by the OPO 118 are made incident upon a second harmonic generator (SHG) 119 and are converted into second harmonic. Then, the thus obtained ultraviolet rays are projected onto the specimen 58 by means of condenser lens 82, glass wedge 111 and UV transmissive window **62*b* formed in the wall of the vacuum chamber 62**.

As explained above, in the present embodiment, the X-ray radiation source is formed by the laser plasma radiation source emitting the white light, and the X-ray condenser lens 54 is formed by the Fresnel zone plate. The Fresnel zone plate has a wavelength dispersion, so that X-rays having different wavelengths are collected at different points, so that by arranging the pin hole plate 115 in front of the specimen 58 the specimen can be irradiated with the X-rays having a given wavelength.

The objective lens 55 is also formed by the zone plate due to the following reason. In the present embodiment, in order to excite the specimen under the optimum condition, the wavelength of the ultraviolet rays is changed, so that when use is made of the objective lens of Schwarzschild type, an amount of the X-rays arriving at the detector 57 is reduced if the change in the wavelength of the X-rays exceeds a certain value, because the reflectance of the Schwarzschild optical element is decreased abruptly when the wavelength of the X-rays is shifted from the designed reference wavelength due to the variation of the wavelength of the ultraviolet rays. The zone plate has a property that the focal length is changed for the variation in the wavelength (chromatic aberration), so that when the wavelength of the X-rays emanating from the specimen is shifted to a certain amount due to the change in the wavelength of the exciting ultraviolet rays in accordance with the substances to be observed, the position of the zone plate objective lens 55 is finely adjusted along the X-ray optical axis as represented by a double headed arrow by means of a suitable mechanism not shown in FIG. 33 such that the focusing condition of the X-ray image formed on the detector 57 is remained unchanged. In this case, the position of the zone plate condenser lens 54 may be finely adjusted in conjunction with the movement of the objective lens 55, if necessary.

Figure 34:
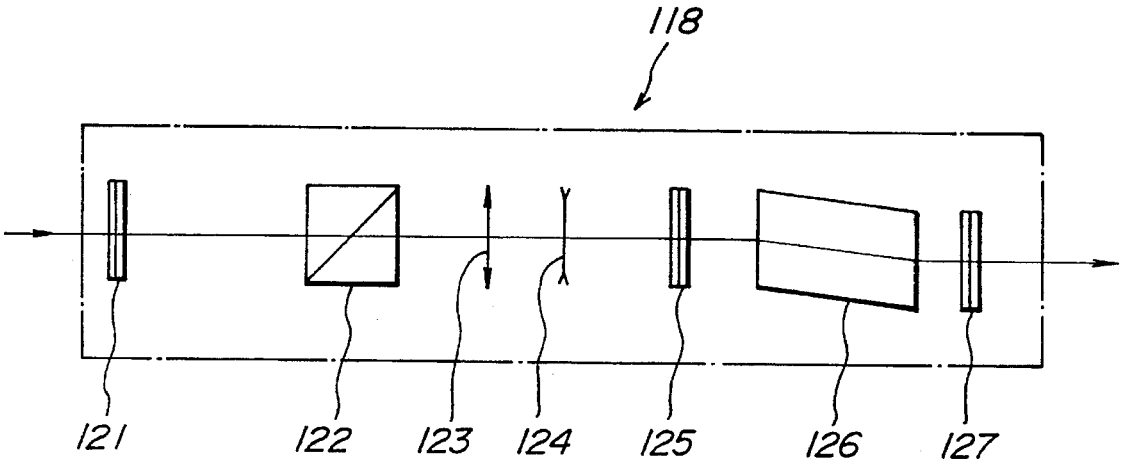
FIG. 34 is a schematic cross sectional view depicting a detailed construction of the optical parametric oscillator shown in FIG. 33.

FIG. 34 is a schematic view illustrating the detailed construction of the optical parametric oscillator (OPO) 118. The OPO comprises half wavelength plate 121, polarizer 122, beam expander 123, 124, BBO crystal 126 and BBO resonance mirrors 125, 127. The OPO 118 itself is known and is commercially available from, for example BMI company (France). The optical parametric oscillation is a non-linear optical process for generating radiation whose wavelength can be tuned over a very wide range. The wavelength tuning is performed continuously by controlling or adjusting a temperature of the BBO crystal 126 and/or an angle of the BBO crystal with respect to the optical axis. When the third harmonics of the Nd:YAG laser-beam (353 nm) is made incident upon the OPO 118, it is possible to generate radiation whose wavelength varies over a range from 400 to 2600 nm including the UV region. Further, by arranging the SHG 119 behind the OPO, the wavelength tuning range can be extended toward the UV region up to 200 nm.

The glass wedge 111 functions to adjust an amount, i.e. a photon flux of the ultraviolet rays to be made incident upon the specimen 58 by changing an optical path length, i.e. a thickness of glass by moving it in a direction perpendicular to the optical axis as illustrated by a double-headed arrow with the aid of a suitable wedge driver 120. The wedge 111 is made of a glass material such as BK7 glass having a sufficiently high absorption for the ultraviolet rays.

If a size of an area on the specimen which is irradiated with the ultraviolet rays does not matter, an amount of the ultraviolet rays may be adjusted by moving the condenser lens 82 along the optical axis to change a focusing condition. In such a case, the wedge 111 is dispensed with.

Figure 35:
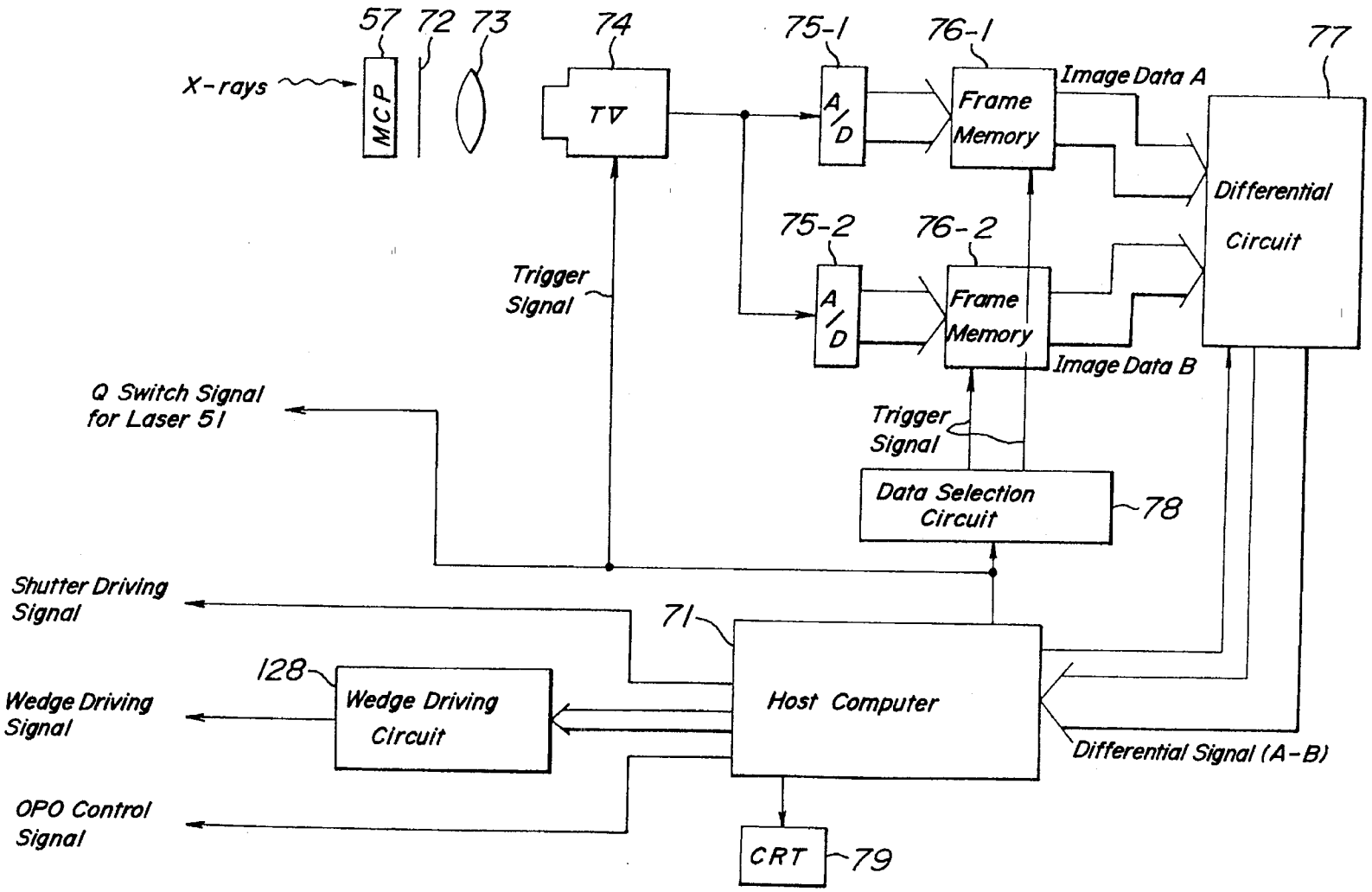
FIG. 35 is a block diagram showing the signal processing circuit of the eleventh embodiment.

FIG. 35 is a block diagram depicting the signal processing circuit of the present embodiment. In the present embodiment, the host computer 71 generates not only the Q switch signal for driving the Nd:YAG laser 51, but also OPO control signal for controlling a wavelength of the ultraviolet rays, photon flux control command for controlling an amount of the ultraviolet rays, and a shutter control command for driving the shutter 117. The photon flux control command is supplied to a wedge driving circuit 128 to produce a wedge control signal, and this wedge control signal is supplied to the wedge driver 120. The remaining construction of the signal processing circuit of the present embodiment is substantially identical with those of the signal processing circuits of the previous embodiments.

Now the operation of the present embodiment will be explained by taking an example for observing carbon contained in a particular substance, i.e. protein constituting a biological specimen together with other substances also containing carbon. Prior to the observation, a carbon containing substance under observation is selected from the following table 2. This may be carried out by entering a substance name or its code into the host computer 71 from a suitable means such as keyboard. Then, the host computer 71 selects a desired wavelength of the ultraviolet rays to be made incident upon the specimen 58 with reference to a look-up table previously stored in the host computer. For instance, if tryptophane is to be observed, a wavelength of the ultraviolet rays is set to a value within a range from 205 to 230 nm, and the host computer 71 supplies the OPO control signal corresponding to the thus selected wavelength for controlling the temperature and/or an angle of the BBO crystal 126 in the OPO 118. In addition to this automatic wavelength selection, there is provided a manual wavelength selection for observing substances whose desired wavelengths are not known.

After the completion of the selection of the wavelength of the ultraviolet rays, the host computer 71 supplies the Q switch signal to the Nd:YAG laser 51 to emit the laser beam. The laser beam is made incident upon the target 53 to emit the X-rays. At the same time the host computer 71 supplies the trigger signals to the TV camera system 74 and frame memories 76-1, 76-2 in synchronism with the generation of the X-rays, and further supplies the shutter driving signal to open the shutter 117. Therefore, the laser beam divided by the half mirror 64 passes through the shutter 117. Further the host computer 71 supplies the command to the wedge driving circuit 128 and this circuit generates the wedge control signal for controlling an amount of the ultraviolet rays passing therethrough. In this manner, the specimen 58 is irradiated with the X-rays and ultraviolet rays having the desired wavelength and in the first frame 76-1 there is stored the first digital image signal A which is obtained by irradiating the specimen 58 with both the X-rays and exciting ultraviolet rays.

Next the host computer 71 changes a state of the shutter driving signal to close the shutter 117, so that the irradiation with the ultraviolet rays is stopped. In this manner, the second digital image signal B is stored in the second frame memory 76-2. As stated above, the second digital image signal is obtained without the irradiation with the ultraviolet rays, so that it represents the image data of elements other than carbon contained in the carbon containing substances under observation. That is to say, the second image signal may be considered to be noise contained in the first digital image signal. Therefore, by deriving a difference between the first and second digital image signals (A-B), it is possible to obtain the digital image signal representing the distribution of carbon in the desired carbon containing substance under the observation.

Also in this embodiment, the sequence of the entry of the first and second digital image signals A and B may be reversed. This is particularly preferable in a case in which the specimen 58 might be strongly influenced by the irradiation with the ultraviolet rays. Further, it is also possible to provide an ultraviolet ray source such as Ti-supphire laser and dye laser separately form the X-ray source. Moreover, the output radiation from the SOR source may be used for generating the ultraviolet rays by means of the monochrometer.

Figure 36:
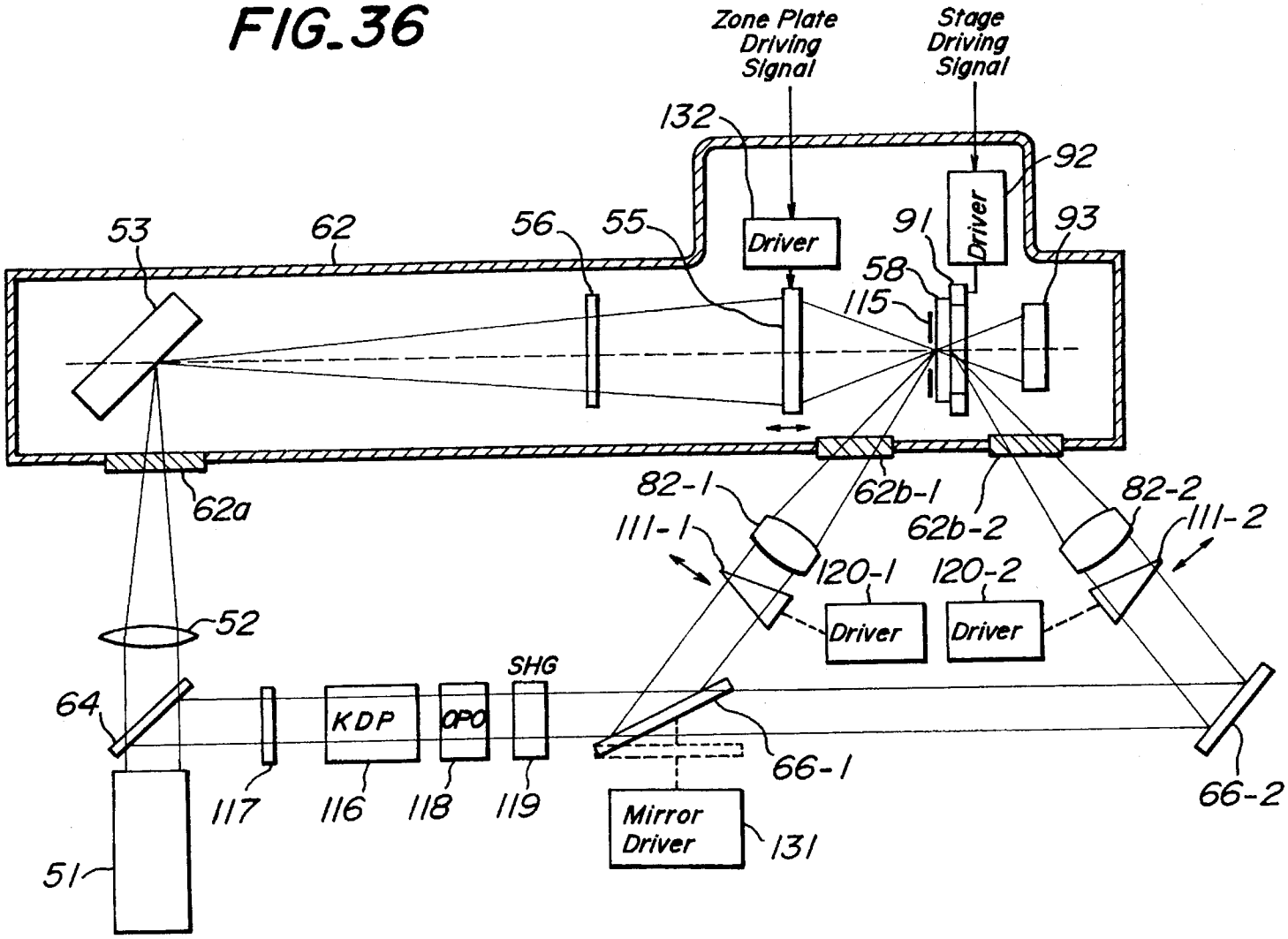
FIG. 36 is a schematic view illustrating a twelveth embodiment of the X-ray microscope according to the invention.

FIG. 36 is a schematic view showing a twelfth embodiment of the X-ray microscope according to the invention. The X-ray microscope of the present invention is constructed as the scanning type similar to the eighth embodiment illustrated in FIG. 23. In this embodiment, the X-rays are made incident upon the specimen 58 as a fine beam spot via the pin hole plate 115, and the specimen and beam spot are moved relative to each other to perform the scanning. To this end, the specimen 58 is supported on the stage 91 and the stage is moved perpendicularly to the X-ray optical axis in a two-dimensional manner by means of the stage driver 92 in accordance with the stage driving signal supplied from the host computer. The X-ray detector 93 is formed by any type detector instead of the image sensing type detector.

In the present embodiment, the ultraviolet rays may be selectively made incident upon the specimen 58 from its front and rear surfaces, so that it is no more necessary to turn over the specimen on the stage 91. That it to say, there are provided singable mirror 66-1 and mirror driver 131. When the singable mirror 66-1 is driven into a position shown by a solid line in FIG. 36, the ultraviolet rays emanating from the SHG 119 are reflected by the mirror 66-1 and are made incident upon the front surface of the specimen 58 by means of first glass wedge 111-1, first condenser lens 82-1 and first UV transmissive window **62*b*-1. The position of the first wedge 111-1 is controlled by a first wedge driver 120-1 to adjust an amount of the ultraviolet rays to be made incident upon the specimen. When the singable mirror 66-1 is driven into a position depicted by a broken line, the ultraviolet rays are reflected by a stationary mirror 66-2 and are then made incident upon the rear surface of the specimen 58 by means of second glass wedge 111-2, second condenser lens 82-2 and second UV transmissive window 62*b*-2. The position of the second wedge 111-2 can be changed by a second wedge driver 120-2** to adjust an amount of the ultraviolet rays.

Further, the X-ray objective lens 55 is formed by the zone plate and a position of the zone plate is changed by a zone plate driver 132 along the X-ray optical axis such that the X-rays are focused on the front or rear surface of the specimen 58. That is to say, when the ultraviolet rays are made incident upon the front surface of the specimen 58, the zone plate objective lens 55 is moved into such a position that the X-rays are focused on the front surface of the specimen, and when the ultraviolet rays are made incident upon the rear surface of the specimen 58, the zone plate objective lens is moved into such a position that the X-rays are focused on the rear surface of the specimen.

Figure 37:
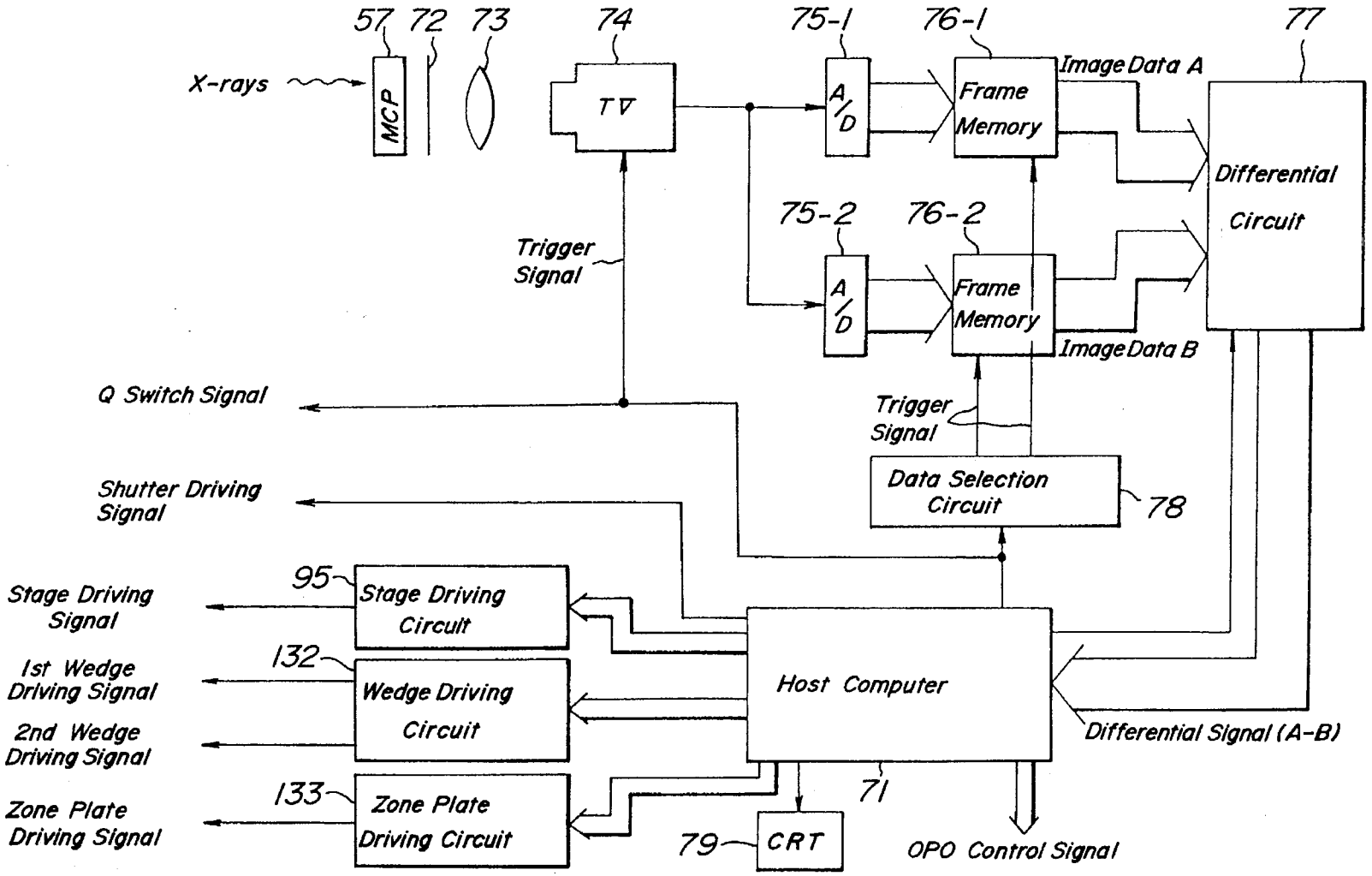
FIG. 37 is a block diagram showing the signal processing circuit of the twelveth embodiment.

FIG. 37 is a block diagram showing the signal processing circuit of the present embodiment. The host computer 71 generates commands for controlling the Nd:YAG laser 51, stage 91, shutter 117, OPO 118, first and second wedges 111-1, 111-2 and zone plate condenser lens 54. There are arranged stage driving circuit 95 for generating the stage driving signal, wedge driving circuit 132 for generating the first and second wedge driving signals, and zone plate driving circuit 133 for producing the zone plate driving signal.

When the front surface of the specimen 58 is observed, at first the X-rays are focused on to the front surface of the specimen, and at the same time the ultraviolet rays having the wavelength adjusted by the OPO 118 are made incident upon the front surface of the specimen 58 by positioning the singable mirror 66-1 into the position shown by the solid line in FIG. 36. Also in this case, the first wedge 111-1 is moved such that an amount of the ultraviolet rays is adjusted to a desired value. Then, the stage 91 supporting the specimen 58 is moved by the stage driver 92 to scan the front surface of the specimen. In this manner, a first digital image signal A with the irradiation with the ultraviolet rays is stored in the first frame memory 76-1. After that, the shutter 117 is closed to stop the irradiation with the ultraviolet rays and the stage 91 is moved again to scan the front surface of the specimen to store a second digital image signal B without the irradiation with the ultraviolet rays is stored in the second frame memory 76-2. By deriving the differential signal A-B, it is possible to obtain the image signal representing the X-ray microscopic image of carbon contained in the desired substance in the specimen 58.

Next, the singable mirror 66-1 is moved into the position shown by the broken line in FIG. 36 and the ultraviolet rays are made incident upon the rear surface of the specimen 58. At the same time, the zone plate objective lens 55 is moved such that the X-rays are focused on the rear surface of the specimen. Then, the shutter 117 is opened and the stage 91 is moved to scan the rear surface of the specimen 58. During this scanning, a first digital image signal A' is stored in the first memory 76-1. Next, the shutter 117 is closed and the scanning is performed by moving the stage 91 and a second digital image signal B' is stored in the second frame memory 76-2. By deriving a differential signal A'-B, it is possible to obtain an image signal representing the transmitted X-ray image of carbon of the desired substance in the specimen.

In the present embodiment, in addition to the advantages attained by the eleventh embodiment depicted in FIG. 33, there is obtained an advantage that the front and rear surfaces of the specimen can be observed without turning over the specimen on the stage 91. In this case, upon observing the rear surface of the specimen, the pin hole plate 115 may be removed from the front surface of the specimen and a separate pin hole plate is arranged on the rear surface. However, an aperture of the pin hole plate 115 is sufficiently large such that the effective X-rays are not shielded by the pin hole plate even when the rear surface of the specimen is observed, it is no more necessary to remove the pin hole and to arrange another pin hole plate on the rear surface of the specimen.

The present invention also proposes the secondary electron spectrometer, in which an observed element can be precisely judged and a particular element contained in a particular substance can be selectively observed without the influence of the same element contained in other substances.

Figure 38:
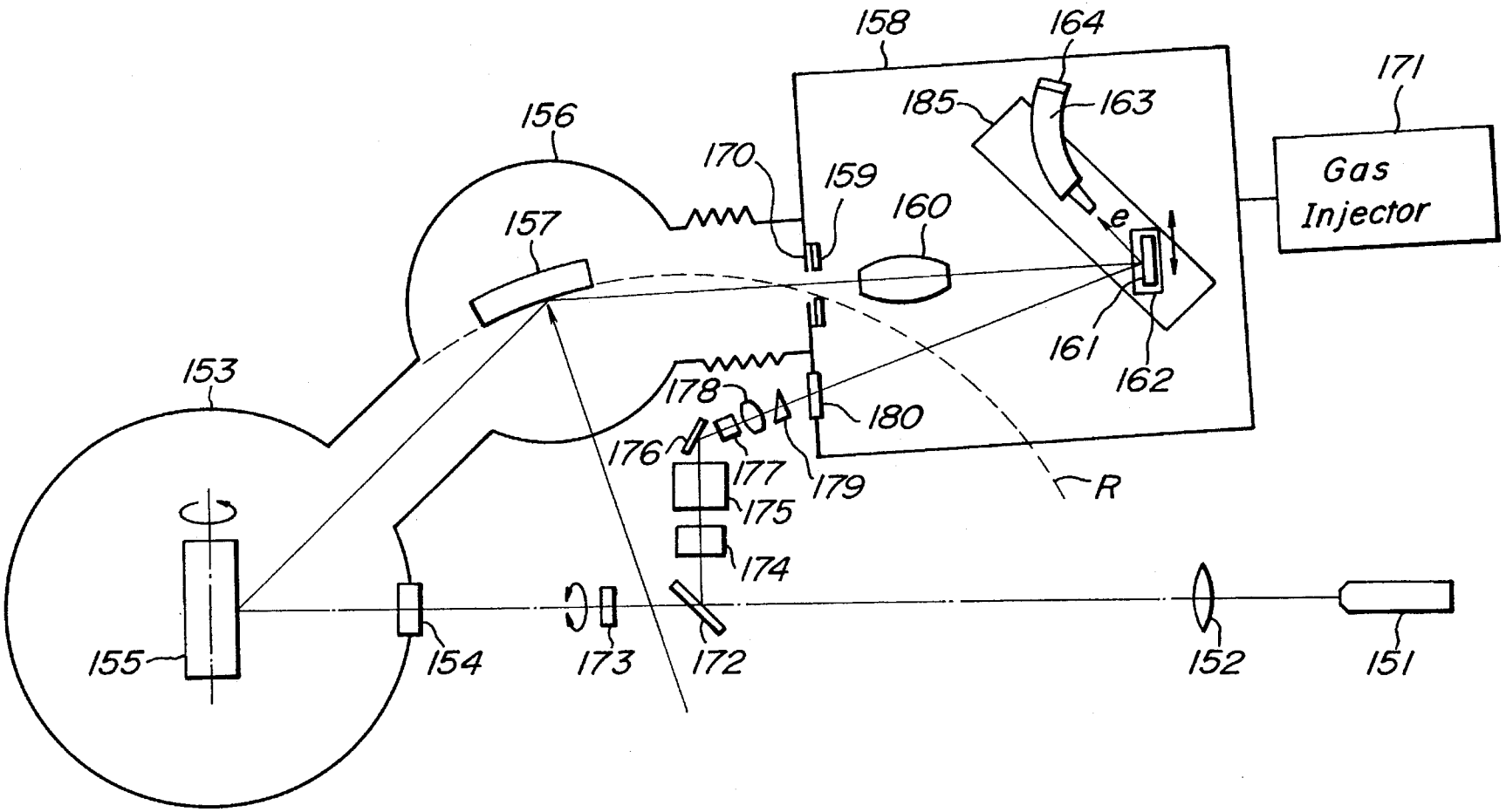
FIG. 38 is a schematic view depciting an embodiment of the secondary electron spectrometer according to the invention.

FIG. 38 is a schematic view showing an embodiment of the secondary electron spectrometer according to the invention. A laser beam emitted by YAG laser 151 is converged by a condenser lens 152 and then is made incident upon a polarizer 173 via a half mirror 172. The polarizer 173 is arranged rotatably so that an amount of the laser light passing through the polarizer can be adjusted. The laser beam emanating from the the polarizer 173 is made incident upon a target 155 arranged within a vacuum chamber 153 via a window 154 formed in a wall of the vacuum chamber. Then, a part of the target 155 is brought into a plasma state to emit soft X-rays. The X-rays emitted by the target 155 are made incident upon a concave diffraction grating 157 arranged within a vacuum chamber 156 which is communicated with the vacuum chamber 153. Therefore, the soft X-rays are dispersed by the concave grating 157 and a part of the soft X-rays having a given wavelength are introduced into a vacuum chamber 158 communicated with the vacuum chamber 156.

Within the vacuum chamber 158, there are arranged slit 159, X-ray optical element 160 such as Wolter optical element, holder 162 for holding a specimen 161, electron monochrometer 163 and microchannel plate (MCP) 164. Between the vacuum chambers 156 and 158, there is provided bellows and the vacuum chamber 158 is arranged movably along a Rowland circle R of the concave diffraction grating 157.

Figure 39:
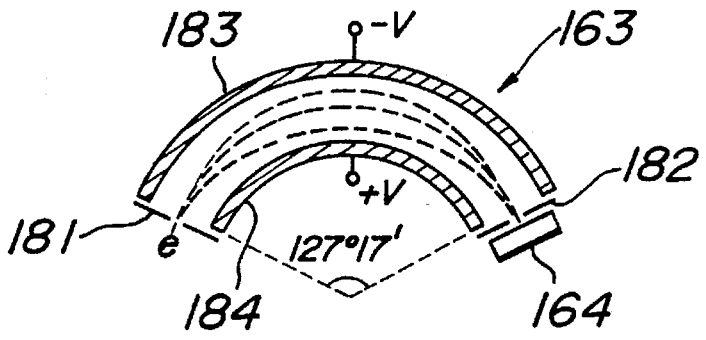
FIG. 39 is a cross sectional view showing a detailed construction of the electron monochrometer in FIG. 38.

FIG. 39 is a cross-section illustrating the electron monochrometer 163. The electron monochrometer 163 comprises inlet and outlet slits 181 and 182, and cylindrical electrodes 183 and 184 arranged between the inlet and outlet slits. The MCP 164 is arranged in opposition to the outlet slit 182. The assembly of the electron monochrometer 163 and MCP 164 is arranged on a supporting plate 185 as shown in FIG. 38. The specimen holder 162 is also arranged on the supporting plate 185 movably in a plane perpendicular to the X-ray optical axis.

Between the vacuum chambers 156 and 158, there is arranged a lid 170 for selectively closing the communication path between these vacuum chambers. To the specimen vacuum chamber 158 is connected a gas injector 171 for introducing a nitrogen gas into the specimen vacuum chamber 158 prior to the observation. It should be noted that the vacuum chambers 153, 156 and 158 are evacuated up to a pressure of $10^{-4}$ to $10^{-6}$ Torr.

A part of the laser beam emitted from the YAG laser 151 is divided by the half mirror 172 and the thus divided laser beam is made incident upon a non-linear crystal 174 and is converted into third harmonics having a wavelength in the ultraviolet region. The ultraviolet rays emanating from the non-linear crystal 174 are then made incident upon an optical parametric oscillator (OPO) 175 to adjust the wavelength of the ultraviolet rays. The ultraviolet rays enamating from the OPO 175 are made incident upon a second harmonic generator (SHG) 177 via a mirror 176 and are converted into a second harmonic. The thus obtained ultraviolet rays having a desired wavelength are made incident upon the specimen 161 by means of condenser lens 178, glass wedge 179 and UV transmissive window 180 formed in a wall of the specimen vacuum chamber 158.

The construction of the OPO 175 is identical with that shown in FIG. 34. The glass wedge 179 has the same function as the glass wedges of the previous embodiments and an amount of the ultraviolet rays to be made incident upon the specimen can be adjusted by moving the wedge in a direction perpendicular to the optical axis.

Figure 41A:
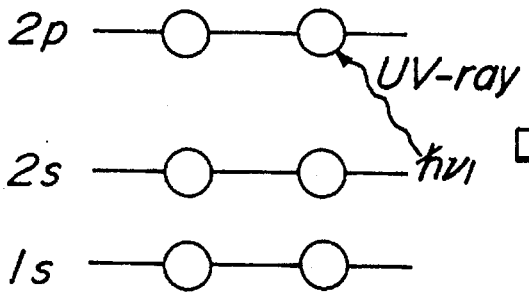
FIGS. 41A to 41F are diagrams for explaining the operation of the secondary electron spectrometer illustrated in FIG. 38.
Figure 41B:
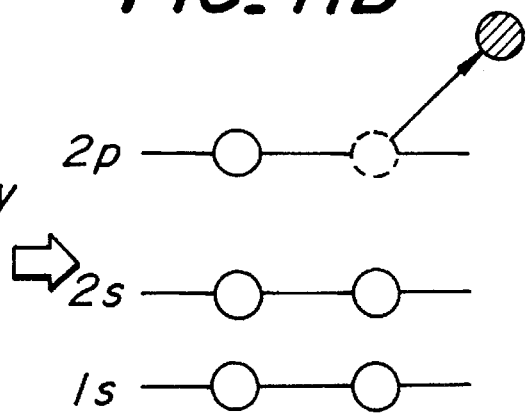
Figure 41C:
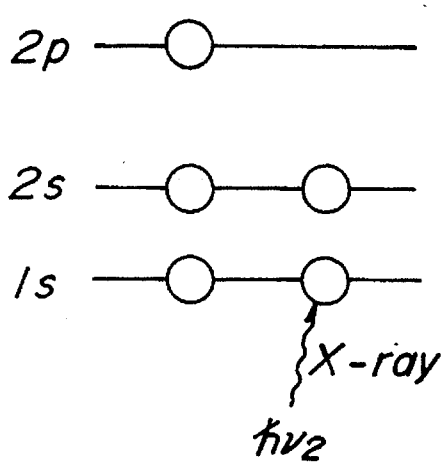
Figure 41D:
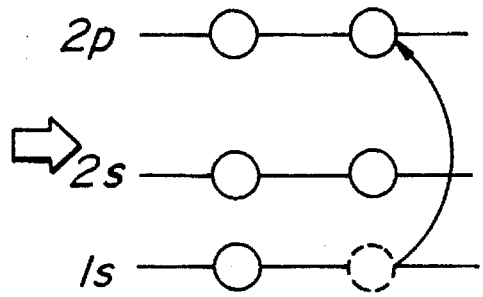
Figure 41E:
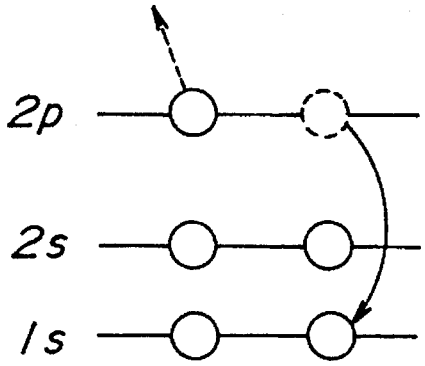
Figure 41F:
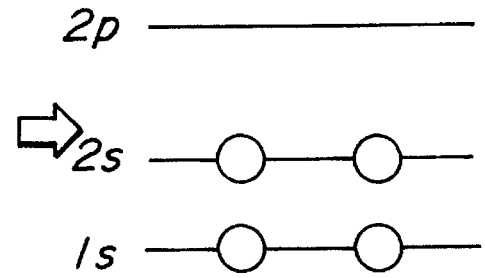

Now the operation of the secondary electron spectrometer of the present embodiment will be explained also with reference to diagrams shown in FIGS. 41A to 41F. These diagrams denote transitions of electrons when a carbon atom emits Auger electrons. In the known secondary spectrometer, the Auger electron is emitted by the direct irradiation with the X-rays. In the present embodiment, at first an electron in the 2*p* orbit of atom under the ground state is ionized or excited by the irradiation of the ultraviolet rays as shown in FIG. 41A. Therefore, in the 2*p* orbit, there is remained a hole as illustrated in FIG. 41B. Next, upon the irradiation with the X-rays as shown in FIG. 41C, an electron is excited from the 1*s* orbit into the hole in the 2*p* orbit as depicted in FIG. 41D. This state is very unstable, so that the electron in the 2*p* orbit is transferred into the hole in the 1*s* orbit as shown in FIG. 41E. During this transition, an electron in the 2*p* orbit is emitted therefrom and finally an electron state illustrated in FIG. 41F is obtained. In the secondary electron spectroscope, the electron emitted by the secondary emission shown in FIG. 41E is detected. According to the invention, carbon elements contained in a given protein in the specimen can be selectively observed by suitably selecting the wavelength of the ultraviolet rays in accordance with the table 2. That is to say, also in this embodiment, the wavelength of the ultraviolet rays is adjusted by controlling the OPO 175 like as the embodiments shown in FIGS. 33 and 36. When carbon in the triptophane is to be observed, the wavelength of the ultraviolet rays is set to a value within a range of 205 to 230 nm. An amount of the ultraviolet rays is adjusted by moving the glass wedge 179. Further, an amount of the X-rays to be made incident upon the specimen 161 is adjusted by rotating the polarizer 173 such that the inner-shell electron could not be excited or ionized into the outer-shell hole solely by the irradiation with the X-rays, but when carbon is excited with the ultraviolet rays, the transition of the inner-shell electron into the outer-shell hole is performed with the X-rays. Therefore, carbon elements contained in other substances than the UV excited substance are not excited or ionized by the X-rays. In this manner, only carbon in the desired substance can be observed without being affected by carbon contained in other substances.

The specimen vacuum chamber 158 is moved relative to the vacuum chamber 156 along the Rowland circle R, so that the wavelength of the X-rays introduced into the specimen vacuum chamber is selected and the X-rays having the thus selected wavelength are made incident upon the specimen 161 by means of the X-ray optical system 160. When it is required to change the wavelength of the X-rays in accordance with a substance to be observed, the concave diffraction grating 157 is adjusted.

The secondary electrons emitted from the specimen 161 by the irradiation with ultraviolet rays and X-rays are detected by the MCP 164, while the voltage applied across the cylindrical electrodes 183, 184 is continuously changed to scan the energy of the secondary electrons. Under a certain voltage condition, secondary electrons having a predetermined kinetic energy are deflected to follow a circular locus between the electrodes 183, 184 and can exit from the outlet slit 182. In this manner, only the secondary electrons having the predetermined kinetic energy can be selectively detected, and thus by changing the voltage across the electrodes 183, 184, it is possible to scan the kinetic energy of the secondary electrons. As explained above, according to the invention, by using both the X-rays and ultraviolet rays, it is possible to emit the secondary electrons only from carbon contained in a particular substance (protein).

In the present embodiment, the power spectrum of the secondary electron is measured, while the specimen vacuum chamber 158 is filled with the He gas from the gas injector 171. Then, a measured energy value is compared with a known energy of the secondary resonance line of the He gas to derive a difference therebetween. Finally, this difference is subtracted from the measured energy value of the secondary electron emitted by the specimen to derive a calculated or corrected value.

Figure 40:
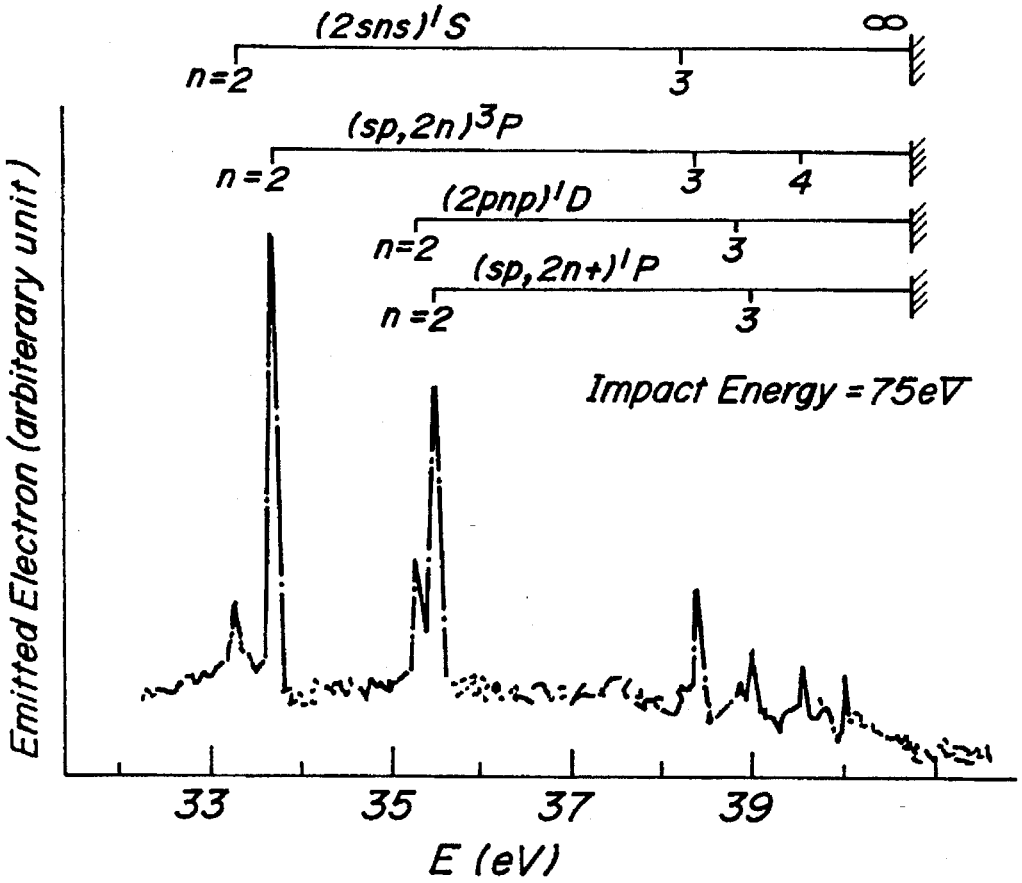
FIG. 40 is a graph showing the resonance lines of carbon.

FIG. 40 shows the energy spectrum of the resonance lines due to the autoionization resonance of the He gas by the electron impact. The energy values of these resonance lines are known, and particularly when the He gas is subjected to the electron impact, signals due to ionization other than the resonance lines are very small and the autoionization resonance lines appear only in a region below 40 eV. Therefore, the background noise in the analysis of the secondary electron of the specimen can be decreased. As stated above, by deriving the difference between the known energy value of the secondary electron of the He gas and the actually measured energy value, it is possible to know a fluctuation in the energy value due to the undesired electromagnetic field within the electron monochorometer 163. Therefore, this fluctuation is subtracted from the actually measured value, an absolute value of the energy of the secondary electron emitted from the specimen can be determined accurately.

In the present embodiment, the specimen vacuum chamber is filled with the He gas, but according to the invention any other gas may be used in accordance with a particle beam to be made incident upon the specimen. For instance, a photon beam such as X-rays is used, Auger electrons are emitted rather than the auto-ionization resonance lines, and therefore a Kr gas having the known energy spectrum of the MNN Auger resonance lines may be advantageously used for correcting the measured energy values. Further, the electron monochrometer may be formed by any other type than the coaxial cylindrical electrostatic type shown in FIG. 39. For instance, use may be made of an electrostatic type electron monochrometer such as electrostatic type parallel plane electron monochrometer, electrostatic type semi-spherical electron monochrometer, electrostatic type cylindrical mirror electron monochrometer, or electrostatic electric field blocking type electron monochrometer, in which the charged particles are deflected by the electric field. Alternatively it is possible to use a magnetic field type electron monochrometer when a kinetic energy of the charged particles is large. Moreover, instead of the multichannel plate 164, use may be made of an electron multiplier.

As explained above, in the present embodiment, the specimen is irradiated with the X-rays as well as the ultraviolet rays to emit the secondary electrons and the thus emitted secondary electrons are detected by means of the electron monochrometer, so that by adjusting the wavelength of the ultraviolet rays in accordance with a particular substance in the specimen, particular element contained in the relevant substance can be selectively observed without being affected by the same element contained in other substances in the specimen.

What is claimed is:

1. In an X-ray microscope in which a specimen is irradiated with X-rays having a wave length region of 65 to 43.7Å and ultraviolet rays and X-rays transmitted through the specimen are received by an X-ray detector to form a transmitted X-ray microscopic image of the specimen, the improvement being characterized in that a ultraviolet transmissive window is provided in a wall of a vacuum chamber in which an X-ray optical system of the X-ray microscope is arranged and the ultraviolet rays are made incident upon the specimen through said window as a converged or parallel ultraviolet beam.

* * * * *